US005947096A

United States Patent [19]

Kurokawa et al.

[11] Patent Number: 5,947,096

[45] Date of Patent: Sep. 7, 1999

[54] AIR-FUEL RATIO CONTROL SYSTEM FOR INTERNAL COMBUSTION ENGINES

[75] Inventors: Naohiro Kurokawa; Toru Kitamura; Akira Kato, all of Wako, Japan

[73] Assignee: Honda Giken Kogyo Kabushiki Kaisha, Tokyo, Japan

[21] Appl. No.: 08/937,747

[22] Filed: Sep. 25, 1997

[30] Foreign Application Priority Data

Sep. 26, 1996 [JP] Japan ..... 8-273963
May 15, 1997 [JP] Japan ..... 9-139104

[51] Int. Cl.[6] ..... F02D 41/00

[52] U.S. Cl. ..... 123/673; 123/674; 123/679; 701/109

[58] Field of Search ..... 123/673, 674, 123/688, 679; 701/109, 114; 73/118.1

[56] References Cited

U.S. PATENT DOCUMENTS 5,485,826 1/1996 Ohata et al. ..... 123/679
5,619,976 4/1997 Kitagawa et al. ..... 123/679
5,657,735 8/1997 Maki et al. ..... 123/673

FOREIGN PATENT DOCUMENTS 7-259588 10/1995 Japan .

*Primary Examiner*—Tony M. Argenbright
*Assistant Examiner*—Mahmoud M Gimie
*Attorney, Agent, or Firm*—Nikaido Marmelstein Murray & Oram LLP

[57] ABSTRACT

An air-fuel ratio control system for an internal combustion engine includes an air-fuel ratio sensor for detecting the air-fuel ratio of exhaust gases from the engine. An ECU estimates the air-fuel ratio of a mixture supplied to each of the cylinders cylinder by cylinder in response to an output from the air-fuel ratio sensor, by using an observer based on a model representative of the behavior of the exhaust system. Cylinder-by-cylinder air-fuel ratio control amounts corresponding respectively to the cylinders are calculated for carrying out feedback control of the air-fuel ratio of the mixture such that each of the estimated air-fuel ratio is converged to a desired value. One of the cylinder-by-cylinder air-fuel ratio control amounts corresponding to one of the cylinders is held at a predetermined value, and it is determined whether relationships in value between ones of the cylinder-by-cylinder air-fuel ratio control amounts corresponding respectively to cylinders other than the one cylinder and a plurality of predetermined determination values meet a predetermined determination pattern. When the relationships meet the predetermined determination pattern, it is determined that the response speed of the air-fuel ratio sensor has changed.

12 Claims, 34 Drawing Sheets

NE
PBA
θTH
PA
B1
TIMF
B2
B3
B4
B5
B6
B7
B8
B9
KTOTAL
KCMDM
TOUT
TOUT
TOUT
TOUT
1
ENG
KOBSV#1
B11
OBSV
PID
PID
PID
PID
B12
B14
B15
B13
KOBSV#3
KOBSV#4
KOBSV#2
KLAF
KLAF
B18
PID
B16
LPF
KCMD
KCMD
B21
KCMD
B22
MIDO2 FB
KCMD
B23
KCMDM
17
LAF
22
LPF
B10
SELV
19
CAT
18
O2
20
CAT
23
LPF

*FIG.4A* TDC SIGNAL PULSES
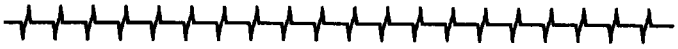
*FIG.4B* A/F AT CONFLUENT PORTION
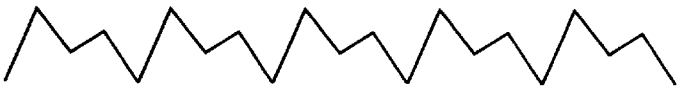

OPTIMUM
SAMPLING TIMING
BAD
SAMPLING TIMING

ACTUAL A/F

A/F
RECOGNIZED
BY ECU

KOBSV#1
KOBSV#4
KOBSV#2
KOBSV#3
KOBSVLMH
KOBSFSHH
KOBSFSHL
1.0
KOBSFSLH
KOBSFSLL
KOBSVLML tmOBSVFS

FOBSVFS
t1
t2
t

TMOBSHLD
TMOBSHLD3
TMOBSHLD2
TMOBSHLD1
t
FIG.31A tmOBSHLD
FIG.31B FOBSHLD1
FIG.31C FOBSHLD2
FIG.31D FOBSHLD3
FIG.31E FOBSHLD4
1
0

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which feedback-controls the air-fuel ratio of a mixture supplied to the engine cylinder by cylinder, by means of feedback control to which an observer based on a modern control theory is applied.

2. Prior Art

Conventionally, there has been proposed an air-fuel ratio control system for internal combustion engines, for example, by Japanese Laid-Open Patent (Kokai) No. 7-259588, which applies an observer which estimates the air-fuel ratio of a mixture supplied to each cylinder (cylinder-by-cylinder air-fuel ratio), based on an output from air-fuel ratio-detecting means, arranged in the exhaust system of the engine at a confluent portion thereof, for generating an output proportional to the air-fuel ratio of exhaust gases, and calculates an air-fuel ratio control amount based on the estimated air-fuel ratio values so as to eliminate variations in the controlled air-fuel ratio between the cylinders. According to the proposed air-fuel ratio control system, values of the output from the air-fuel ratio-detecting means are sequentially sampled and stored, and the sampling timing of the output from the air-fuel ratio-detecting means is corrected based on operating conditions of the engine and a degree of deterioration of the air-fuel ratio-detecting means, to select a value of the output from the stored values according to the corrected sampling timing, to thereby always detect the optimum air-fuel ratio. In this proposed air-fuel ratio control system, when fuel-cut (interruption of fuel supply to the engine) is carried out, a delay time from the actual start of the fuel-cut to the time the output from the air-fuel ratio-detecting means indicates a lean air-fuel ratio value is actually detected, and a change in the response speed of the air-fuel ratio-detecting means is detected based on the detected delay time.

According to this manner of detecting the response speed change, however, values of the output from the air-fuel ratio-detecting means must be monitored at very short sampling intervals in order to accurately detect the delay time, which requires a specific detecting process executed at time intervals (repetition period) much shorter than those of an ordinary air-fuel ratio control process.

Further, when the response speed change of the air-fuel ratio-detecting means exceeds an expected degree, correction of the sampling timing cannot be executed, which can result in inaccurate estimation of the cylinder-by-cylinder air-fuel ratio. In such a case, if the feedback control is executed based on the estimated cylinder-by-cylinder air-fuel ratio, it can result in increased variations in the controlled air-fuel ratio between the cylinders.

SUMMARY OF THE INVENTION

It is a first object of the invention to provide an air-fuel ratio control system for internal combustion engines, which is capable of determining a change in the response speed of the air-fuel ratio-detecting means during execution of an ordinary air-fuel ratio control process executed with an ordinary repetition period.

It is a second object of the invention to provide an air-fuel ratio control system for internal combustion engines, which is capable of accurately determining unevenness of the cylinder-by-cylinder air-fuel ratio between the cylinders of the engine due to deterioration of the air-fuel ratio-detecting means, to thereby prevent increased variations in the controlled air-fuel ratio between the cylinders.

To attain the first object, according to a first aspect of the invention, there is provided an air-fuel ratio control system for an internal combustion engine having a plurality of cylinders, and an exhaust system, including air-fuel ratio-detecting means arranged in the exhaust system, for detecting an air-fuel ratio of exhaust gases from the engine, cylinder-by-cylinder air-fuel ratio-estimating means for estimating an air-fuel ratio of a mixture supplied to each of the cylinders cylinder by cylinder in response to an output from the air-fuel ratio-detecting means, by using an observer for observing an internal operative state of the exhaust system based on a model representative of a behavior of the exhaust system, and cylinder-by-cylinder air-fuel ratio control means for calculating cylinder-by-cylinder air-fuel ratio control amounts corresponding respectively to the cylinders for carrying out feedback control of the air-fuel ratio of the mixture supplied to the each of the cylinders such that the estimated air-fuel ratio of the mixture supplied to the each of the cylinders is converged to a desired value, the air-fuel ratio control system being characterized by an improvement comprising:

response speed-determining means for holding one of the cylinder-by-cylinder air-fuel ratio control amounts corresponding to one of the cylinders at a predetermined value, determining whether relationships in value between ones of the cylinder-by-cylinder air-fuel ratio control amounts corresponding respectively to cylinders other than the one cylinder and a plurality of predetermined determination values meet a predetermined determination pattern, and determining that the response speed of the air-fuel ratio-detecting means has changed when the relationships meet the predetermined determination pattern.

Preferably, the plurality of the predetermined determination values comprise at least one predetermined determination value which is set between a central value of the cylinder-by-cylinder air-fuel ratio control amounts and an allowable upper limit value thereof, and at least one predetermined determination value which is set between the central value and an allowable lower limit value thereof.

Also preferably, the air-fuel ratio control system includes air-fuel ratio detection timing-correcting means responsive to a determination by the response speed-determining means that the response speed of the air-fuel ratio-detecting means has changed, for correcting timing of detection of the air-fuel ratio of the exhaust gases by the air-fuel ratio-detecting means, based on results of the determination.

Advantageously, the air-fuel ratio control system includes deterioration-determining means responsive to a determination by the response speed-determining means that the response speed of the air-fuel ratio-detecting means has changed, for determining that the air-fuel ratio-detecting means is deteriorated.

More preferably, the predetermined determination pattern comprises a first determination pattern for determining that the response speed of the air-fuel ratio-detecting means has become higher, and a second determination pattern for determining that the response speed of the air-fuel ratio detection means has become lower, the air-fuel ratio-detection timing-correcting means correcting the timing of detecting in a direction depending on whether the response speed-determining means has determined that the relationships meet the first determination pattern or the second determination pattern.

Advantageously, the response speed-determining means determines whether second relationships in value between the cylinder-by-cylinder air-fuel ratio control amounts corresponding respectively to all the cylinders and the plurality of predetermined determination values meet a predetermined held-to-limit pattern, and wherein when the second relationships meet the predetermined held-to-limit pattern, the response speed-determining means holds the one of the cylinder-by-cylinder air-fuel ratio control amounts corresponding to the one cylinder at the predetermined value and at the same time the cylinder-by-cylinder air-fuel ratio control means calculates the cylinder-by-cylinder air-fuel ratio control amounts corresponding respectively to the cylinders other than the one cylinder, the response speed-determining means determining whether the first-mentioned relationships in value between the calculated cylinder-by-cylinder air-fuel ratio control amounts and the plurality of the predetermined determination values meet the predetermined determination pattern, and determining that the response speed of the air-fuel ratio-detecting means has changed when the first-mentioned relationships meet the predetermined determination pattern.

Preferably, the response speed-determining means sequentially changes the one cylinder of which the one of the cylinder-by-cylinder air-fuel ratio control amounts is held at the predetermined value, with a predetermined repetition period.

To attain the second object, according to a second aspect of the invention, there is provided an air-fuel ratio control system for an internal combustion engine having a plurality of cylinders, and an exhaust system, including air-fuel ratio-detecting means arranged in the exhaust system, for detecting an air-fuel ratio of exhaust gases from the engine, cylinder-by-cylinder air-fuel ratio-estimating means for estimating an air-fuel ratio of a mixture supplied to each of the cylinders cylinder by cylinder in response to an output from the air-fuel ratio-detecting means, by using an observer for observing an internal operative state of the exhaust system based on a model representative of a behavior of the exhaust system, and cylinder-by-cylinder air-fuel ratio control means for calculating cylinder-by-cylinder air-fuel ratio control amounts corresponding respectively to the cylinders for carrying out feedback control of the air-fuel ratio of the mixture supplied to the each of the cylinders such that the estimated air-fuel ratio of the mixture supplied to the each of the cylinders is converged to a desired value, the air-fuel ratio control system being characterized by an improvement comprising:

cylinder-by-cylinder control-interrupting means for determining whether relationships in value between the cylinder-by-cylinder air-fuel ratio control amounts corresponding respectively to the cylinders and a plurality of predetermined determination values meet a predetermined held-to-limit pattern, and interrupting the feedback control by the cylinder-by-cylinder air-fuel ratio control means when the relationships meet the predetermined held-to-limit pattern.

Preferably, the cylinder-by-cylinder control-interrupting means interrupts the feedback control by the cylinder-by-cylinder air-fuel ratio control means when the relationships have continuously met the predetermined held-to-limit state over a predetermined time period.

More preferably, the air-fuel ratio control system includes learned value-calculating means for calculating learned values of the cylinder-by-cylinder air-fuel ratio control amounts, and wherein the cylinder-by-cylinder control-interrupting means interrupts calculation of the learned values by the learned value-calculating means and at the same time initializes the learned values to a predetermined value when the relationships meet the predetermined held-to-limit pattern.

Preferably, the predetermined held-to-limit pattern is a pattern in which cylinder-by-cylinder air-fuel ratio control amounts corresponding to a cylinder group consisting of cylinders in which ignition takes place every other stroke deviate in the same direction and at the same time at least one of the cylinder-by-cylinder air-fuel ratio control amounts corresponding to at least one of the cylinders falls out of a range defined by the predetermined determination values.

More preferably, the plurality of the predetermined determination values comprise at least one predetermined determination value which is set between a central value of the cylinder-by-cylinder air-fuel ratio control amounts and an allowable upper limit value thereof, and at least one predetermined determination value which is set between the central value and an allowable lower limit value thereof.

The above and other objects, features, and advantages of the invention will become more apparent from the following detailed description taken in conjunction with the accompanying drawings.

BRIEF DESCRIPTION OF THE DRAWINGS

FIGS. 4A and 4B collectively form a timing chart showing the relationship between TDC signal pulses obtained from a multi-cylinder internal combustion engine and the air-fuel ratio detected at a confluent portion of the exhaust system of the engine, in which:

FIG. 4A shows TDC signal pulses obtained from the engine; and

FIG. 4B shows the air-fuel ratio detected at the confluent portion of the exhaust system;

FIGS. 5A and 5B show good and bad examples of timing of sampling an output from the LAF sensor, in which;

FIG. 5A shows examples of the sampling timing in relation to the actual air-fuel ratio; and FIG. 5B shows examples of the air-fuel ratio recognized by an ECU through sampling of the output from the LAF sensor;

FIGS. 21A to 21C collectively form a timing chart useful in explaining a control operation by the determining process of FIGS. 19 and 20, in which:

FIG. 21A shows changes in cylinder-by-cylinder correction coefficients KOBSV#1 to KOBSV#4;

FIG. 21B shows a change in the value of a timer tmOBSVFS; and

FIG. 21C shows a change in a held-to-limit flag FOBSVFS;

FIGS. 31A to 31E collectively form a timing chart useful in explaining a control operation of the third embodiment, in which:

FIG. 31A shows a change in the count value of an up-counting timer tmOBSHLD; and FIGS. 31B to 31E show changes in respective flags FOBSHLD1 to FOBSHLD4;

DETAILED DESCRIPTION

The invention will now be described in detail with reference to the drawings showing embodiments thereof.

Figure 1:
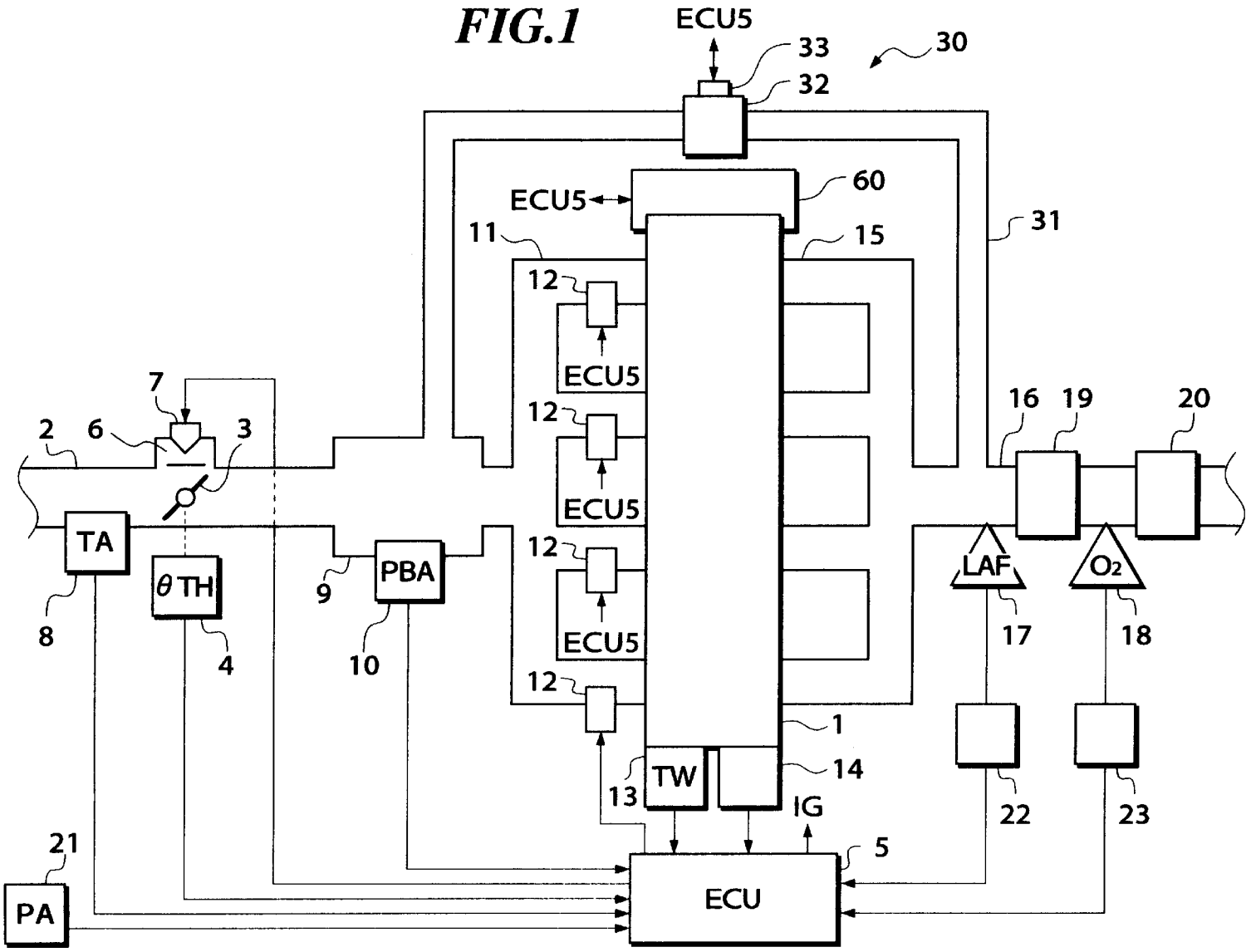
FIG. 1 is a block diagram showing the arrangement of an internal combustion engine incorporating an air-fuel ratio control system therefor, according to a first embodiment of the invention.

Referring first to FIG. 1, there is schematically shown the whole arrangement of an internal combustion engine and an air-fuel ratio control system therefor, according to a first embodiment of the invention. In the figure, reference numeral 1 designates a four-cylinder type internal combustion engine (hereinafter simply referred to as "the engine").

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged across the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion 9 as a chamber interposed between the throttle valve 3 and the intake manifold 11. An intake pipe absolute pressure (PBA) sensor 10 is arranged in the chamber 9, for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is electrically connected to the ECU 5 for supplying an electric signal indicative of the sensed rotational angle of the crankshaft to the ECU 5.

The crank angle position sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as fuel injection timing and ignition timing, and for detecting the engine rotational speed NE.

Fuel injection valves 12 are inserted into the intake manifold 11 for respective cylinders at locations slightly upstream of intake valves, not shown. The fuel injection valves 12 are connected to a fuel pump, not shown, and electrically connected to the ECU 5 to have the fuel injection timing and fuel injection periods (valve opening periods) thereof controlled by signals therefrom. Spark plugs, not shown, of the engine 1 are also electrically connected to the ECU 5 to have the ignition timing θIG thereof controlled by signals therefrom.

An exhaust pipe 16 of the engine has a manifold part (exhaust manifold) 15 directly connected to the combustion chambers of the cylinders of the engine 1. A linear output oxygen concentration sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17, for purifying noxious components present in exhaust gases, such as HC, CO, and NOx. An oxygen concentration sensor (hereinafter referred to as "the O2 sensor") 18 is inserted into the exhaust pipe 16 at a location intermediate between the three-way catalysts 19 and 20.

The LAF sensor 17 is electrically connected via a low-pass filter 22 to the ECU 5, for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is electrically connected via a low-pass filter 23 to the ECU 5, for supplying the ECU 5 with the high or low level signal.

The engine 1 is provided with an exhaust gas recirculation (EGR) system 30 which is comprised of an exhaust gas recirculation passage 31 extending between the chamber 9 of the intake pipe 2 and the exhaust pipe 16, an exhaust gas recirculation control valve (hereinafter referred to as "the EGR valve") 32 arranged across the exhaust gas recirculation passage 31, for controlling the amount of exhaust gases to be recirculated, and a lift sensor 33 for detecting the lift of the EGR valve 32 and supplying a signal indicative of the detected valve lift to the ECU 5. The EGR valve 32 is an electromagnetic valve having a solenoid which is electrically connected to the ECU 5, the valve lift of which is linearly changed by a control signal from the ECU 5.

The engine 1 includes a valve timing changeover mechanism 60 which changes valve timing of at least the intake valves out of the the intake valves and exhaust valves, not shown, between a high speed valve timing suitable for operation of the engine in a high speed operating region thereof and a low speed valve timing suitable for operation of the engine in a low speed operating region thereof. The changeover of the valve timing includes not only timing of opening and closing of the valve but also changeover of the valve lift amount, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve for changing the valve timing.

Further electrically connected to the ECU 5 is an atmospheric pressure (PA) sensor 21, for detecting atmospheric pressure PA, and supplying a signal indicative of the sensed atmospheric pressure PA to the ECU 5.

The ECU 5 is comprised of an input circuit having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as "the CPU"), a memory circuit comprised of a ROM storing various operational programs which are executed by the CPU and various maps and tables, referred to hereinafter, and a RAM for storing results of calculations from the CPU, etc., and an output circuit which outputs driving signals to the fuel injection valves 12 and other electromagnetic valves, the spark plugs, etc. The memory circuit is provided with a RAM (hereinafter referred to as "the back-up RAM") which is supplied with electric power from a battery, not shown, of a vehicle in which the engine is installed, even when an ignition switch, not shown, of the engine is off, to thereby preserve contents thereof.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT (N) over which the fuel injection valves 12 are to be opened, by the use of the following equation (1), to output signals for driving the fuel injection valves 12, based on the results of the calculation:

$$TOUT(N)=TIMF\times KTOTAL\times KCMDM\times KLAF\times KOBSV\#N \quad (1)$$

where TIMF represents a basic value of the fuel injection amount TOUT(N), KTOTAL a correction coefficient, KCMDM a final desired air-fuel ratio coefficient, KLAF an air-fuel ratio correction coefficient, and KOBSV#N a cylinder-by-cylinder correction coefficient, respectively.

Figure 2:
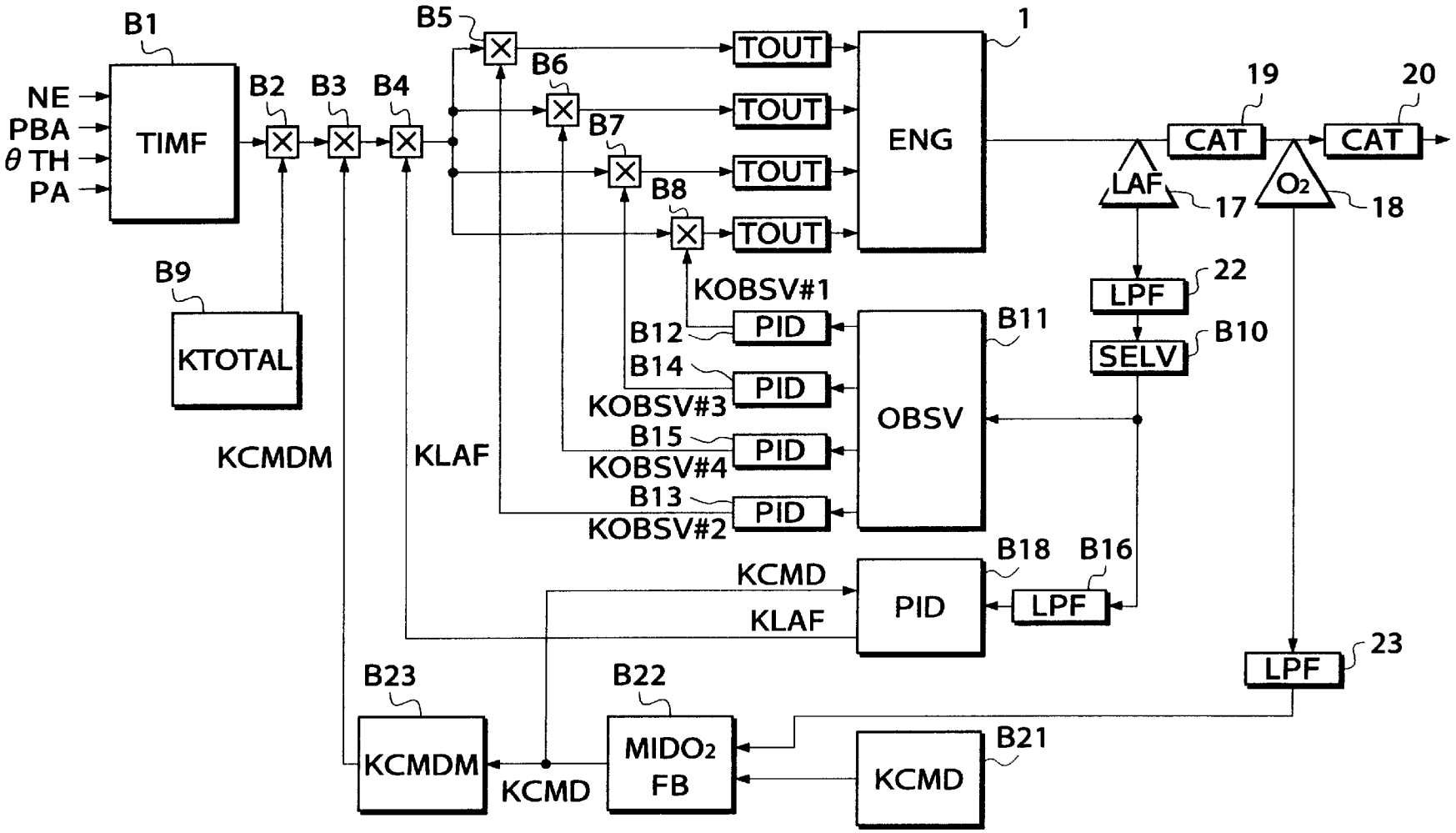
FIG. 2 is a block diagram useful in explaining a manner of controlling the air-fuel ratio of a mixture supplied to the engine.

FIG. 2 is a block diagram useful in explaining the manner of calculating the fuel injection period TOUT(N) by the use of the equation (1). With reference to the figure, an outline of the manner of calculating the fuel injection period TOUT (N) according to the present embodiment will be described. It should be noted that in the present embodiment, the amount of fuel to be supplied to the engine is calculated, actually, in terms of a time period over which the fuel injection valve 6 is opened (fuel injection period), but in the present specification, the fuel injection period TOUT(N) is referred to as the fuel injection amount or the fuel amount since the fuel injection period is equivalent to the amount of fuel injected or to be injected.

In FIG. 2, a block B1 calculates the basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B4 designate multiplying blocks, which multiply the basic fuel amount TIMF by respective parameter values input thereto, and deliver the product values. These blocks carry out the arithmetic operation of the equation (1), and generate fuel injection amounts TOUT(N).

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purging-dependent correction coefficient KPUG set according to an amount of purged evaporative fuel during execution of purging by an evaporative fuel-processing system of the engine, not shown, to obtain the correction coefficient KTOTAL, which is supplied to the block B2.

A block B21 determines a desired air-fuel ratio coefficient KCMD, based on the engine rotational speed NE, the intake pipe absolute pressure PBA, etc., and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to blocks B18 and B23. The block B23 carries out fuel cooling-dependent correction of the corrected KCMD value to calculate the final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values in a ring buffer memory, not shown, and selects one of the stored values depending on operating conditions of the engine (LAF sensor output-selecting process), which was sampled at the optimum timing for each cylinder, to supply the selected value to a block B11 and the block B18 via a low-pass filter block B16. The LAF sensor output-selecting process eliminates the inconveniences that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time or response speed of the LAF sensor per se changes depending on operating conditions of the engine.

The block B11 has the function of a so-called observer, i.e. a function of estimating a value of the air-fuel ratio separately for each cylinder from the air-fuel ratio (of a mixture of exhaust gases emitted from the cylinders) detected at the confluent portion of the exhaust system by the LAF sensor 17, and supplying the estimated value to a corresponding one of blocks B12 to B15 associated, respectively, with the four cylinders. In FIG. 2, the block B12 corresponds to a cylinder #1, the block B13 to a cylinder #2, the block B14 to a cylinder #3, and the block B15 to a cylinder #4. The blocks B12 to B15 calculate the cylinder-by-cylinder correction coefficient KOBSV#N (N=1 to 4) as a cylinder-by-cylinder air-fuel ratio control amount by PID control such that the air-fuel ratio of each cylinder (the value of the air-fuel ratio estimated by the observer B11 for each cylinder) becomes equal to a value of the air-fuel ratio detected at the confluent portion, and supply KOBSV#N values to the blocks B5 to B8, respectively.

The block B18 calculates the PID correction coefficient KLAF through the PID control, based on the difference between the actual air-fuel ratio and the desired air-fuel ratio and supplies the KLAF value to the block B4.

As described above, in the present embodiment, the fuel injection amount TOUT(N) is calculated cylinder by cylinder by applying to the equation (1) the PID correction coefficient KLAF which is calculated by the ordinary PID control according to the output from the LAF sensor 17, as well as applying to the same equation the cylinder-by-cylinder correction coefficient KOBSV#N which is set according to the air-fuel ratio of each cylinder estimated based on the output from the LAF sensor 17. Variations in the air-fuel ratio between the cylinders can be eliminated by the use of the cylinder-by-cylinder correction coefficient KOBSV#N to thereby improve the purifying efficiency of the catalysts and hence obtain good exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings.

Figure 3:
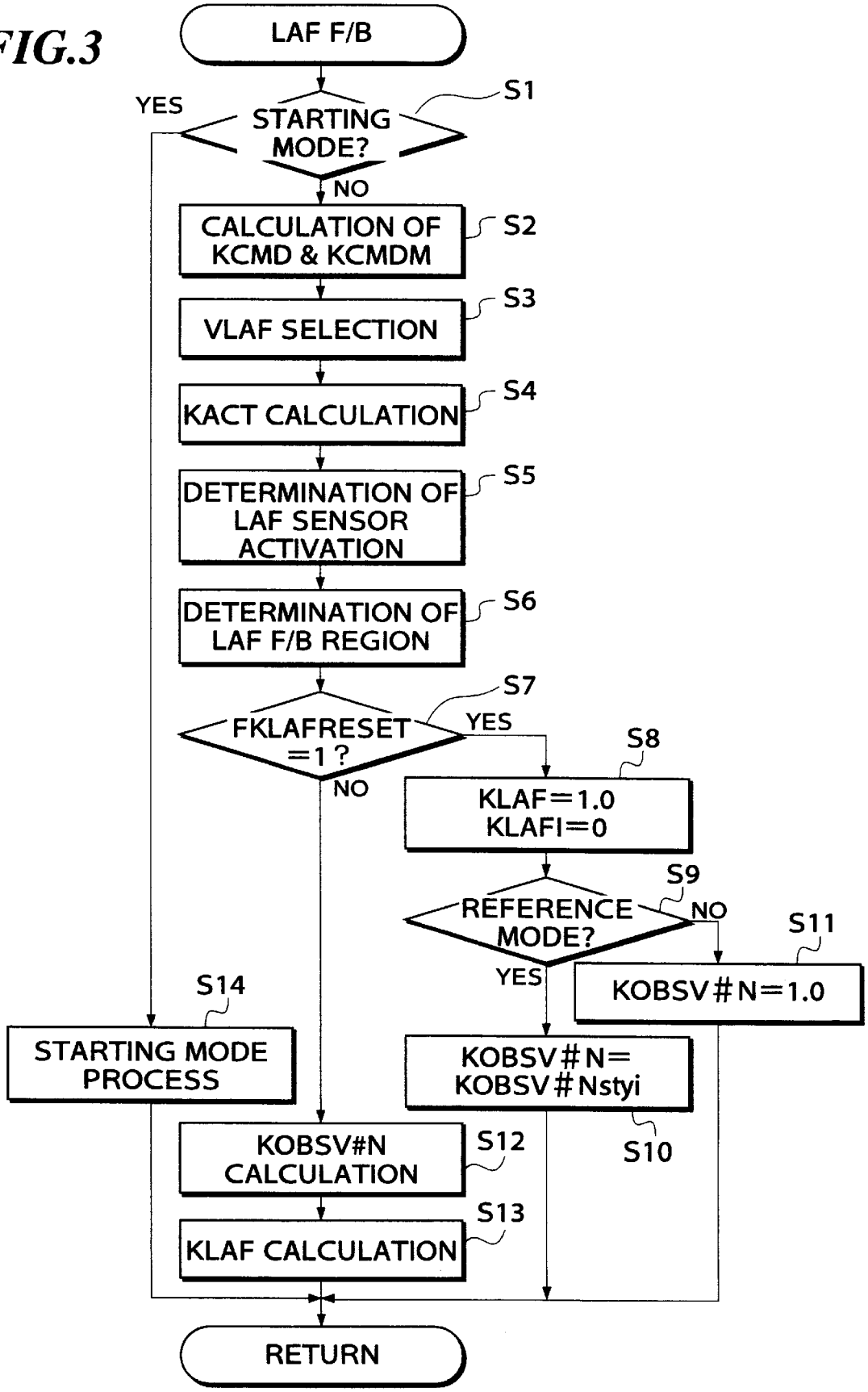
FIG. 3 is a flowchart showing a main routine for calculating a PID correction coefficient KLAF and a cylinder-by-cylinder correction coefficient KOBSV#N in response to an output from a LAF sensor appearing in FIG. 1.

FIG. 3 shows a main routine for calculating the PID correction coefficient KLAF and the cylinder-by-cylinder correction coefficient KOBSV#N in response to the output from the LAF sensor 17. This routine is executed in synchronism with generation of TDC signal pulses.

At a step S1, it is determined whether or not the engine is in a starting mode, i.e. whether or not the engine is cranking. If the engine is in the starting mode, the program proceeds to a step S14 to execute a subroutine for the starting mode, not shown. If the engine is not in the starting mode, the desired air-fuel ratio coefficient (desired equivalent ratio) KCMD and the final desired air-fuel ratio coefficient KCMDM are calculated at a step S2, and the LAF sensor output-selecting process is executed at a step S3. Further, an actual equivalent ratio KACT depending on the output from the LAF sensor is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region, e.g. when the LAF sensor 17 has been activated but at the same time neither fuel cut nor wide open throttle operation is being carried out. If it is determined that the engine is not in the LAF feedback control region, a reset flag FKLAFRESET which, when set to "1", indicates that the engine is not in the LAF feedback control region, is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRSET=1 holds, the program proceeds to a step S8, wherein the PID correction coefficient KLAF is set to "1.0" and at the same time an integral term KLAFI used in the PID control is set to "0". Then, it is determined at a step S9 whether or not the engine is in a reference mode where a learned value KOBSV#Nstyi, referred to hereinafter, of the cylinder-by-cylinder correction coefficient KOBSV#N is to be used. If it is determined that the engine is not in the reference mode, the cylinder-by-cylinder correction coefficient KOBSV#N is set to 1.0 at a step S11, followed by terminating the program. On the other hand, if the engine is in the reference mode, the cylinder-by-cylinder correction coefficient KOBSV#N is set to the learned value KOBSV#Nstyi thereof at a step S10, followed by terminating the present routine.

It is determined that the engine is in the reference mode, e.g. when the LAF sensor is inactive and at the same time the engine is in a predetermined operating condition (the engine rotational speed NE and the intake pipe absolute pressure PBA are in respective predetermined ranges). Further, the learned value KOBSV#Nstyi (i=1 to 3) is calculated for each of three operating regions of the engine, which are set according to the intake pipe absolute pressure PBA. Therefore, at the step S10, it is determined which of the three operating regions the engine is operating in, and the cylinder-by-cylinder correction coefficient KOBSV#N is set to the learned value KOBSV#Nstyi (i=1 to 3) corresponding to the determined operating region.

On the other hand, if FKLAFRESET=0 holds at the step S7, the cylinder-by-cylinder correction coefficient KOBSV#N and the PID correction coefficient KLAF are calculated at respective steps S12 and S13, followed by terminating the present routine.

Next, the LAF sensor output-selecting process executed at the step S3 in FIG. 3 will be described.

Figures 5A, 5B:
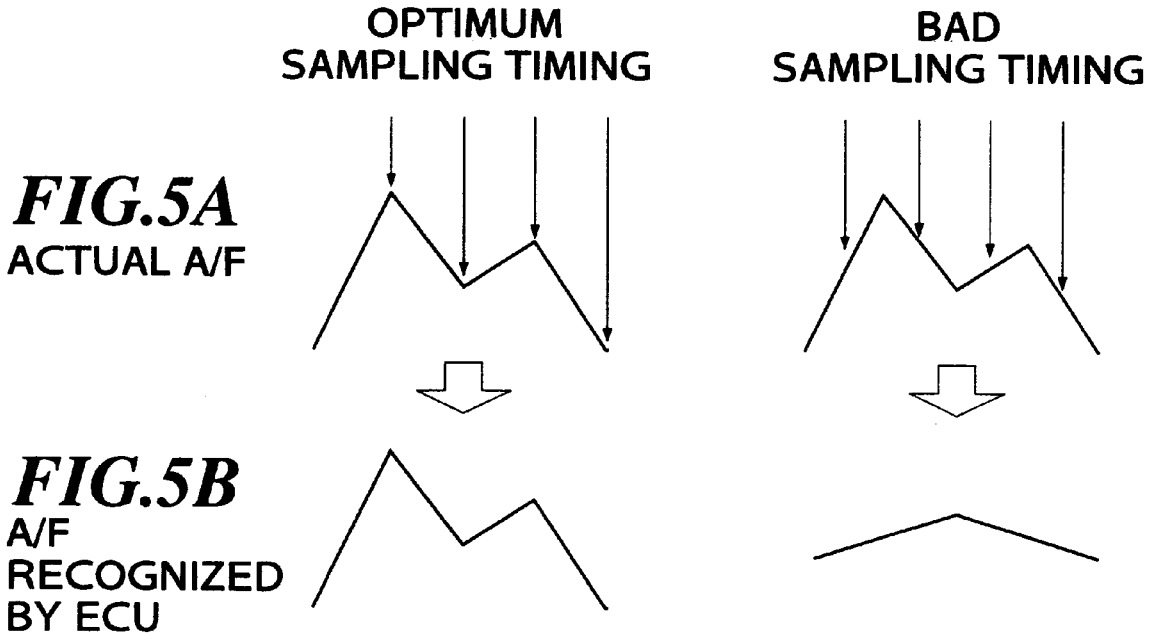

Exhaust gases are emitted from the engine on the exhaust stroke, and accordingly, clearly the behavior of the air-fuel ratio detected at the confluent portion of the exhaust system of the multi-cylinder engine is synchronous with generation of TDC signal pulses. Therefore, detection of the air-fuel ratio by the LAF sensor 17 is also required to be carried out in synchronism with generation of TDC signal pulses. However, depending on the timing of sampling the output from the LAF sensor 17, there are cases where the behavior of the air-fuel ratio cannot be accurately grasped. For example, if the air-fuel ratio detected at the confluent portion of the exhaust system varies as shown in FIG. 4B in comparison with timing of generation of each TDC signal pulse shown in FIG. 4A, the air-fuel ratio recognized by the ECU 5 can have quite different values depending on the timing of sampling, as shown in FIG. 5B. Therefore, it is desirable that the sampling of the output from the LAF sensor 17 should be carried out at such timing as enables the ECU 5 to recognize actual variation in the sensor output as accurately as possible.

Further, the variation in the air-fuel ratio also depends upon a time period required to elapse before exhaust gases emitted from the cylinder reach the LAF sensor 17 as well as upon the response time (response speed) of the LAF sensor 17. The required time period depends on the pressure and volume of exhaust gases, etc. Further, sampling of the sensor output in synchronism with generation of TDC signal pulses is equivalent to sampling of the same based on the crank angle position, so that the sampling result is inevitably influenced by the engine rotational speed NE. The optimum timing of detection of the air-fuel ratio thus largely depends upon operating conditions of the engine.

Figure 6:
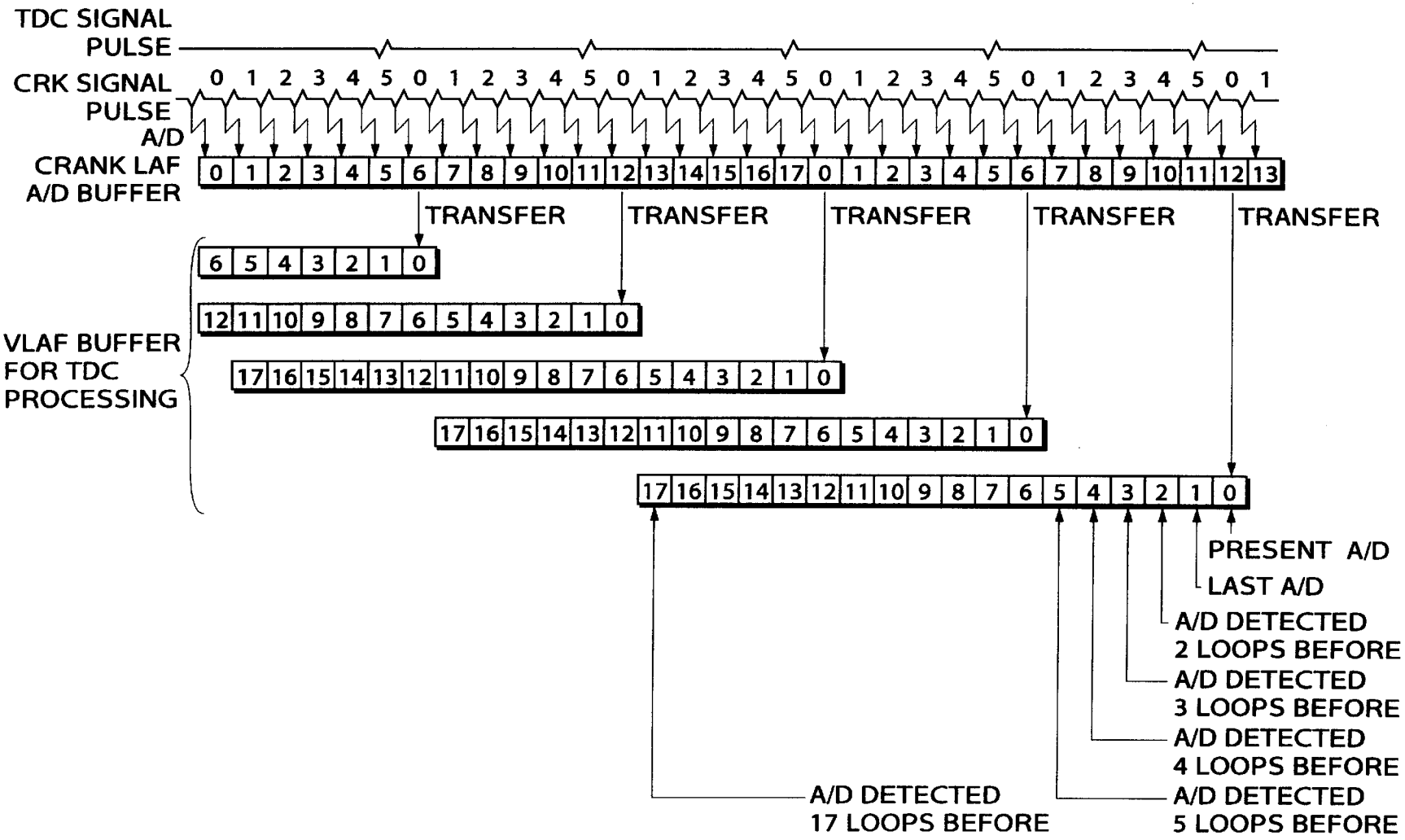
FIG. 6 is a diagram which is useful in explaining how to select a value of the output from the LAF sensor sampled at the optimum timing from values of the same sampled whenever a CRK signal pulse is generated.

In view of the above fact, in the present embodiment, as shown in FIG. 6, values of the output from the LAF sensor 17 sampled in synchronism with generation of CRK signal pulses (at crank angle intervals of 30 degrees) are sequentially stored in the ring buffer memory (having 18 storage locations in the present embodiment), and one sampled at the optimum timing (selected out of the values from a value obtained 17 loops before to the present value) is converted to the actual equivalent ratio KACT for use in the feedback control.

Figure 7:
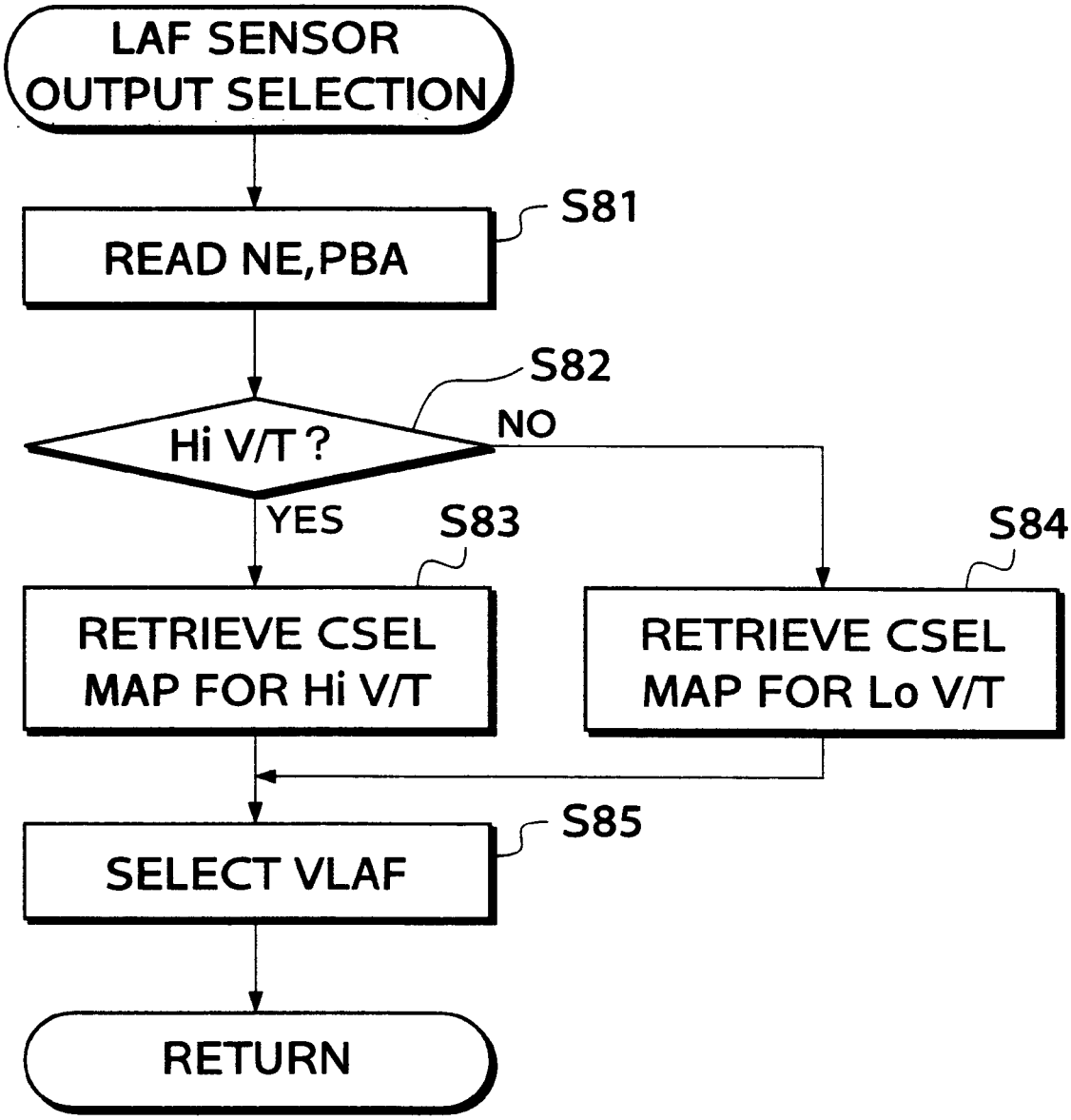
FIG. 7 is a flowchart showing a subroutine for selecting a value of the output from the LAF sensor (LAF sensor output value), which is executed at a step S3 in FIG. 3.

FIG. 7 shows a subroutine for carrying out the LAF sensor output-selecting process, which is executed at the step S3 in FIG. 3.

First, at a step S81, the engine rotational speed NE and the intake pipe absolute pressure PBA are read from the respective sensor outputs, and then it is determined at a step S82 whether or not the present valve timing is set to the high-speed valve timing. If the present valve timing is set to the high-speed valve timing, a CSEL map suitable for the high-speed valve timing is retrieved at a step S83, whereas if the same is set to the low-speed valve timing, a CSEL map suitable for the low-speed valve timing is retrieved at a step S84. Then, one of the LAF sensor output values VLAF stored in the ring buffer is selected according to the result of the retrieval at a step S85, followed by terminating the program.

Figure 8:
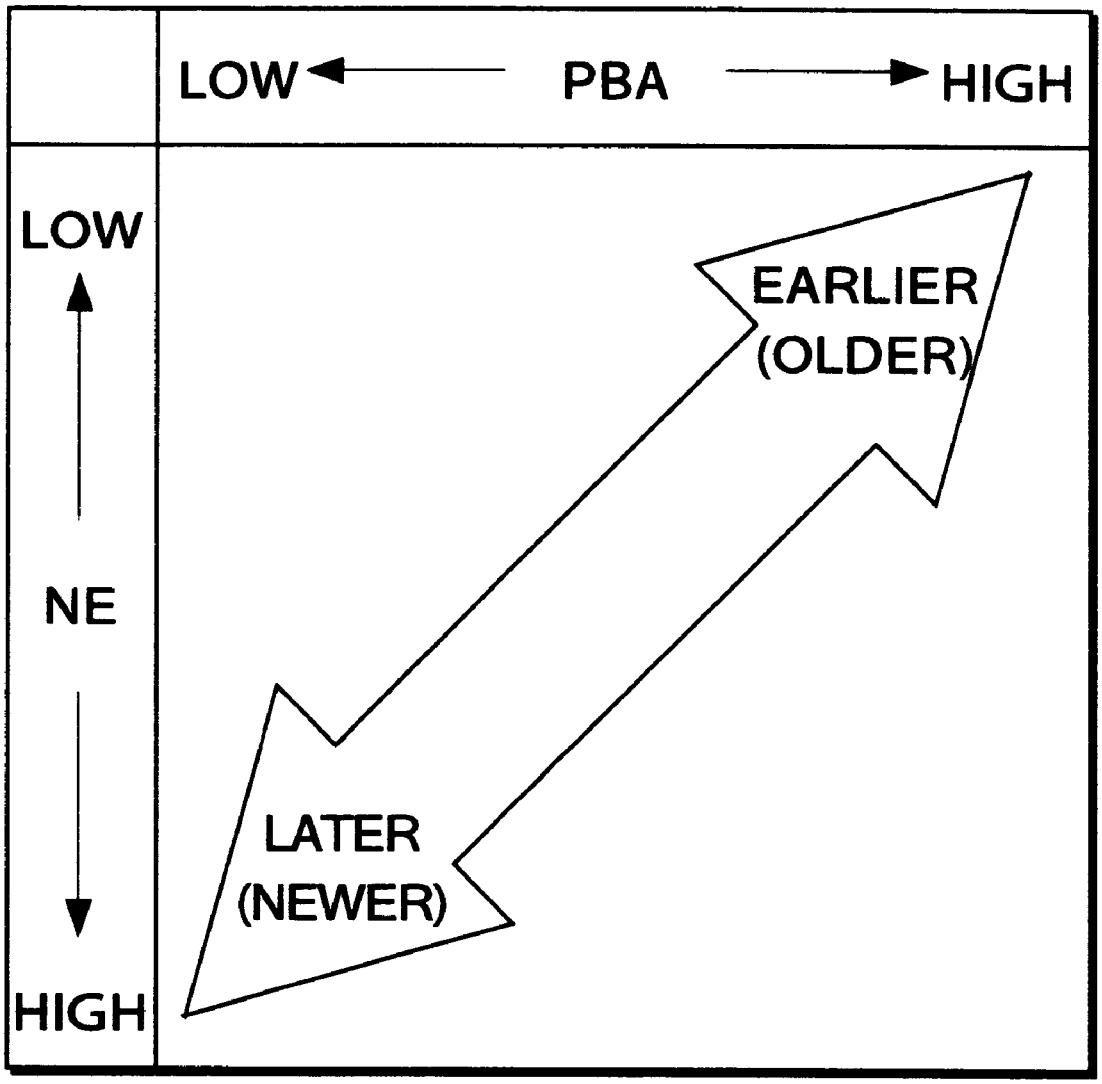
FIG. 8 is a diagram showing characteristics of timing maps used in the FIG. 7 subroutine.
Figure 9A:
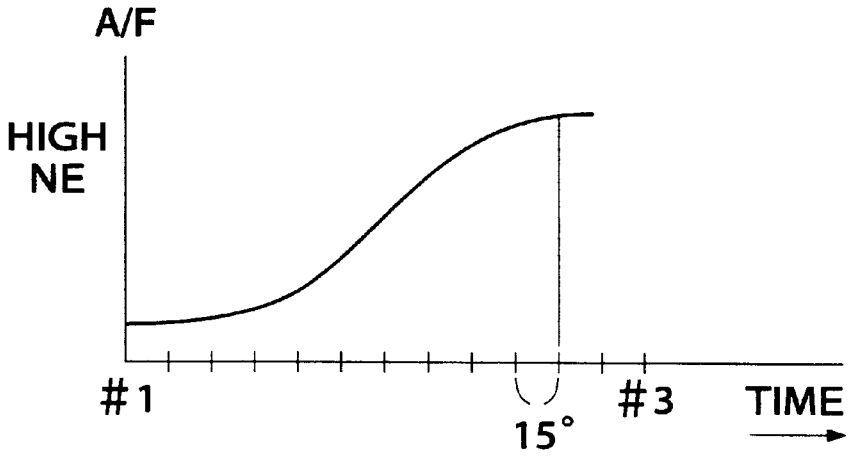
FIG. 9A is a diagram showing characteristics of the output from the LAF sensor assumed at a high engine rotational speed, which is useful in explaining the characteristics of the timing maps shown in FIG. 8.
Figure 9B:
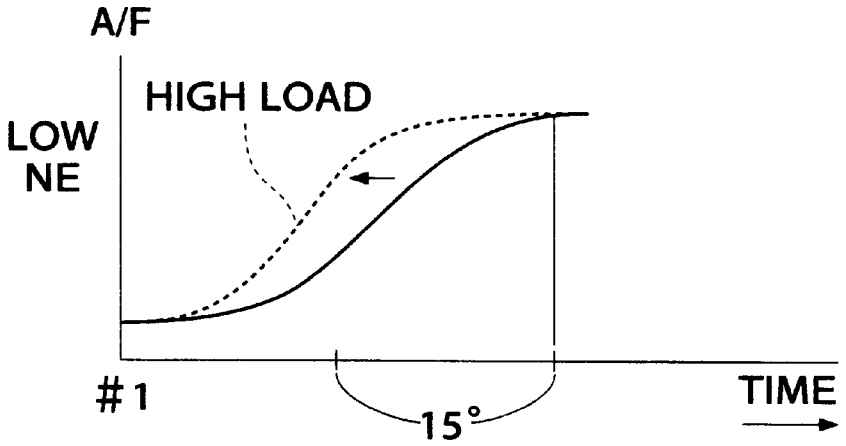
FIG. 9B is a diagram showing characteristics of the output from the LAF sensor assumed at a low engine rotational speed with a shift to be effected when a change in load on the engine occurs, which is useful in explaining the characteristics of the timing maps shown in FIG. 8.

The CSEL maps are stored in the ROM and values of a timing-selecting parameter CSEL are set e.g. as shown in FIG. 8 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that, as shown in FIGS. 5A and 5B referred to before, the air-fuel ratio is best sampled at timing closest to time points corresponding to maximal and minimal values (hereinafter both referred to as "extreme values" of the actual air-fuel ratio), and assuming that the response time (delay of response) of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIGS. 9A and 9B. In the present embodiment, the timing-selecting parameter CSEL is set such that the earlier (older) detected value of the sampling timing is selected as the CSEL value increases.

As described above, according to the FIG. 7 process, the sensor output VLAF value sampled at the optimum timing is selected depending on operating conditions of the engine, which improves the accuracy of detection of the air-fuel ratio. As a result, a cylinder-by-cylinder value of the air-fuel ratio can be estimated by the observer with enhanced accuracy, leading to improved accuracy of the air-fuel ratio feedback control for each cylinder.

Figure 10:
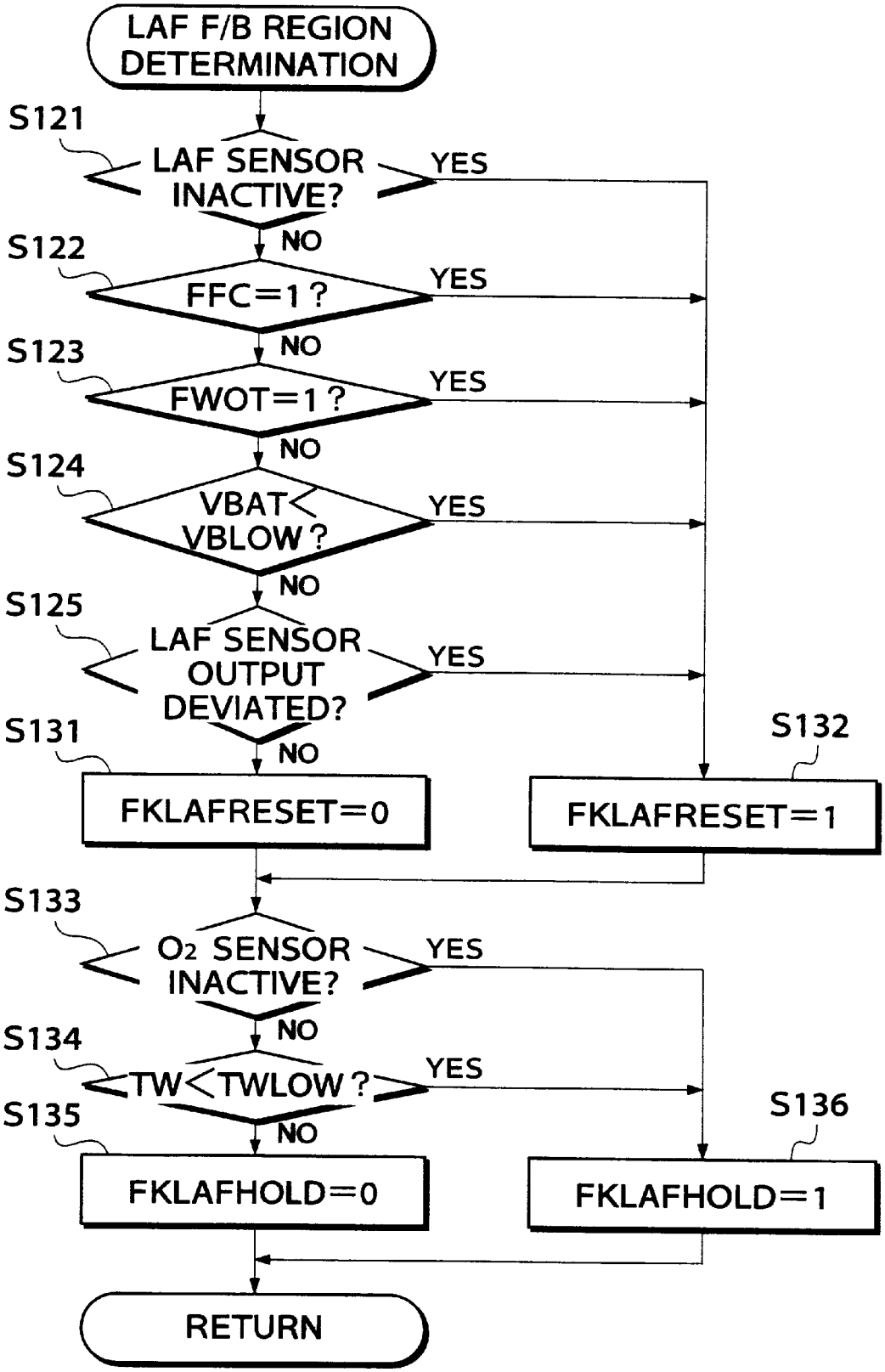
FIG. 10 is a flowchart showing a subroutine for carrying out a LAF feedback control region-determining process, which is executed at a step S6 in FIG. 3.

FIG. 10 shows a subroutine for carrying out a LAF feedback control region-determining process, which is executed at the step S6 in FIG. 3.

First, at a step S121, it is determined whether or not the LAF sensor 17 is in an inactive state. If the LAF sensor 17 is in an active state, it is determined at a step S122 whether or not a flag FFC which, when set to "1", indicates that fuel cut is being carried out, assumes "1". If FFC=0 holds, it is determined at a step S123 whether or not a WOT flag FWOT which, when set to "1", indicates that the engine is operating in a wide open throttle condition, assumes "1". If FWOT=1 does not hold, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from a proper value corresponding to the stoichiometric air-fuel ratio (LAF sensor output deviation). If any of the answers to the questions of the steps S121 to S125 is affirmative (YES), the reset flag FKLAFRESET which, when set to "1", indicates that the feedback control based on the LAF sensor output should be terminated, is set to "1" at a step S132.

On the other hand, if all the answers to the questions of the steps S121 to S125 are negative (NO), it is determined that the feedback control based on the LAF sensor output can be carried out, and therefore the reset flag FKLAFRESET is set to "0" at a step S131.

At the following step S133, it is determined whether or not the O2 sensor 18 is in an inactive state. If the O2 sensor 18 is in an active state, it is determined at a step S134 whether or not the engine coolant temperature TW is lower than a predetermined lower limit value TWLOW (e.g. 0° C.). If the O2 sensor 18 is in an inactive state or if TW<TWLOW holds, a hold flag FKLAFHOLD which, when set to "1", indicates that the PID correction coefficient KLAF should be held at the present value, is set to "1" at a step S136, followed by terminating the program. If the O2 sensor 18 has been activated and at the same time TW≧TWLOW holds, the hold flag FKLAFHOLD is set to "0" at a step S135, followed by terminating the program.

Next, description will be made of the manner of calculation of the cylinder-by-cylinder correction coefficient KOBSV#N executed at the step S12 in FIG. 3.

In the following description, first, a manner of estimating the cylinder-by-cylinder air-fuel ratio by the observer will be described, and then a manner of calculating the cylinder-by-cylinder correction coefficient KOBSV#N according to the estimated cylinder-by-cylinder air-fuel ratio will be described.

The air-fuel ratio detected at the confluent portion of the exhaust system is regarded as a weighted average value of air-fuel ratio values of the cylinders, which reflects time-dependent contributions of all the cylinders, whereby values of the air-fuel ratio detected at time points (k), (k+1), and (k+2) are expressed by equations (2A), (2B), and (2C), respectively. In preparing these equations, the fuel amount (F) was used as an operation amount, and accordingly the fuel-air ratio F/A is used in these equations:

$$[F/A](k)=C_1[F/A\#1]+C_2[F/A\#3]+C_3[F/A\#4]+C_4[F/A\#2] \quad (2A)$$

$$[F/A](k+1)=C_1[F/A\#3]+C_2[F/A\#4]+C_3[F/A\#2]+C_4[F/A\#1] \quad (2B)$$

$$[F/A](k+2)=C_1[F/A\#4]+C_2[F/A\#2]+C_3[F/A\#1]+C_4[F/A\#3] \quad (2C)$$

Figure 11:
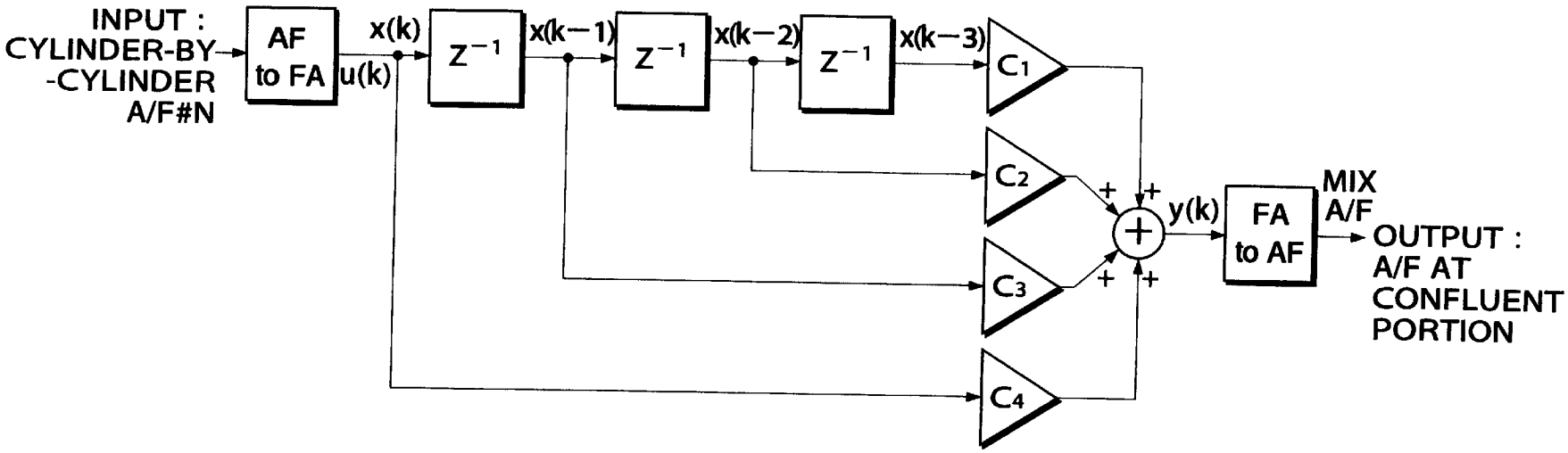
FIG. 11 is a block diagram showing a model representative of the behavior of the exhaust system of the engine.

More specifically, the fuel-air ratio detected at the confluent portion of the exhaust system is expressed as the sum of values of the cylinder-by-cylinder fuel-air ratio multiplied by respective weights C varying in the order of combustion (e.g. 40% for a cylinder corresponding to the immediately preceding combustion, 30% for one corresponding to the second preceding combustion, and so on). This model can be expressed in a block diagram as shown in FIG. 11, and the state equation therefor is expressed by the following equation (3):

$$\begin{bmatrix} x(k-2) \\ x(k-1) \\ x(k) \end{bmatrix} = \begin{bmatrix} 0 & 1 & 0 \\ 0 & 0 & 1 \\ 0 & 0 & 0 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \quad (3)$$

Further, if the fuel-air ratio detected at the confluent portion is designated by y(k), the output equation can be expressed by the following equation (4):

$$y(k) = [\, C_1 \quad C_2 \quad C_3 \,] \begin{bmatrix} x(k-3) \\ x(k-2) \\ x(k-1) \end{bmatrix} + C_4 u(k) \quad (4)$$

where, $C_1$: 0.05, $C_2$: 0.15, $C_3$: 0.30, $C_4$: 0.50.

In the equation (4), u(k) cannot be observed, and hence an observer designed based on this state equation cannot perform observation of x(k). Therefore, on the assumption that a value of the air-fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (4) can be changed into the following equation (5):

$$\begin{bmatrix} x(k-2) \\ x(k-1) \\ x(k) \\ x(k+1) \end{bmatrix} = \begin{bmatrix} 0 & 1 & 0 & 0 \\ 0 & 0 & 1 & 0 \\ 0 & 0 & 0 & 1 \\ 1 & 0 & 0 & 0 \end{bmatrix} \begin{bmatrix} x(k-3) \\ x(k-2) \\ x(k-1) \\ x(k) \end{bmatrix} \quad (5)$$

-continued $$y(k) = [\,C_1 \quad C_2 \quad C_3 \quad C_4\,]\begin{bmatrix} x(k-3) \\ x(k-2) \\ x(k-1) \\ x(k) \end{bmatrix}$$

It has been empirically ascertained that the thus set model well represents the exhaust system of a four-cylinder type engine. Therefore, a problem arising from estimating the cylinder-by-cylinder air-fuel ratio from the air-fuel ratio A/F at the confluent portion of the exhaust system is the same as a problem with an ordinary Kalman filter used in observing x(k) by the following state equation and output equation (6). If weight matrices Q, R are expressed by the following equation (7), the Riccati's equation can be solved to obtain a gain matrix K represented by the following equation (8):

$$X(k+1)=AX(k)+Bu(k) \quad y(k)=CX(k)+Du(k) \tag{6}$$

where $$A = \begin{bmatrix} 0 & 1 & 0 & 0 \\ 0 & 0 & 1 & 0 \\ 0 & 0 & 0 & 1 \\ 1 & 0 & 0 & 0 \end{bmatrix} \quad C = [\,C_1 \quad C_2 \quad C_3 \quad C_4\,] \quad B = D = [0] \tag{7}$$

$$X(k) = \begin{bmatrix} x(k-3) \\ x(k-2) \\ x(k-1) \\ x(k) \end{bmatrix}$$

$$Q = \begin{bmatrix} 1 & 0 & 0 & 0 \\ 0 & 1 & 0 & 0 \\ 0 & 0 & 1 & 0 \\ 0 & 0 & 0 & 1 \end{bmatrix} \quad R = [1]$$

$$K = \begin{bmatrix} -0.3093 \\ 1.1916 \\ 0.3093 \\ 0.0803 \end{bmatrix} \tag{8}$$

Figure 12:
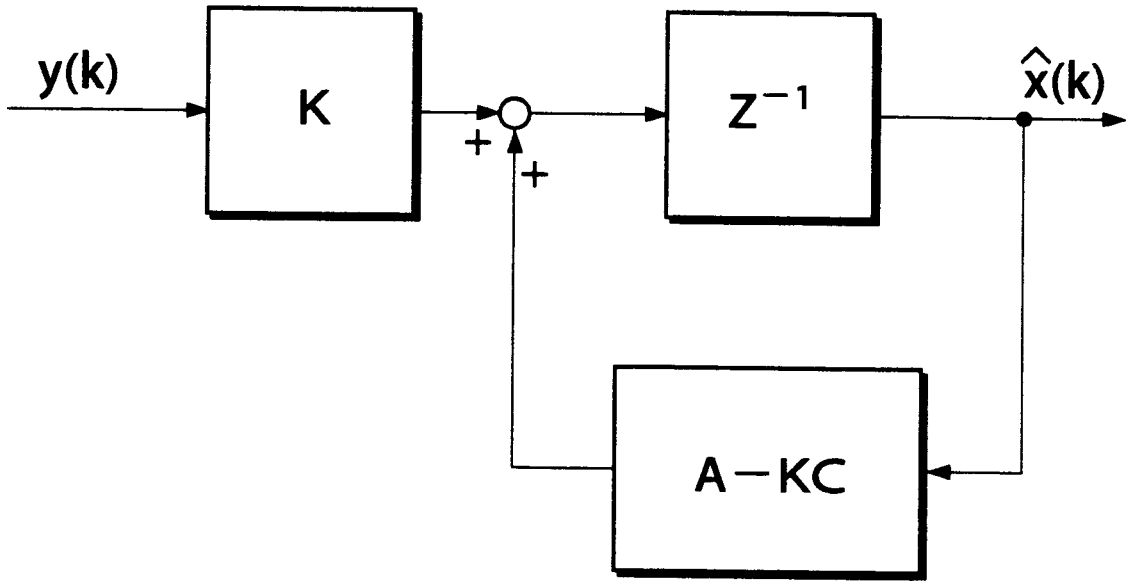
FIG. 12 is a block diagram showing the construction of an observer, which is applied to the model of the exhaust system.

In the model of the present embodiment, there is no inputting of u(k) which is input to an observer of a general type, so that the observer of the present embodiment is constructed such that y(k) alone is input thereto as shown in FIG. 12, which is expressed by the following equation (9):

$$\begin{aligned} \hat{X}(k+1) &= [A - KC]\hat{X}(k) + Ky(k) \\ &= A\hat{X}(k) + K\big(y(k) - C\hat{X}(k)\big) \end{aligned} \tag{9}$$

$$\hat{X}(k) = \begin{bmatrix} \hat{x}(k-3) \\ \hat{x}(k-2) \\ \hat{x}(k-1) \\ \hat{x}(k) \end{bmatrix}$$

Therefore, from the fuel-air ratio y(k) at the confluent portion and the estimated value X∧(k) of the cylinder-by-cylinder fuel-air ratio obtained in the past, the estimated value X∧(k+1) of the same in the present loop can be calculated.

When the above equation (9) is employed to calculate the cylinder-by-cylinder fuel-air ratio X∧(k+1), the actual equivalent ratio KACT(k) is substituted for the fuel-air ratio y(k) at the confluent portion. However, the actual equivalent ratio KACT(k) contains the response delay of the LAF sensor 17, whereas the CX∧(k) value (weighted sum of four cylinder-by-cylinder fuel-air ratio values) does not contain the response delay. Therefore, the cylinder-by-cylinder fuel-air ratio cannot be accurately estimated by the use of the equation (9), due to the influence of the response delay of the LAF sensor 17. Especially, at a high engine rotational speed NE when time intervals at which TDC signal pulses are generated are shorter, the influence of the response delay upon the accuracy of the estimation is large.

According to the present embodiment, therefore, an estimated value y∧(k) of the fuel-air ratio at the confluent portion is calculated by the use of the following equation (10), and the thus calculated value y∧(k) is applied to the following equation (11), to thereby calculate the estimated value X∧(k+1) of the cylinder-by-cylinder air-fuel ratio:

$$\hat{y}(k)=DL\hat{y}(k-1)+(1-DL)C\hat{X}(k) \tag{10}$$

$$\hat{X}(k+1)=A\hat{X}(k)+K(y(k)-\hat{y}(k)) \tag{11}$$

Figure 13:
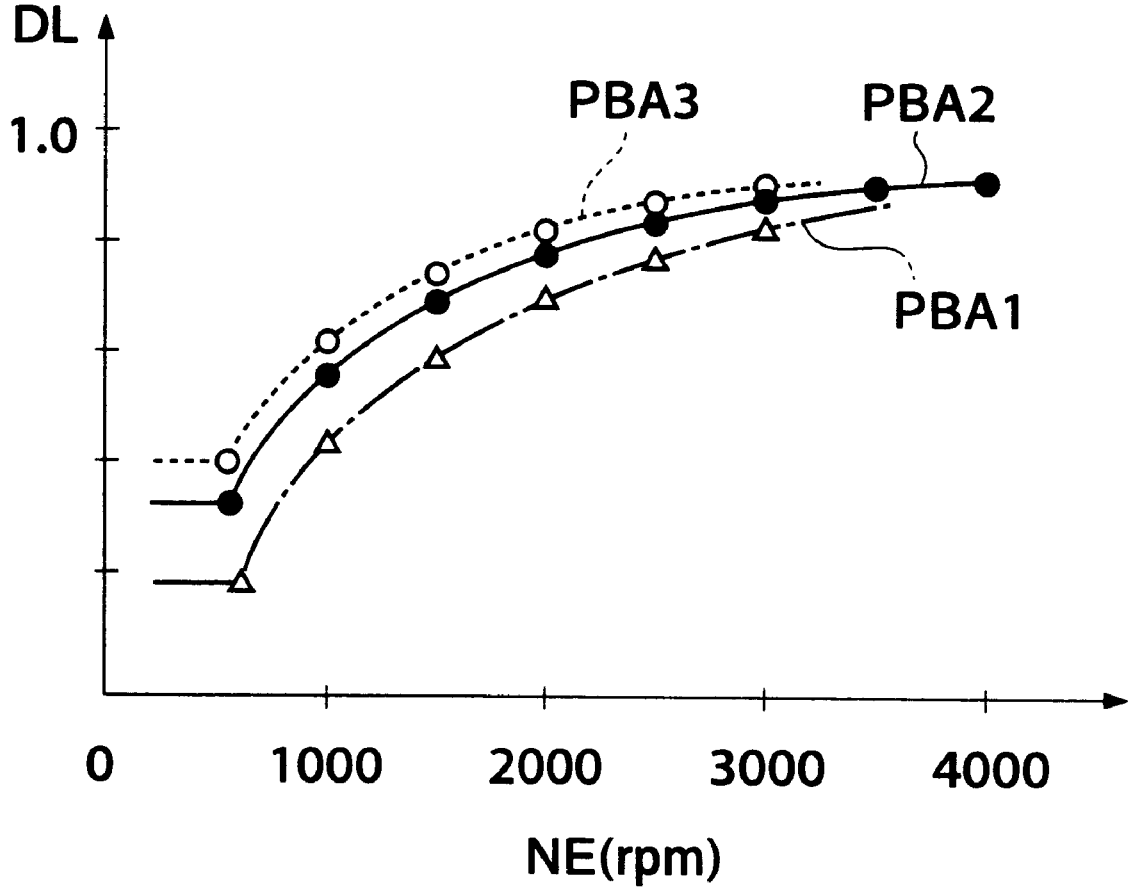
FIG. 13 shows a table for determining a response delay time constant DL for the LAF sensor.

In the above equation (10), DL represents a parameter corresponding to a time constant of the response delay of the LAF sensor 17, which is determined from a DL table shown in FIG. 13. The DL table is set such that the DL value is set to a value between 0 to 1.0 according to the engine rotational speed NE and the intake pipe absolute pressure PBA. In the figure, PBA1 to PBA3 represent 660 mmHg, 460 mmHg, and 260 mmHg, respectively, and an interpolation is carried out when the NE and/or PBA value falls between the predetermined values. It has been empirically ascertained that the best compensation for the response delay of the LAF sensor 17 can be obtained if the time constant DL is set to a value corresponding to a time period longer than the actual response delay by approximately 20%.

In the above equations (10) and (11), an initial vector of the X∧(k) value is set such that component elements thereof (x∧(k−3), x∧(k−2), x∧(k−1), x∧(k)) all assume 1.0, and in the equation (10), an initial value of the estimated value y∧(k−1) is set to 1.0.

By thus using the equation (11) which is obtained by replacing the CX∧(k) in the equation (9) by the estimated value y∧(k) of the fuel-air ratio at the confluent portion containing the response delay, the response delay of the LAF sensor can be properly compensated for, to thereby carry out accurate estimation of the cylinder-by-cylinder air-fuel ratio. In the following description, estimated equivalent ratio values KACT#1(k) to KACT#4(k) for the respective cylinders correspond to the x∧(k) value.

Figure 14:
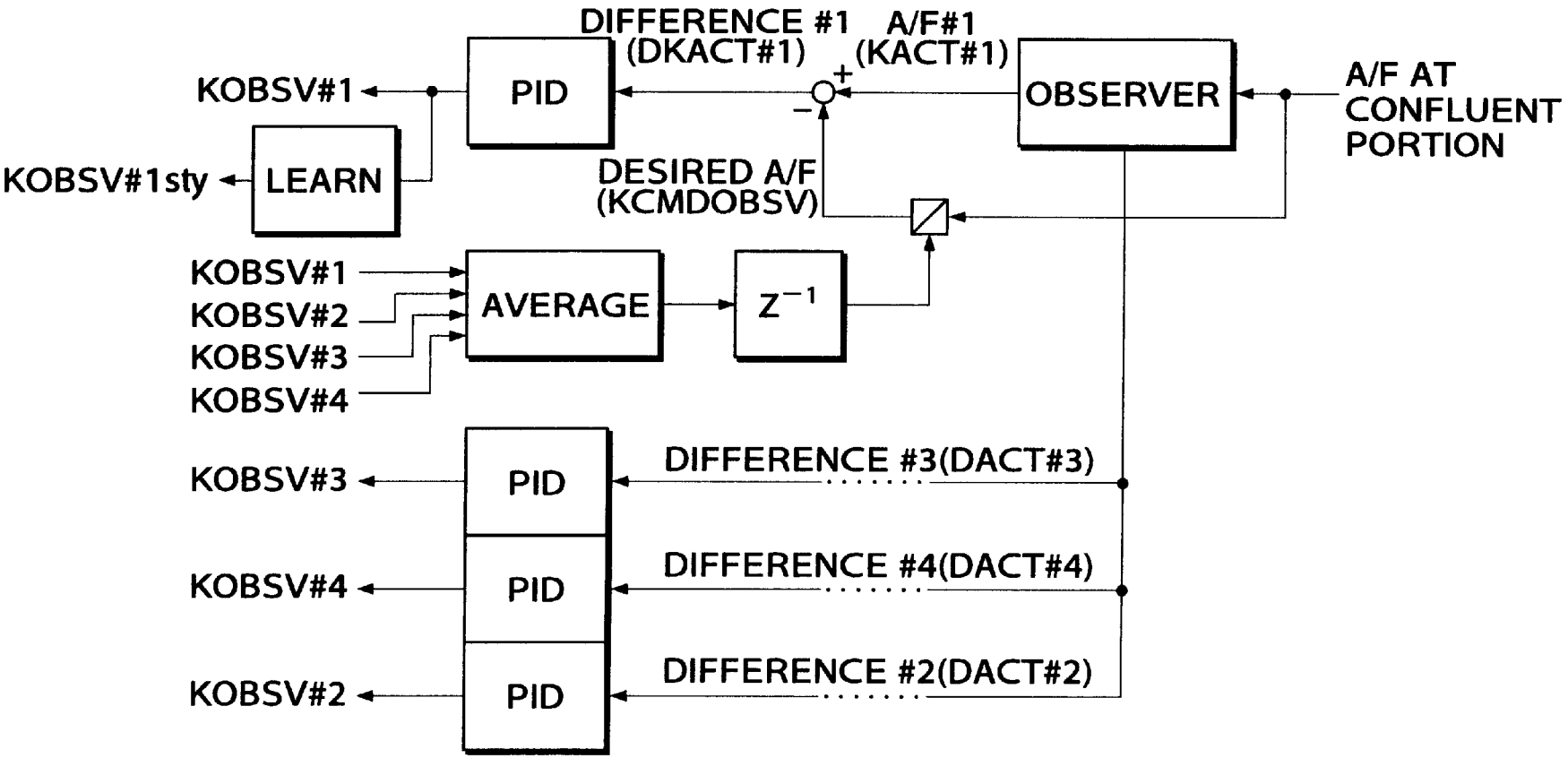
FIG. 14 is a diagram which is useful in explaining the manner of cylinder-by-cylinder air-fuel ratio feedback control.

Next, description will be made of the manner of calculating the cylinder-by-cylinder correction coefficient KOBSV#N, based on the thus estimated cylinder-by-cylinder air-fuel ratio, with reference to FIG. 14.

As shown in the following equation (12), the actual equivalent ratio KACT corresponding to the air-fuel ratio A/F at the confluent portion is divided by the immediately preceding value of an average value of the cylinder-by-cylinder correction coefficient KOBSV#N for all the cylinders, to thereby calculate a desired value KCMDOBSV (k) as an equivalent ratio corresponding to the desired air-fuel ratio. The cylinder-by-cylinder correction coefficient KOBSV#1 of the #1 cylinder is calculated by the PID control such that the difference DKACT#1(k) (=KACT#1 (k)−KCMDOBSV(k)) between the desired value KCMDOBSV(k) and the estimated equivalent ratio KACT#1(k) of the #1 cylinder becomes equal to zero:

$$KCMDOBSV(k) = KACT(k) \Big/ \left( \sum_{N=1}^{4} KOBSV\#N(k-1)/4 \right) \quad (12)$$

More specifically, a proportional term KOBSVP#1, an integral term KOBSVI#1, and a differential term KOBSVD#1 for use in the PID control are calculated by the use of the respective following equations (13A), (13B), and (13C), to thereby calculate the cylinder-by-cylinder correction coefficient KOBSV#1 by the use of the following equation (14):

$$KOBSVP\#1(k)=KPOBSV\times DKACT\#1(k) \quad (13A)$$

$$KOBSVI\#1(k)=KIOBSV\times DKACT\#1(k)+KOBSVI\#1(k-1) \quad (13B)$$

$$KOBSVD\#1(k)=KDOBSV\times(DKACT\#1(k)-DKACT\#1(k-1)) \quad (13C)$$

$$KOBSV\#1(k)=KOBSVP\#1(k)+KOBSVI\#1(k)+KOBSVD\#1(k)+1.0 \quad (14)$$

where KPOBSV, KIOBSV and KDOBSV represent a basic proportional term, a basic integral term, and a basic differential term, respectively.

The same calculations are carried out with respect to the cylinders #2 to #4, to obtain the cylinder-by-cylinder correction coefficients KOBSV#2 to KOBSV#4 therefor. If the KOBSV#N value exceeds a predetermined upper limit value KOBSVLMH, the KOBSV#N value is set to the upper limit value KOBSVLMH. On the other hand, if the KOBSV#N value is below a predetermined lower limit value KOBSVLML, the KOBSV#N value is set to the lower limit value KOBSVLML.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired-air fuel ratio.

Further, the learned value KOBSV#Nstyi of the cylinder-by-cylinder correction coefficient KOBSV#N is calculated for each of the three engine operating regions by the use of the following equation (15) and stored in the back-up RAM backed up by the battery:

$$KOBSV\#Nstyi=Csty\times KOBSV\#N+(1-Csty)\times KOBSV\#Nstyi \quad (15)$$

where i (i=1 to 3) represents a parameter representative of the operating region, Csty a weighting coefficient set to a value between 0 to 1, and KOBSV#Nstyi on the right side the immediately preceding learned value.

Figure 15:
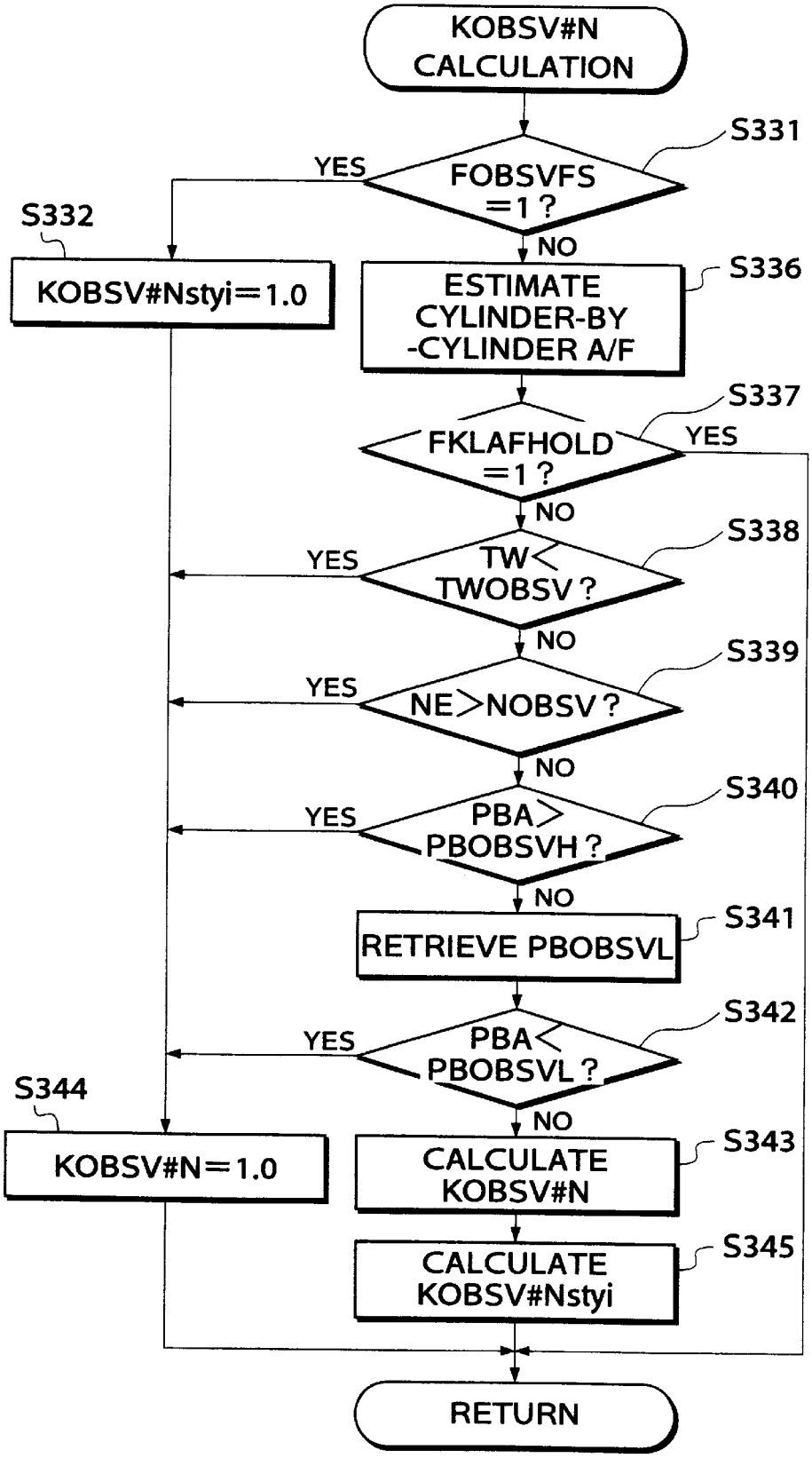
FIG. 15 is a flowchart showing a subroutine for calculating the cylinder-by-cylinder correction coefficient KOBSV#N, which is executed at a step S9 in FIG. 3.

FIG. 15 shows a subroutine for calculating the cylinder-by-cylinder correction coefficient KOBSV#N, which is executed at the step S12 in FIG. 3.

First, at a step S331, it is determined whether or not a held-to-limit flag FOBSVFS (referred to hereinafter with reference to FIGS. 19 and 20) is equal to "1". The held-to-limit flag FOBSVFS, when set to "1", indicates that the cylinder-by-cylinder correction coefficient KOBSV#N is in a held-to-limit state where it is continuously held at an upper or lower limit value due to deterioration of the LAF sensor 17 (due to a change in the response speed). If FOBSVFS=0 holds, the program proceeds to a step S336. On the other hand, if FOBSVFS=1 holds, the learned value KOBSV#Nstyi is initialized to a non-corrective value 1.0 at a step S332, and then the cylinder-by-cylinder correction coefficient KOBSV#N for all the cylinders is set to 1.0 at a step S344, which means that the cylinder-by-cylinder air-fuel ratio feedback control is not executed, followed by terminating the present routine.

At the step S336, the cylinder-by-cylinder air-fuel ratio estimation by the observer described above is executed. Then, it is determined at a step S337 whether or not the hold flag FKLAFHOLD which, when set to "1", indicates that the PID correction coefficient KLAF should be held at the present value, assumes "1". If FKLAFHOLD=1 holds, the program is immediately terminated.

Figure 17:
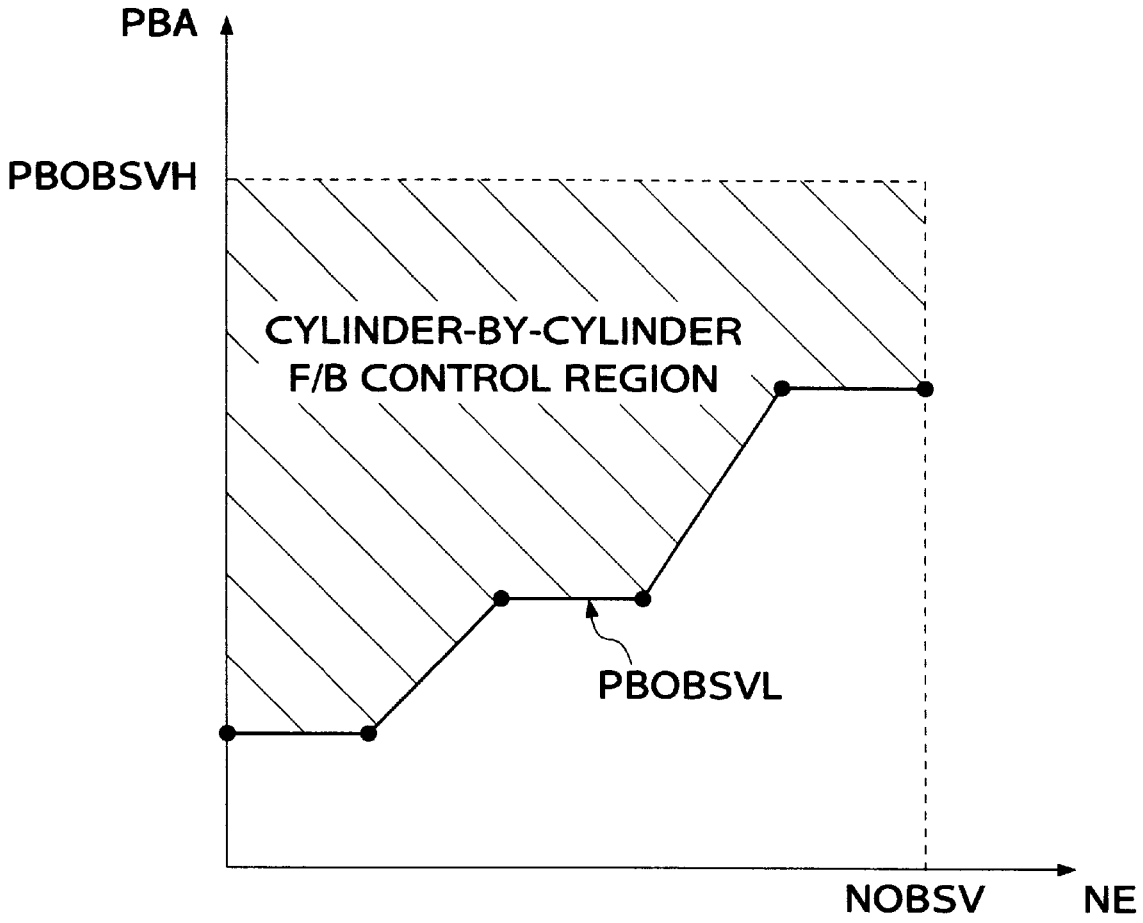
FIG. 17 is a diagram which is useful in explaining a cylinder-by-cylinder feedback control region.

If FKLAFHOLD=0 holds at the step S337, it is determined at a step S338 whether or not the engine coolant temperature TW is lower than a predetermined value TWOBSV. If TW≧TWOBSV holds, it is determined at a step S339 whether or not the engine rotational speed NE is higher than a predetermined value NOBSV (e.g. 3500 rpm). If NE≦NOBSV holds, it is determined at a step S340 whether or not the intake pipe absolute pressure PBA is higher than a predetermined upper limit value PBOBSVH (e.g. 650=mmHg). If PBA≦PBOBSVH holds, a PBOBSVL table which is set according to the engine rotational speed NE, as shown in FIG. 17, is retrieved to determine a lower limit value PBOBSVL of the PBA value at a step S341, and then it is determined at a step S342 whether or not the PBA value is lower than the lower limit value PBOBSVL.

If any of the answers to the questions of the steps S338 to S340 and S342 is affirmative (YES), the program proceeds to the step S344, and therefore the cylinder-by-cylinder air-fuel ratio feedback control is not executed. On the other hand, if the answers to the questions of the steps S338 to S340 and S342 are all negative (NO), which means that the engine is in a operating condition corresponding to the shaded region in FIG. 17, it is determined that the cylinder-by-cylinder air-fuel ratio feedback control can be carried out. Therefore, the cylinder-by-cylinder correction coefficient KOBSV#N is calculated in the manner as described above at a step S343, and then the learned value KOBSV#Nstyi of the cylinder-by-cylinder correction coefficient KOBSV#N is calculated at a step S345, followed by terminating the present program.

Figure 16:
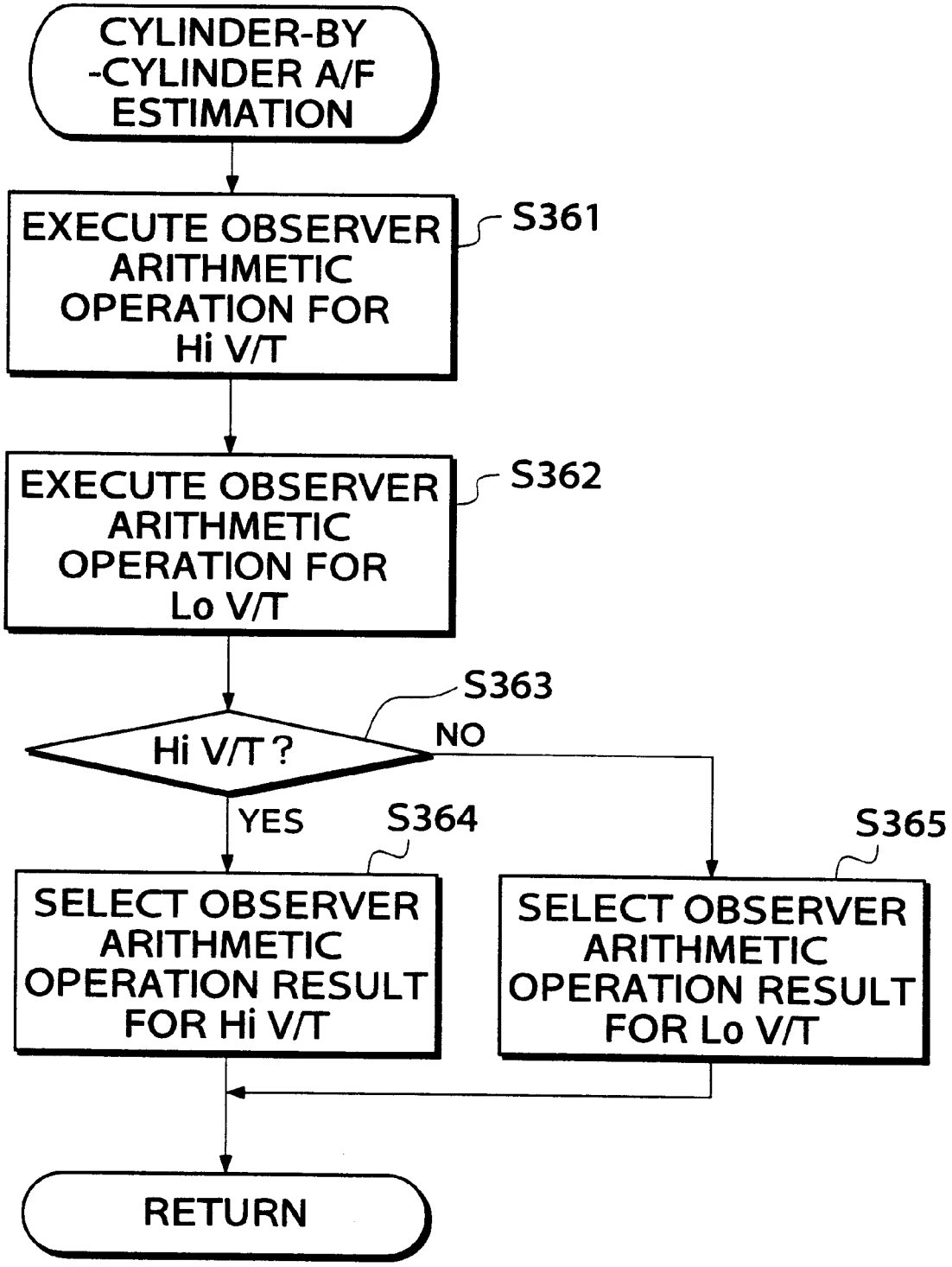
FIG. 16 is a flowchart showing a subroutine for carrying out a cylinder-by-cylinder air-fuel ratio-estimating process, which is executed at a step S336 in FIG. 15.

FIG. 16 shows a subroutine for estimating the cylinder-by-cylinder air-fuel ratio, which is executed at the step S336 in FIG. 15.

First, at a step S361, an arithmetic operation by the use of the observer (i.e. estimation of the cylinder-by-cylinder air-fuel ratio value) for the high-speed valve timing is carried out, and at the following step S362, an arithmetic operation by the use of the observer for the low-speed valve timing is carried out. Then, it is determined at a step S363 whether or not the present valve timing is set to the high-speed valve timing. If the present valve timing is set to the high-speed valve timing, a result of the observer arithmetic operation for the high-speed valve timing is selected at a step S364, whereas if the present valve timing is set to the low-speed valve timing, a result of the observer arithmetic operation for the low-speed valve timing is selected at a step S365.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

Figure 18:
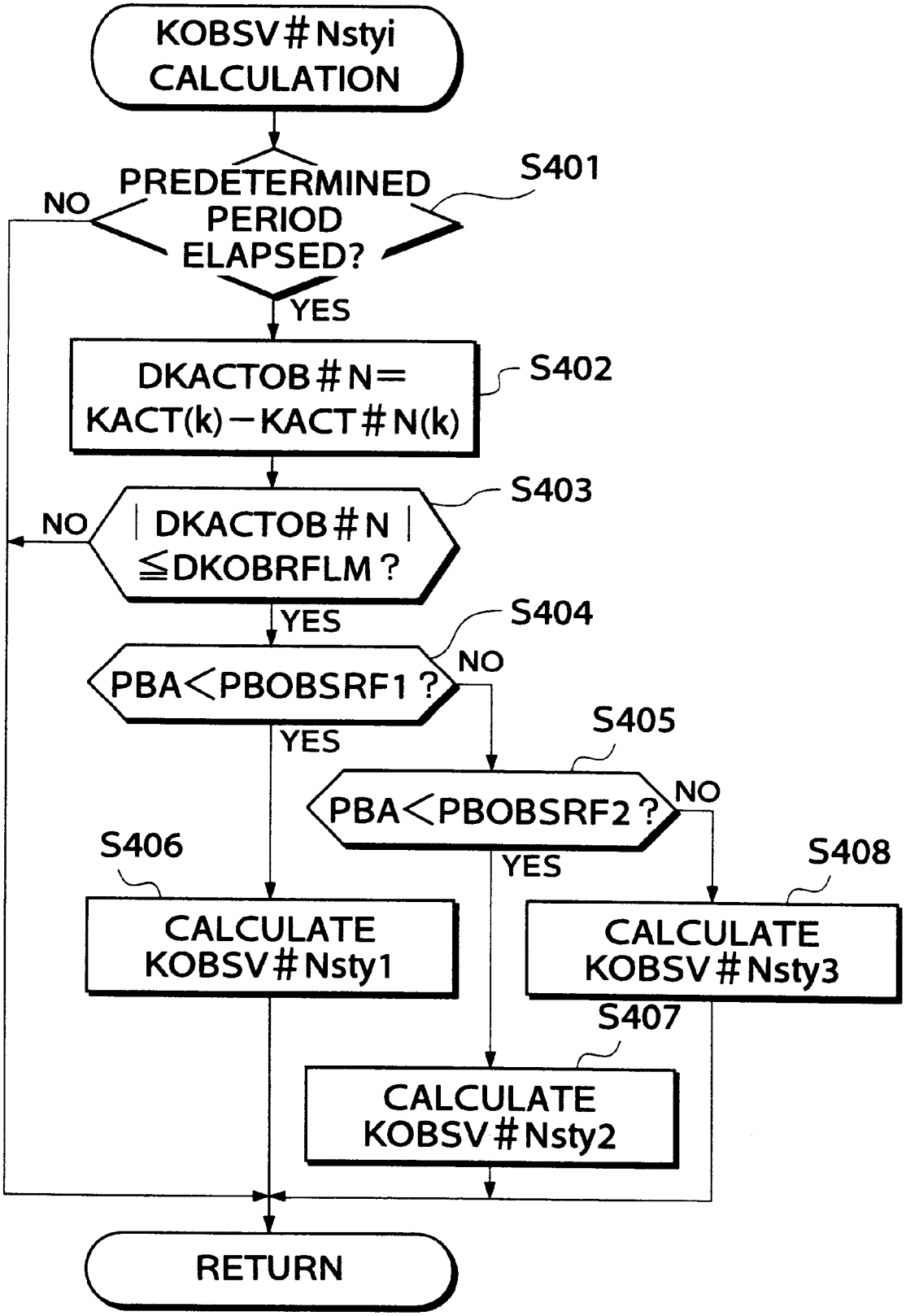
FIG. 18 is a flowchart showing a subroutine for calculating a learned value KOBSV#Nstyi of the cylinder-by-cylinder correction coefficient KOBSV#N, which is executed at a step S345 in FIG. 15.

FIG. 18 shows a subroutine for calculating the learned value KOBSV#Nstyi of the cylinder-by-cylinder correction coefficient KOBSV#N, which is executed at the step S345 in FIG. 15.

First, at a step S401, it is determined whether or not a predetermined time period has elapsed from a time point at which the cylinder-by-cylinder air-fuel ratio feedback control which is currently being executed was started (at which a state where the conditions for executing the cylinder-by-cylinder feedback control are unsatisfied shifted to a state where the conditions are satisfied). If the predetermined time period has not elapsed, the program is immediately terminated. On the other hand, if the predetermined time period has elapsed, the program proceeds to a step S402, wherein an equivalent ratio difference DKACTOB#N which is the difference between the actual equivalent ratio KACT(k) and an estimated cylinder-by-cylinder equivalent ratio KACT#N (k) is calculated by the use of the following equation (16):

$$DKACTOB\#N=KACT(k)-KACT\#N(k) \quad (16)$$

Then, it is determined at a step S403 whether or not the absolute value of the equivalent ratio difference |DKACTOB#N| is equal to or smaller than a predetermined value DKOBRFLM. If |DKACTOB#N|>DKOBRFLM holds, the program is immediately terminated without calculating the learned value KOBSV#Nstyi.

On the other hand, if |DKACTOB#N|≦DKOBRFLM holds, the learned value KOBSV#Nstyi is calculated for each of the three engine operating regions in the following manner, followed by terminating the present routine.

More specifically, if the intake pipe absolute pressure PBA is lower than a first predetermined value PBOBSRF1, a learned value KOBSV#Nsty1 is calculated by the use of the above equation (15) and the calculated value is stored in the back-up RAM at steps S404 and S406. If the intake pipe absolute pressure PBA is equal to or higher than the first predetermined value PBOBSRF1 and at the same time lower than a second predetermined value PBOBSRF2 (which is higher than the first predetermined value), a learned value KOBSV#Nsty2 is calculated by the use of the above equation (15) and the calculated value is stored in the back-up RAM at steps S404, S405 and S407. If the intake pipe absolute pressure PBA is equal to or higher than the second predetermined value PBOBSRF2, a learned value KOBSV#Nsty3 is calculated by the use of the above equation (15) and the calculated value is stored in the back-up RAM at steps S404, S405 and S408.

According to the FIG. 18 subroutine, if the absolute value of the difference DKACTOB#N between the actual equivalent ratio KACT and the estimated cylinder-by-cylinder equivalent ratio KACT#N is larger than the predetermined value DKOBRFLM, the learned value KOBSV#Nstyi is not calculated (updated). Therefore, for example, immediately after the start of the cylinder-by-cylinder air-fuel ratio feedback control or during execution of perturbation of the air-fuel ratio, the learned value KOBSV#Nstyi is not updated, whereby it can be prevented that the learned value KOBSV#Nstyi deviates from a desired value.

Figure 19:
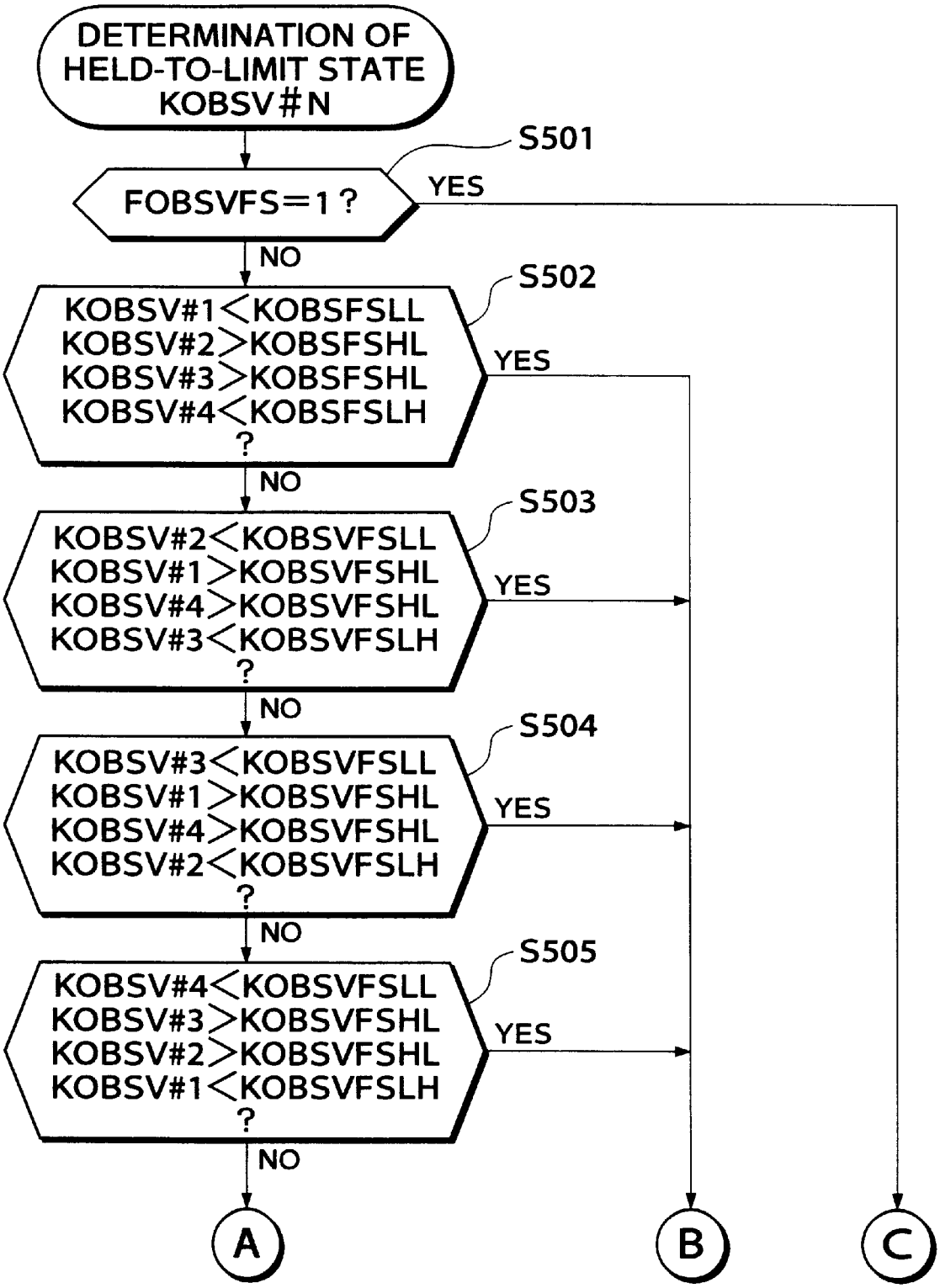
FIG. 19 is a flowchart showing a routine for determining a held-to-limit state of the cylinder-by-cylinder correction coefficient KOBSV#N.
Figure 20:
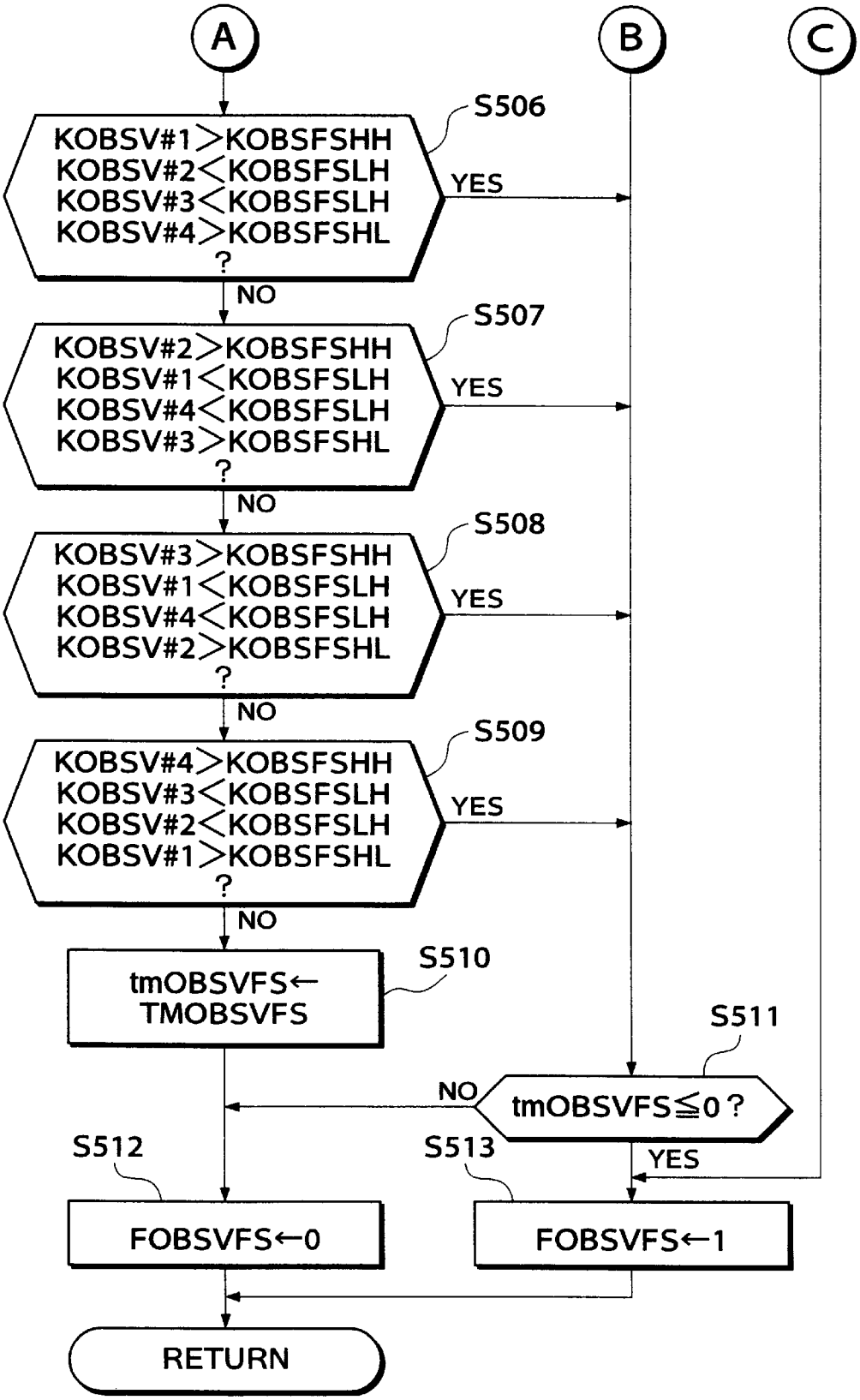
FIG. 20 is a continued part of the FIG. 19 routine.

FIGS. 19 and 20 show a routine for determining the held-to-limit state of the cylinder-by-cylinder correction coefficient KOBSV#N, which is executed in synchronism with generation of TDC signal pulses, by the CPU of the ECU 5.

Figures 21A, 21B, 21C:
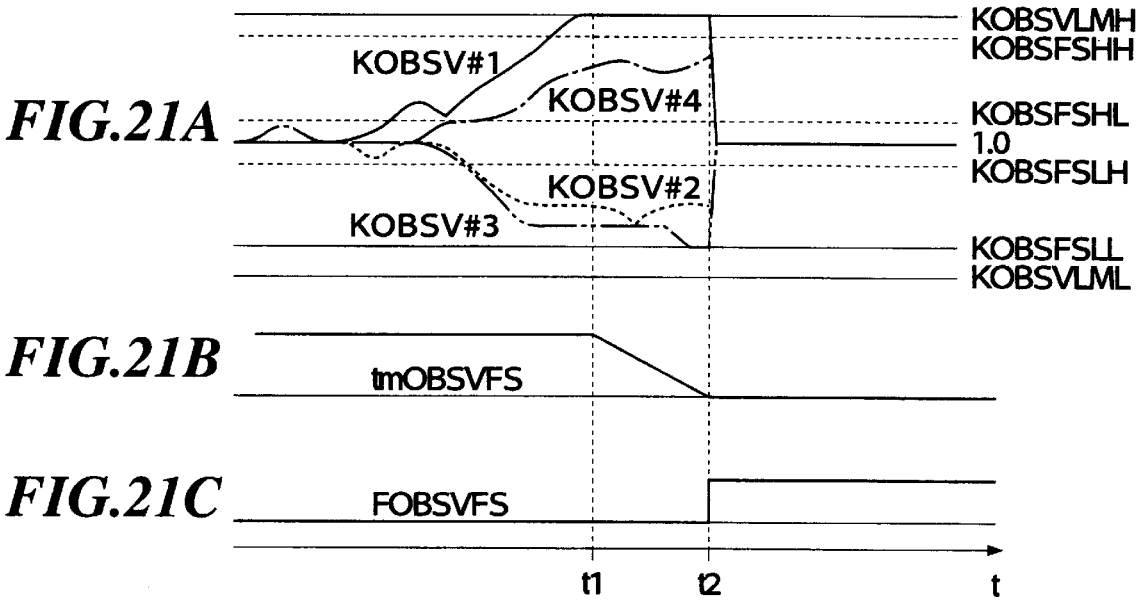

First, at a step S501, it is determined whether or not the held-to-limit flag FOBSVFS is equal to "1", and if FOBSVFS=1 holds, the program jumps to a step S513 in FIG. 20. On the other hand, if FOBSVFS=0 holds, the relationships in value between the KOBSV#N value and predetermined determination values KOBSFSHH, KOBSFSHL, KOBSFSLH, KOBSFSLL are determined at steps S502 to S509, to thereby determine whether or not the determined relationships show predetermined held-to-limit patterns. The predetermined determination values and upper and lower limit values KOBSVLMH and KOBSVLML are in a relationship of KOBSVLML<KOBSFSLL<KOBSFSLH<1.0<KOBSFSHL<KOBSFSHH<KOBSVLMH, as shown in FIG. 21A. The determination values KOBSFSLL, KOBSFSLH, KOBSFSHL, and KOBSFSHH are set, e.g. to 0.82, 0.98, 1.02 and 1.18, respectively, and the predetermined upper and lower limit values KOBSVLMH and KOBSVLML are set, e.g. to 0.8 and 1.2, respectively.

More specifically, it is determined at the step S502 whether or not the correction coefficient KOBSV#1 of the #1 cylinder is smaller than the first lower determination value KOBSFSLL, the correction coefficient KOBSV#2 of the #2 cylinder is larger than the second upper determination value KOBSFSHL, the correction coefficient KOBSV#3 of the #3 cylinder is larger than the second upper determination value KOBSFSHL, and at the same time the correction coefficient KOBSV#4 of the #4 cylinder is smaller than the second lower determination value KOBSFSLH. If the answer is affirmative (YES), which means that the determined relationships show a corresponding one of the predetermined held-to-limit patterns, the program proceeds to a step S511. On the other hand, if the answer is negative (NO), the program proceeds to the step S503.

At the step S503, it is determined whether or not the correction coefficient KOBSV#2 is smaller than the first lower determination value KOBSFSLL, the correction coefficient KOBSV#1 is larger than the second upper determination value KOBSFSHL, the correction coefficient KOBSV#4 is larger than the second upper determination value KOBSFSHL, and at the same time the correction coefficient KOBSV#3 is smaller than the second lower determination value KOBSFSLH. If the answer is affirmative (YES), which means that the determined relationships show a corresponding one of the predetermined held-to-limit patterns, the program proceeds to the step S511. On the other hand, if the answer is negative (NO), the program proceeds to the step S504.

At the step S504, it is determined whether or not the correction coefficient KOBSV#3 is smaller than the first lower determination value KOBSFSLL, the correction coefficient KOBSV#1 is larger than the second upper determination value KOBSFSHL, the correction coefficient KOBSV#4 is larger than the second upper determination value KOBSFSHL, and at the same time the correction coefficient KOBSV#2 is smaller than the second lower determination value KOBSFSLH. If the answer is affirmative (YES), which means that the determined relationships show a corresponding one of the predetermined held-to-limit patterns, the program proceeds to the step S511. On the other hand, if the answer is negative (NO), the program proceeds to the step S505.

At the step S505, it is determined whether or not the correction coefficient KOBSV#4 is smaller than the first lower determination value KOBSFSLL, the correction coefficient KOBSV#3 is larger than the second upper determination value KOBSFSHL, the correction coefficient KOBSV#2 is larger than the second upper determination value KOBSFSHL, and at the same time the correction coefficient KOBSV#1 is smaller than the second lower determination value KOBSFSLH. If the answer is affirmative (YES), which means that the determined relationships show a corresponding one of the predetermined held-to-limit patterns, the program proceeds to the step S511. On the other hand, if the answer is negative (NO), the program proceeds to the step S506.

At the step S506, it is determined whether or not the correction coefficient KOBSV#1 is larger than the first upper determination value KOBSFSHH, the correction coefficient KOBSV#2 is smaller than the second lower determination value KOBSFSLH, the correction coefficient KOBSV#3 is smaller than the second lower determination value KOBSFSLH, and at the same time the correction coefficient KOBSV#4 is larger than the second upper determination value KOBSFSHL. If the answer is affirmative (YES), which means that the determined relationships show a corresponding one of the predetermined held-to-limit patterns, the program proceeds to the step S511. On the other hand, if the answer is negative (NO), the program proceeds to the step S507.

At the step S507, it is determined whether or not the correction coefficient KOBSV#2 is larger than the first upper determination value KOBSFSHH, the correction coefficient KOBSV#1 is smaller than the second lower determination value KOBSFSLH, the correction coefficient KOBSV#4 is smaller than the second lower determination value KOBSFSLH, and at the same time the correction coefficient KOBSV#3 is larger than the second upper determination value KOBSFSHL. If the answer is affirmative (YES), which means that the determined relationships show a corresponding one of the predetermined held-to-limit patterns, the program proceeds to the step S511. On the other hand, if the answer is negative (NO), the program proceeds to the step S508.

At the step S508, it is determined whether or not the correction coefficient KOBSV#3 is larger than the first upper determination value KOBSFSHH, the correction coefficient KOBSV#1 is smaller than the second lower determination value KOBSFSLH, the correction coefficient KOBSV#4 is smaller than the second lower determination value KOBSFSLH, and at the same time the correction coefficient KOBSV#2 is larger than the second upper determination value KOBSFSHL. If the answer is affirmative (YES), which means that the determined relationships show a corresponding one of the predetermined held-to-limit patterns, the program proceeds to the step S511. On the other hand, if the answer is negative (NO), the program proceeds to the step S509.

At the step S509, it is determined whether or not the correction coefficient KOBSV#4 is larger than the first upper determination value KOBSFSHH, the correction coefficient KOBSV#3 is smaller than the second lower determination value KOBSFSLH, the correction coefficient KOBSV#2 is smaller than the second lower determination value KOBSFSLH, and at the same time the correction coefficient KOBSV#1 is larger than the second upper determination value KOBSFSHL. If the answer is affirmative (YES), which means that the determined relationships show a corresponding one of the predetermined held-to-limit patterns, the program proceeds to the step S511. On the other hand, if the answer is negative (NO), the program proceeds to a step S510.

If the determined relationships do not correspond to any of the predetermined held-to-limit patterns, a timer tmOBSVFS is set to a predetermined time period TMOBSVFS (e.g. 100 msec) and started at the step S510, and the held-to-limit flag FOBSVFS is set to "0" at a step S512, followed by terminating the present routine.

On the other hand, if the determined relationships correspond to one of the predetermined held-to-limit patterns, it is determined at the step S511 whether or not the count value of the timer tmOBSVFS is equal to "0". So long as tmOBSVFS>0 holds, the program proceeds to the step S512, whereas if the count value of the timer tmOBSVFS is equal to "0", the held-to-limit flag FOBSVFS is set to "1" at the step S513, followed by terminating the present routine.

By virtue of the determinations at the steps S502 to S509, unevenness of the estimated cylinder-by-cylinder air-fuel ratio due to deterioration of the LAF sensor 17 can be correctly determined. This is based on the following ground: If the air-fuel ratio value of only one cylinder becomes different from the air-fuel ratios of the other cylinders due to a reason other than deterioration of the LAF sensor, only the cylinder-by-cylinder correction coefficient KOBSV#N corresponding to the one cylinder exceeds the first upper determination value KOBSFSHH or falls below the first lower determination value KOBSFSLL. On the other hand, if the LAF sensor is deteriorated to cause unevenness of the cylinder-by-cylinder air-fuel ratio between the cylinders, the air-fuel ratio values of the #1 and #4 cylinders forming a first cylinder group deviate in the same direction, while the air-fuel ratio values of the #2 and #3 cylinders forming a second cylinder group deviate in the direction opposite to the direction of deviation of the air-fuel ratio values of the first cylinder group. Therefore, by executing the steps S502 to S509, it is determined whether or not the cylinder-by-cylinder correction coefficients KOBSV#N corresponding to the two cylinder groups indicate the above manner of deviation and at the same time the cylinder-by-cylinder correction coefficient KOBSV#N of at least one of the cylinders exceeds the first upper determination value KOBSFSHH or falls below the first lower determination value KOBSFSLL. In the present embodiment, ignition takes place in the order of the #1 cylinder, #3 cylinder, #4 cylinder and #2 cylinder, and the above-mentioned cylinder groups each consist of the cylinders in which ignition takes place every other stroke (i.e. the #1 and #4 cylinders and the #2 and #3 cylinders).

FIGS. 21A to 21C show the timing relationship between changes in the cylinder-by-cylinder correction coefficients KOBSV#N, the count value of the timer tmOBSVFS and the held-to-limit flag FOBSVFS, to explain the state where the answer to the question of the step S506 is affirmative (YES). In the illustrated example, the correction coefficient KOBSV#1 of the #1 cylinder exceeds the first upper determination value KOBSFSHH (slightly before a time point t1) and thereafter held at the upper limit value KOBSVLMH. When the count value of the timer tmOBSVFS becomes equal to "0", the held-to-limit flag FOBSVFS is set to "1". When FOBSVFS=1 holds, as described hereinbefore with reference to FIG. 15, the step S336 of estimating the cylinder-by-cylinder air-fuel ratio, the step S343 of calculating the cylinder-by-cylinder correction coefficient KOBSV#N corresponding to the estimated cylinder-by-cylinder air-fuel ratio, and the step S345 of calculating the learned value KOBSV#Nstyi are not executed, by setting the cylinder-by-cylinder correction coefficient KOBSV#N and the learned value KOBSV#Nstyi both to the non-corrective value of 1.0. Thus, it can be prevented that unevenness of the estimated cylinder-by-cylinder air-fuel ratio due to the deterioration of the LAF sensor causes increased variations in the controlled air-fuel ratio between the cylinders.

Further, since the learned value KOBSV#Nstyi is initialized to 1.0, a possible inconvenience to be caused by using a learned value obtained based on the output from the deteriorated LAF sensor can be avoided.

Next, description will be made of a second embodiment of the invention.

In the first embodiment described above, when the held-to-limit flag FOBSVFS=1 holds, the cylinder-by-cylinder correction coefficients KOBSV#N of the cylinders are all set to the non-corrective value of 1.0. In the present embodiment, however, if the held-to-limit flag FOBSVFS=1 holds, the cylinder-by-cylinder correction coefficient KOBSV#1 of the #1 cylinder is held at 1.0, followed by carrying out a response speed-determining process for determining whether the response speed of the LAF sensor has become lower or higher, and the timing-selecting parameter CSEL is corrected based on results of the determination, thus continuing execution of the cylinder-by-cylinder air-fuel ratio control.

Hereunder, only of those which differ from the first embodiment will be described. The hardware construction of the second embodiment is identical with that of the first embodiment.

Figure 22:
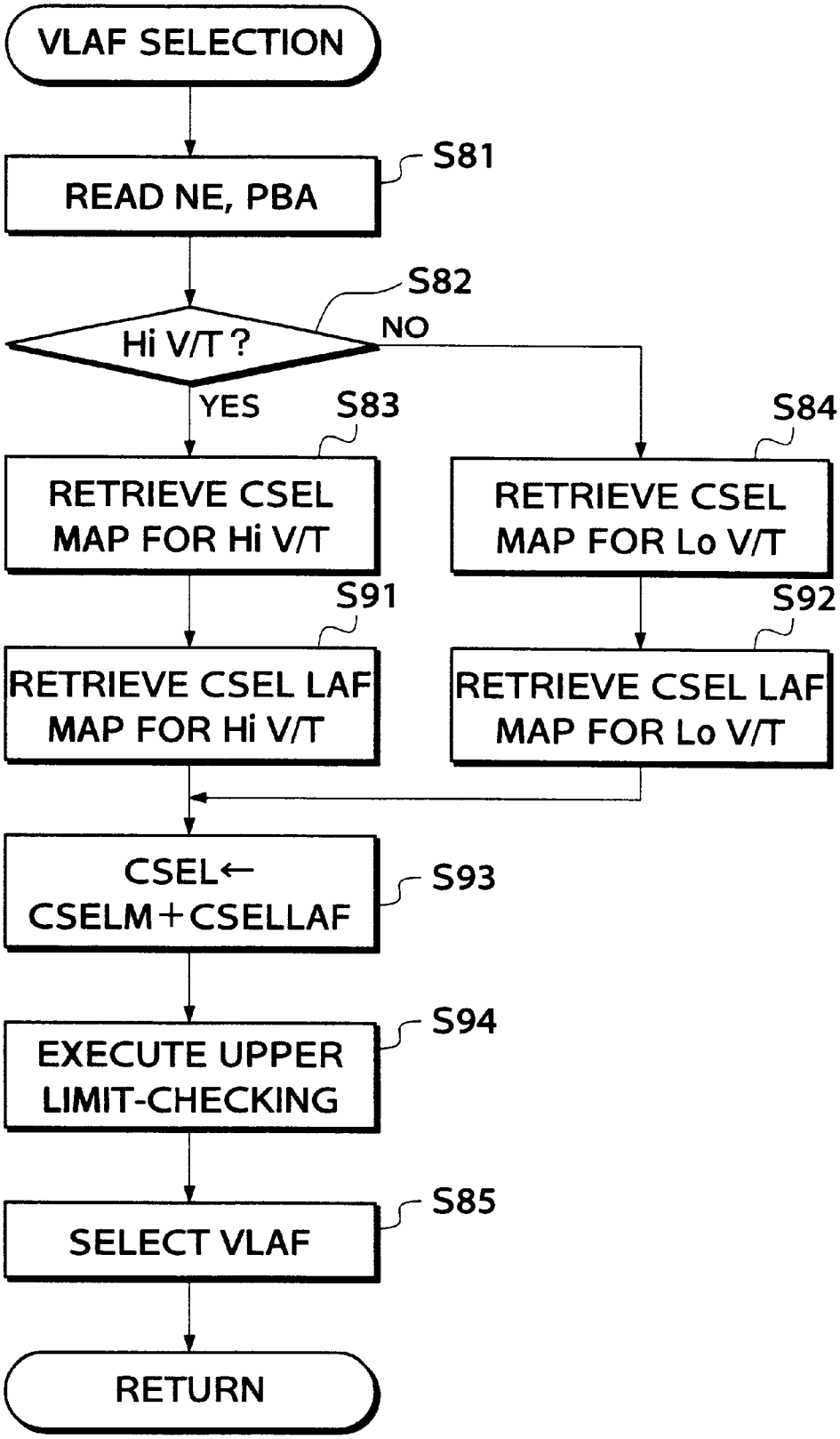
FIG. 22 is a flowchart showing a routine for selecting the output from the LAF sensor, according to a second embodiment of the invention, which corresponds to the FIG. 7 subroutine in the first embodiment.

FIG. 22 shows a routine for selecting the LAF sensor output, which corresponds to the FIG. 7 subroutine in the first embodiment. This routine is distinguished from the FIG. 7 subroutine in that steps S91 to S94 are newly added. The steps S81 to S85 in FIG. 22 are identical with those in FIG. 7.

At the steps S91 and S92, a CSELLAF map suitable for the high-speed valve timing and a CSELLAF map suitable for the low-speed valve timing are retrieved, respectively, according to the engine rotational speed NE and the intake pipe absolute pressure PBA, to thereby determine a correction term CSELLAF for correcting the timing-selecting parameter CSEL according to a change in the response speed of the LAF sensor 17. The CSELLAF map is set such that map values of the CSELLAF value are provided for each operating region determined by the engine rotational speed NE and the intake pipe absolute pressure PBA, and the set map value CSELLAF is updated by a process of FIG. 28. The CSELLAF map is stored in the back-up RAM.

At the following step S93, the thus determined or retrieved correction term CSELM is added to the map value CSELM obtained at the step S83 or S84, to thereby calculate the timing-selecting parameter CSEL. Then, at a step S94, upper limit-checking of the CSEL value is executed to prevent the CSEL value from exceeding its limit value (17 in the present embodiment), followed by the program proceeding to the step S85.

Figure 23:
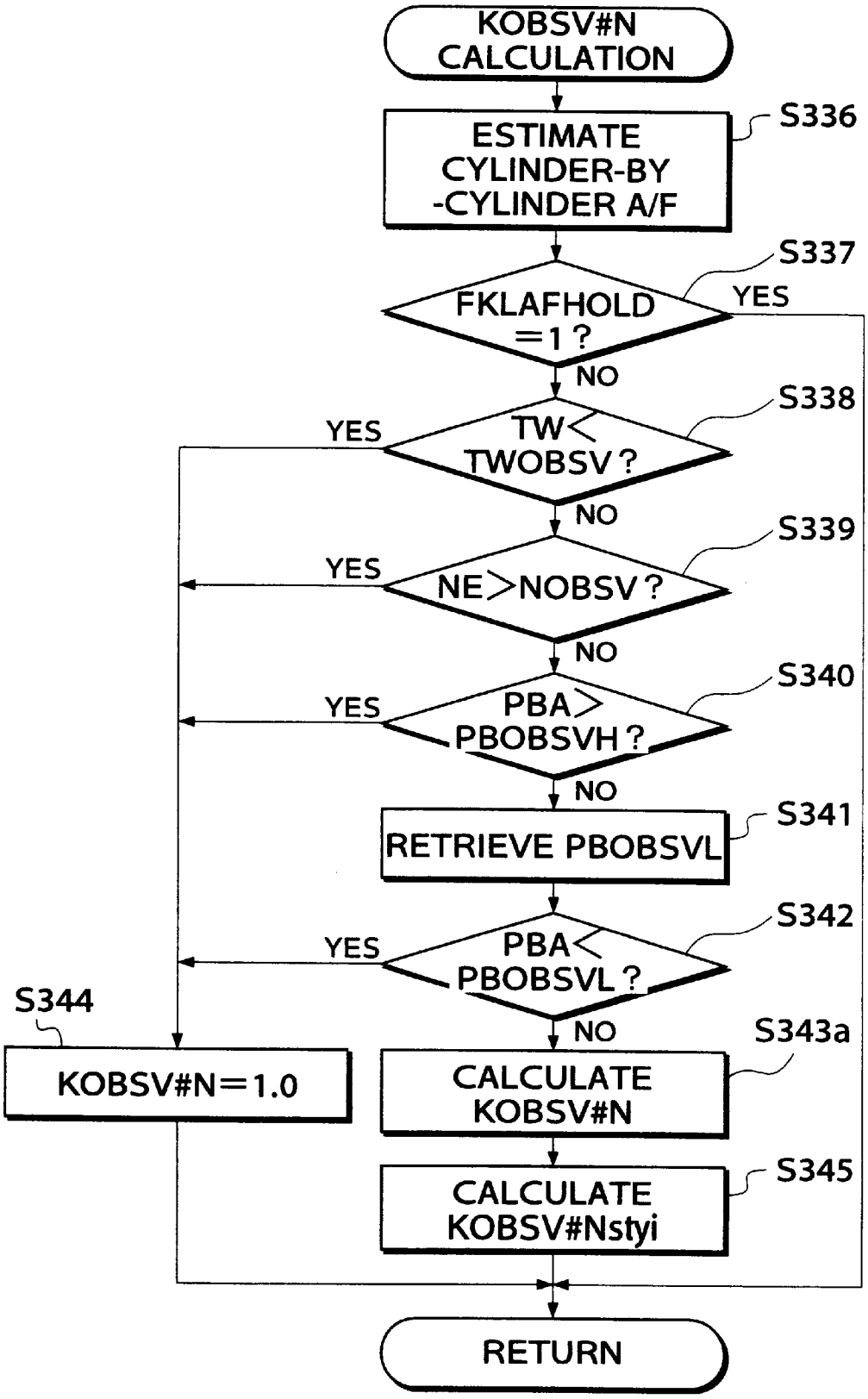
FIG. 23 is a flowchart showing a routine for calculating the cylinder-by-cylinder correction coefficient KOBSV#N, which corresponds to the FIG. 15 subroutine in the first embodiment.

FIG. 23 shows a routine for calculating the cylinder-by-cylinder correction coefficient KOBSV#N, which corresponds to the FIG. 15 subroutine in the first embodiment. This FIG. 23 routine is distinguished from FIG. 15 in that the steps S331 and S332 in FIG. 15 are deleted, and further a step S343*a* is substituted for the step S343 in FIG. 15. Except for the above, the FIG. 23 process is identical with the FIG. 15 process. That is, in the present embodiment, even when the held-to-limit flag FOBSVFS is equal to "1", execution of the cylinder-by-cylinder air-fuel ratio control is continued while the timing-selecting parameter CSEL is corrected.

Figure 24:
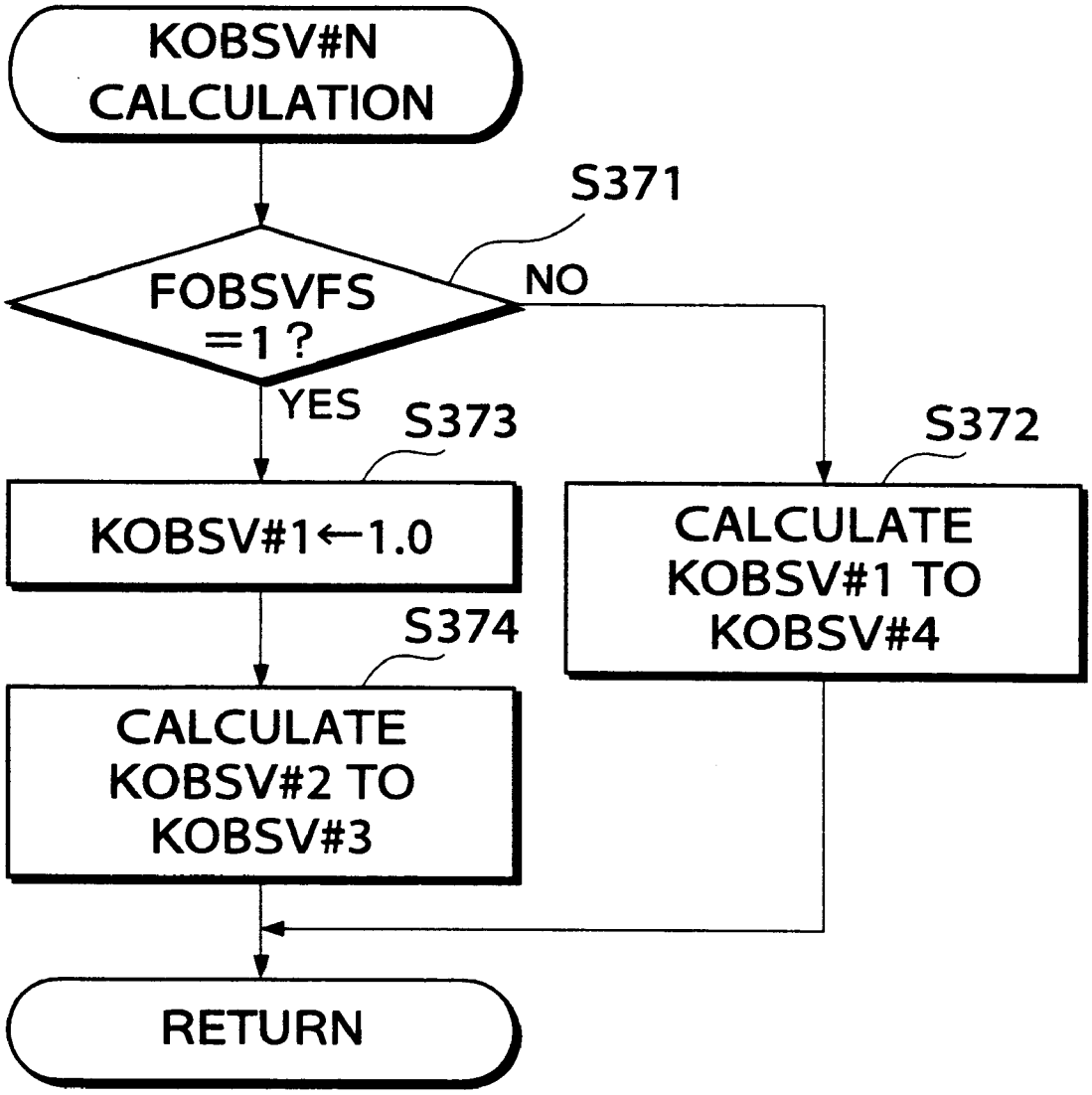
FIG. 24 is a flowchart showing a subroutine for calculating the KOBSV#N value, which is executed at a step S343*a* in FIG. 23.

FIG. 24 shows a subroutine for calculating the KOBSV#N value, which has been executed at the step S343*a* in FIG. 24.

First, it is determined at a step S371 whether or not the held-to-limit flag FOBSVFS is equal to "1", and if FOBSVFS=0 holds, which means that the held-to-limit state has not been detected, the cylinder-by-cylinder correction coefficients KOBSV#1 to #4 are calculated in the ordinary manner by the use of the equations 13A to 13C and 14, at a step S372, followed by terminating the present routine. On the other hand, if FOBSVFS=1 holds, which means that the held-to-limit state has been detected, the correction coefficient KOBSV#1 of the #1 cylinder is held at 1.0 at a step S373, and the correction coefficients KOBSV#2 to KOBSV#4 of the respective #2 to #4 cylinders are calculated in the ordinary manner at a step S374.

Figure 25:
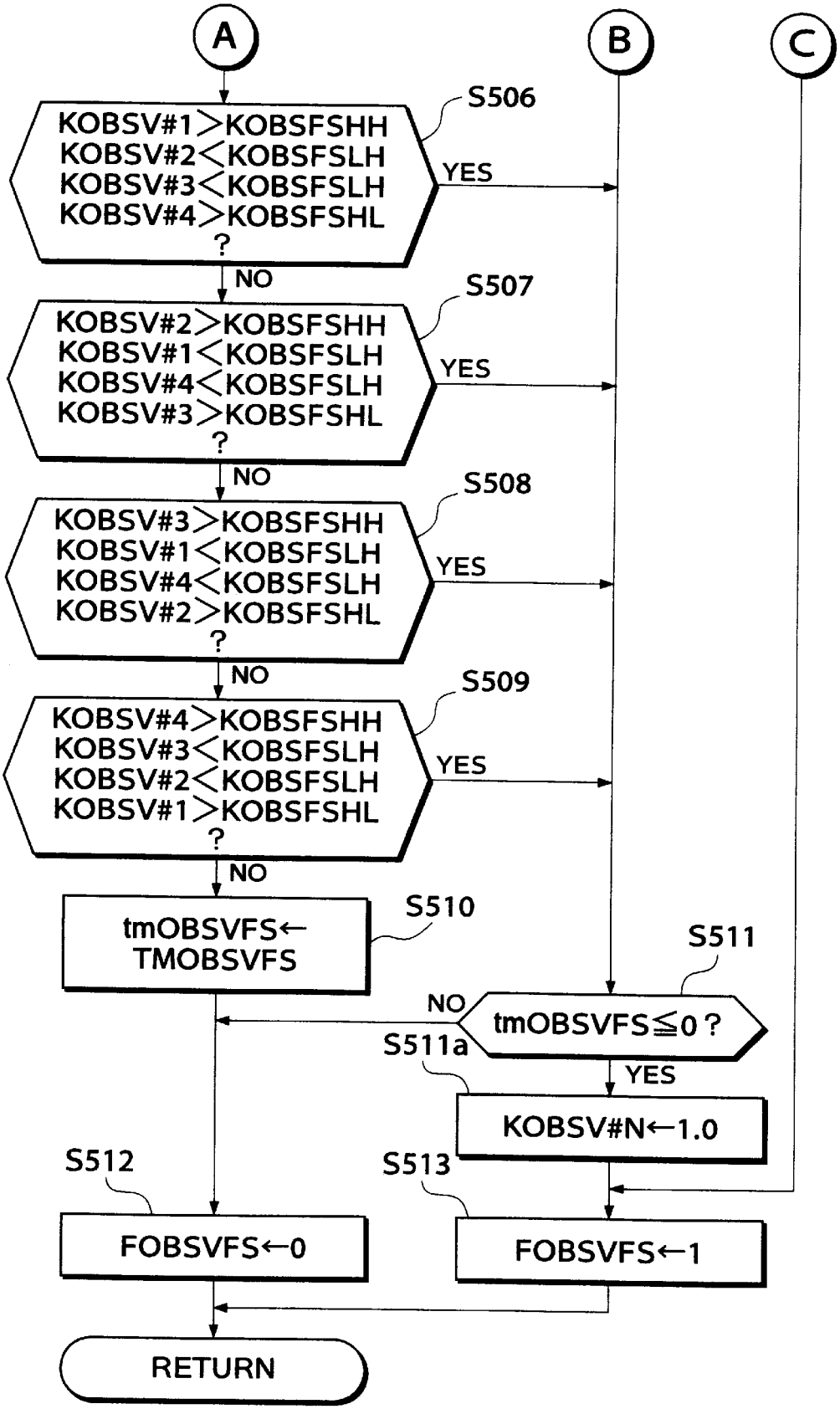
FIG. 25 is a flowchart showing a routine for determining a held-to-limit state of the cylinder-by-cylinder correction coefficient KOBSV#N, which corresponds to the FIG. 20 subroutine in the first embodiment.

FIG. 25 shows a part of a routine for determining the cylinder-by-cylinder correction coefficient KOBSV#N held-to-limit state, which corresponds to the routine of FIG. 20 in the first embodiment. The FIG. 25 routine is distinguished from the FIG. 20 routine in that a step S511*a* is newly added. Except for this, the FIG. 25 process is identical with the FIG. 20 process. More specifically, according to the second embodiment, if a time period over which the relationships in value between the cylinder-by-cylinder correction coefficient KOBSV#N and the predetermined determination values, determined at any of the steps S502 to S509, show one of the predetermined held-to-limit patterns exceeds the predetermined time period TMOBSVFS, i.e. if the answer to the question of the step S511 becomes affirmative (YES), the cylinder-by-cylinder correction coefficients KOBSV#N are all set to 1.0 at a step S511*a*.

Figure 26:
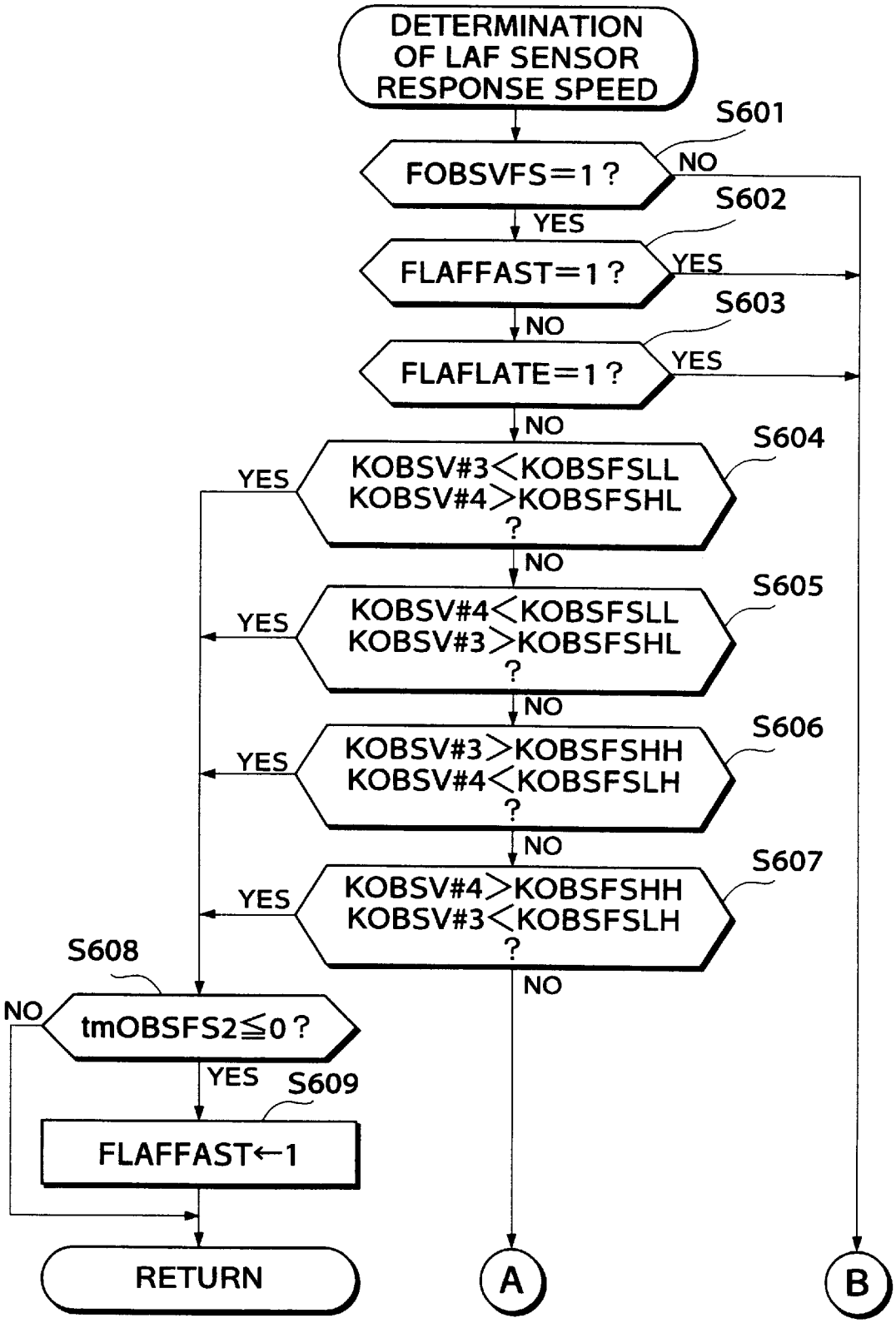
FIG. 26 is a flowchart showing a routine for determining the response speed of the LAF sensor.
Figure 27:
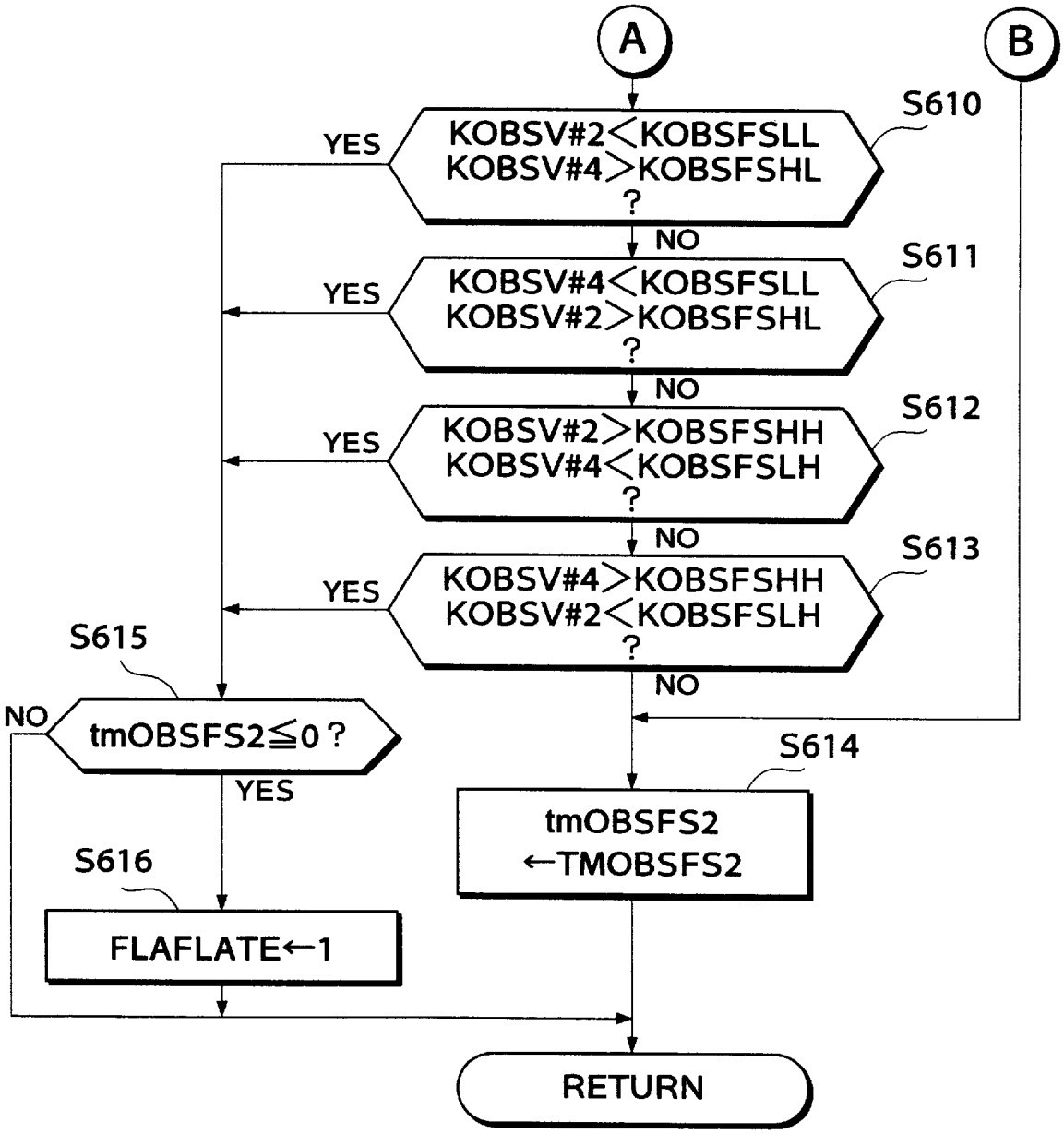
FIG. 27 is a continued part of the FIG. 26 routine.

FIGS. 26 and 27 show a program for determining the response speed of the LAF sensor 17, which is executed in synchronism with generation of TDC signal pulses, by the CPU of the ECU 5.

Figure 29A:
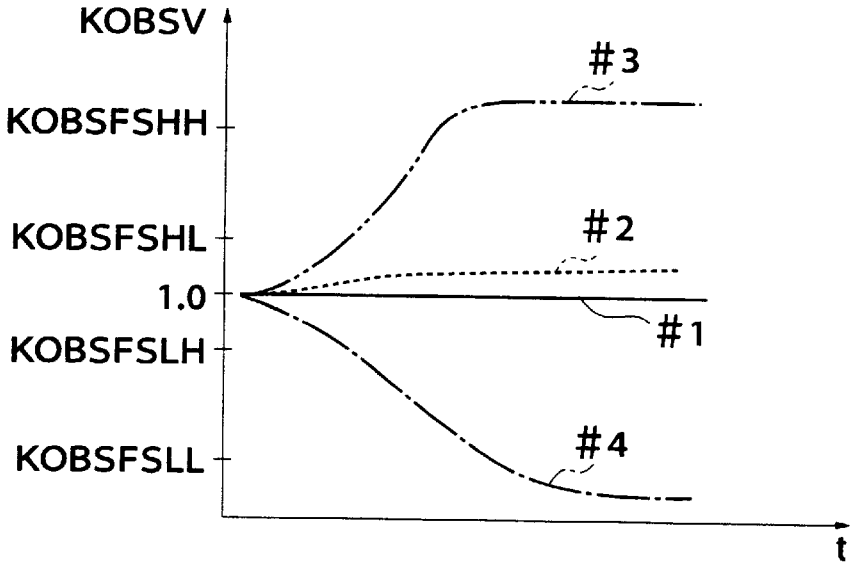
FIG. 29A is a timing chart showing changes in the cylinder-by-cylinder correction coefficients KOBSV#1 to KOBSV#4 with the lapse of time, which take place when the response speed of the LAF sensor has changed to a higher side.
Figure 29B:
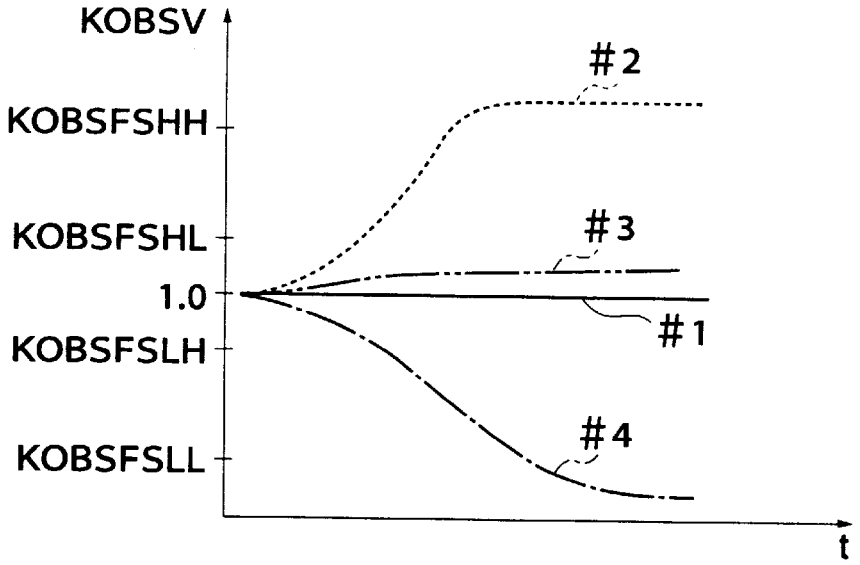
FIG. 29B is a timing chart showing changes in the correction coefficients KOBSV#1 to KOBSV#4 with the lapse of time, which take place when the response speed of the LAF sensor has changed to a lower side.

This process determines the response speed of the LAF sensor 17 by utilizing the following fact: It has been empirically ascertained that when the correction coefficient KOBSV#1 of the #1 cylinder is held at 1.0 and at the same time the correction coefficients KOBSV#2 to KOBSV#4 of the respective #2 to #4 cylinders are calculated through the ordinary cylinder-by-cylinder air-fuel ratio feedback control, if the LAF sensor 17 is deteriorated so that the response speed thereof becomes higher, the correction coefficient KOBSV#3 of the #3 cylinder becomes held at the upper limit value KOBSVLMH and at the same time the correction coefficient KOBSV#4 of the #4 cylinder becomes held at the lower limit value KOBSVLML, as shown in FIG. 29A, or in some cases, the correction coefficient KOBSV#3 becomes held at the lower limit value KOBSVLML and at the same time the correction coefficient KOBSV#4 becomes held at the upper limit value KOBSVLMH, and on the other hand, if the LAF sensor 17 is deteriorated so that its response speed becomes lower, the correction coefficient KOBSV#2 of the #2 cylinder becomes held at the upper limit value KOBSVLMH and at the same time the correction coefficient KOBSV#4 of the #4 cylinder becomes held at the lower limit value KOBSVLML, as shown in FIG. 29B, or in some cases, the correction coefficient KOBSV#2 becomes held at the lower limit value KOBSVLML and at the same time the correction coefficient KOBSV#4 becomes held at the upper limit value KOBSVLMH.

In the present embodiment, there are provided first and second determination patterns. The first determination pattern is a pattern for determining that the response speed of the LAF sensor 17 has become higher, i.e. a pattern that with the cylinder-by-cylinder correction coefficient KOBSV#1 of the #1 cylinder held at 1.0, the correction coefficient KOBSV#3 of the #3 cylinder (fired next to the #1 cylinder) is held at the limit value and at the same time the correction coefficient KOBSV#4 of the #4 cylinder (fired two strokes later than the #1 cylinder) deviates in a direction opposite to the correction coefficient KOBSV#3, or in some cases, the correction coefficient KOBSV#4 of the #4 cylinder is held at the limit value and at the same time the correction coefficient KOBSV#3 of the #3 cylinder deviates in a direction opposite to the correction coefficient KOBSV#4. The second determination pattern is a pattern for determining that the response speed of the LAF sensor 17 has become lower, i.e.

a pattern that with the cylinder-by-cylinder correction coefficient KOBSV#1 of the #1 cylinder held at 1.0, the correction coefficient KOBSV#2 of the #2 cylinder (fired three strokes later than the #1 cylinder) is held at the limit value and at the same time the correction coefficient KOBSV#4 of the #4 cylinder (fired two strokes later than the #1 cylinder) deviates in a direction opposite to the correction coefficient KOBSV#2, or in some cases, the correction coefficient KOBSV#4 of the #4 cylinder is held at the limit value and at the same time the correction coefficient KOBSV#2 of the #2 cylinder deviates in a direction opposite to the correction coefficient KOBSV#4.

First, at a step S601, it is determined whether or not the held-to-limit flag FOBSVFS is equal to "1". If FOBSVFS=1 holds, it is determined at a step S602 whether or not a first determination flag FLAFFAST which, when set to "1", indicates that the LAF sensor 17 is deteriorated so that its response speed becomes higher, is equal to "1". If FLAFFAST=0 holds, it is determined at a step S603 whether or not a second determination flag FLAFLATE which, when set to "1", indicates that the LAF sensor 17 is deteriorated so that its response speed becomes lower, is equal to "1". If FOBSVFS=0 holds at the step S601, which means that the predetermined held-to-limit state has not been detected, or if either FLAFFAST=1 or FLAFLATE=1 holds, which means that a change in the response speed has been detected, the program proceeds to a step S614, wherein a down-counting timer tmOBSFS2 is set to a predetermined time period TMOBSFS2 (e.g. 10 sec) is set and started, followed by terminating the present routine.

If the answer to the question at the step S603 is negative (NO), it is determined at steps S604 to S607 whether or not the relationships in value between the correction coefficients KOBSV#3 and KOBSV#4 and the predetermined determination values KOBSFSHH, KOBSFSHL, KOBSFSLL and KOBSFSLH show the first determination pattern. More specifically, it is determined at the step S604 whether or not the correction coefficient KOBSV#3 is smaller than the first lower determination value KOBSFSLL and at the same time the correction coefficient KOBSV#4 is larger than the second upper determination value KOBSFSHL. If the answer is affirmative (YES), which means that the correction coefficients KOBSV#3 and KOBSV#4 meet the first determination pattern, the program proceeds to a step S608, whereas if the answer is negative (NO), the program proceeds to the step S605.

At the step S605, it is determined whether or not the correction coefficient KOBSV#4 is smaller than the first lower determination value KOBSFSLL and at the same time the correction coefficient KOBSV#3 is larger than the second upper determination value KOBSFSHL. If the answer is affirmative (YES), which means that the correction coefficients KOBSV#3 and KOBSV#4 meet the first determination pattern, the program proceeds to the step S608, whereas if the answer is negative (NO), the program proceeds to the step S606.

At the step S606, it is determined whether or not the correction coefficient KOBSV#3 is larger than the first upper determination value KOBSFSHH and at the same time the correction coefficient KOBSV#4 is smaller than the second lower determination value KOBSFSLH. If the answer is affirmative (YES), which means that the correction coefficients KOBSV#3 and KOBSV#4 meet the first determination pattern, the program proceeds to the step S608, whereas if the answer is negative (NO), the program proceeds to the step S607.

At the step S607, it is determined whether or not the correction coefficient KOBSV#4 is larger than the first upper determination value KOBSFSHH and at the same time the correction coefficient KOBSV#3 is smaller than the second lower determination value KOBSFSLH. If the answer is affirmative (YES), which means that the correction coefficients KOBSV#3 and KOBSV#4 meet the first determination pattern, the program proceeds to the step S608, whereas if the answer is negative (NO), the program proceeds to a step S610.

At the step S608, it is determined whether or not the count value of the timer tmOBSFS2 which was set and started at the step S614 in FIG. 27 is equal to 0. When this question is first made, tmOBSFS2>0 holds, and therefore the program is immediately terminated. On the other hand, if tmOBSFS2=0 holds, it is determined that the response speed of the LAF sensor 17 has become higher, and then the first determination flag FLAFFAST is set to "1" at a step S609, followed by terminating the present routine.

At the step S610 and steps S611 to S613, it is determined whether or not the relationships in value between the correction coefficients KOBSV#2 and KOBSV#4 and the predetermined determination values KOBSFSHH, KOBSFSHL, KOBSFSLL and KOBSFSLH show the second determination pattern. More specifically, it is determined at the step S610 whether or not the correction coefficient KOBSV#2 is smaller than the first lower determination value KOBSFSLL and at the same time the correction coefficient KOBSV#4 is larger than the second upper determination value KOBSFSHL. If the answer is affirmative (YES), which means that the correction coefficients KOBSV#2 and KOBSV#4 meet the second determination pattern, the program proceeds to a step S615, whereas if the answer is negative (NO), the program proceeds to the step S611.

At the step S611, it is determined whether or not the correction coefficient KOBSV#4 is smaller than the first lower determination value KOBSFSLL and at the same time the correction coefficient KOBSV#2 is larger than the second upper determination value KOBSFSHL. If the answer is affirmative (YES), which means that the correction coefficients KOBSV#2 and KOBSV#4 meet the second determination pattern, the program proceeds to the step S615, whereas if the answer is negative (NO), the program proceeds to the step S612.

At the step S612, it is determined whether or not the correction coefficient KOBSV#2 is larger than the first upper determination value KOBSFSHH and at the same time the correction coefficient KOBSV#4 is smaller than the second lower determination value KOBSFSLH. If the answer is affirmative (YES), which means that the correction coefficients KOBSV#2 and KOBSV#4 meet the second determination pattern, the program proceeds to the step S615, whereas if the answer is negative (NO), the program proceeds to the step S613.

At the step S613, it is determined whether or not the correction coefficient KOBSV#4 is larger than the first upper determination value KOBSFSHH and at the same time the correction coefficient KOBSV#2 is smaller than the second lower determination value KOBSFSLH. If the answer is affirmative (YES), which means that the correction coefficients KOBSV#2 and KOBSV#4 meet the second determination pattern, the program proceeds to the step S615, whereas if the answer is negative (NO), the program proceeds to the step S614.

At the step S615, it is determined whether or not the count value of the timer tmOBSFS2 which was set and started at the step S614 is equal to 0. When this question is first made, tmOBSFS2>0 holds, and therefore the program is immediately terminated. On the other hand, if tmOBSFS2=0 holds, it is determined that the response speed of the LAF sensor 17 has become lower, and then the second determination flag FLAFLATE is set to "1" at a step S616, followed by terminating 15 the present routine.

Figure 28:
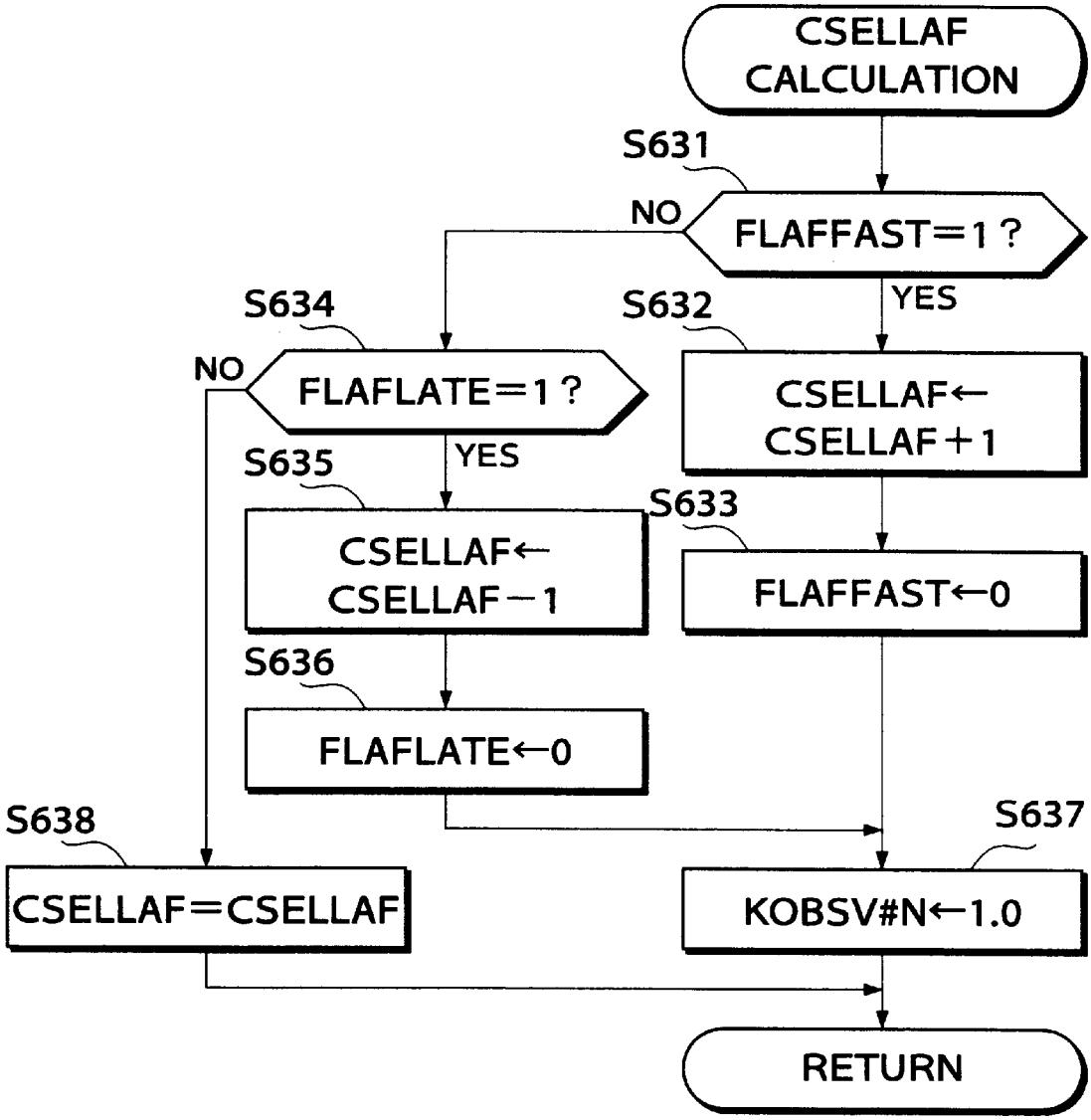
FIG. 28 is a flowchart showing a routine for calculating a correction term CSELLAF for a LAF sensor output timing-selecting parameter CSEL.

FIG. 28 shows a routine for calculating the correction term CSELLAF for the timing-selecting parameter CSEL according to the first and second determination flags FLAFFAST and FLAFLATE which were set in the process of FIGS. 26 and 27. This routine is executed in synchronism with generation of TDC signal pulses, by the CPU of the ECU 5.

First, at a step S631, it is determined whether or not the first determination flag FLAFFAST is equal to "1". If FLAFFAST=1 holds, which means that the response speed of the LAF sensor has become higher, the correction term CSELLAF is incremented by "1" at a step S632. Then, the first determination flag FLAFFAST is reset to "0" at a step S633, and the cylinder-by-cylinder correction coefficients KOBSV#N are all set to 1.0 at a step S637, followed by terminating the present routine. By incrementing the correction term CSELLAF, the timing-selecting parameter CSEL is corrected such that an output value from the LAF sensor 17 detected at earlier (older) timing is selected.

If FLAFFAST=0 holds at the step S631, it is determined at a step S634 whether or not the second determination flag FLAFLATE is equal to "1". If FLAFLATE=1 holds, which means that the response speed of the LAF sensor has become lower, the correction term CSELLAF is decremented by "1" at a step S635, and then the second determination flag FLAFLATE is reset to "0" at a step S636, followed by the program proceeding to the step S637. By decrementing the correction term CSELLAF, the timing-selecting parameter CSEL is corrected such that an output value from the LAF sensor 17 detected at later (newer) timing is selected.

If the first and second determination flags FLAFFAST and FLAFLATE are both equal to "0", the correction term CSELLAF is held at the last value thereof at a step S638, followed by terminating the present routine.

The correction term CSELLAF updated at the step S632 or S635 is stored in the back-up RAM as a map value of a CSELLAF map corresponding to the valve timing and the engine operating region (determined by the engine rotational speed NE and the intake pipe absolute pressure PBA) at and in which the present calculation of the CSELLAF value has been executed. The correction term CSELLAF is thus updated for each engine operating region because a suitable value of the correction term CSELLAF to compensate for the change in the response speed of the LAF sensor due to deterioration thereof varies with the engine operating region in which the sensor response speed changes.

As described above, according to the present embodiment, when the relationships in value between the cylinder-by-cylinder correction coefficient KOBSV#N and the predetermined determination values KOBSFSHH, KOBSFSHL, KOBSFSLH, and KOBSFSLL show one of the predetermined held-to-limit patterns, the cylinder-by-cylinder correction coefficient KOBSV#1 of the #1 cylinder is held at 1.0 and the other correction coefficients KOBSV#2 to KOBSV#4 of the respective #2 to #4 cylinders are calculated through the ordinary feedback control. Then, it is determined whether or not the response speed of the LAF sensor has become higher or lower based on the relationships in value between the above calculated correction coefficients KOBSV#2 to KOBSV#4 and the predetermined determination values KOBSFSHH, KOBSFSHL, KOBSFSLH and KOBSFSLL. As a result, the change of the response speed of the LAF sensor can be determined while the air-fuel ratio feedback control is executed with the ordinary repetition period. Therefore, a special process executed with a repetition period different from the ordinary repetition period as employed in the prior art is not required. Further, since the timing-selecting parameter CSEL is corrected based on the results of the response speed-determining process, the cylinder-by-cylinder air-fuel ratio feedback control can be carried out in an excellent manner even if the response speed of the LAF sensor changes due to deterioration of the same.

Although in the above embodiment, the correction coefficient KOBSV#1 of the #1 cylinder is held at 1.0 to carry out the LAF sensor response speed-determining process, this is not limitative. Alternatively, any of the other correction coefficients KOBSV#2 to KOBSV#4 may be held at 1.0. In such a case, the parameters employed in the process of FIGS. 26 and 27 should be changed in the following manner, to thereby carry out the LAF sensor response speed-determining process:

a) When the cylinder-by-cylinder correction coefficient KOBSV#2 of the #2 cylinder is held at 1.0:
KOBSV#3→KOBSV#1
KOBSV#4→KOBSV#3
KOBSV#2→KOBSV#4 b) When the cylinder-by-cylinder correction coefficient KOBSV#3 of the #3 cylinder is held at 1.0:
KOBSV#3→KOBSV#4
KOBSV#4→KOBSV#2
KOBSV#2→KOBSV#1 c) When the cylinder-by-cylinder correction coefficient KOBSV#4 of the #4 cylinder is held at 1.0:
KOBSV#3→KOBSV#2
KOBSV#4→KOBSV#1
KOBSV#2→KOBSV#3

If the cylinder of which the correction coefficient KOBSV#N is held at 1.0 is referred to as "the held cylinder", the above described first and second determination patterns are defined as follows:

The first pattern is for determining that the response speed of the LAF sensor 17 has become higher. In this pattern, the correction coefficient KOBSV(k+1) of the cylinder which is fired next to the held cylinder is held at the limit value and at the same time the correction coefficient KOBSV(k+2) of the cylinder which is fired two strokes later than the held cylinder deviates in the direction opposite to the correction coefficient KOBSV(k+1), or in some cases, the correction coefficient KOBSV(k+2) of the cylinder which is fired two strokes later than the held cylinder is held at the limit value and at the same time the correction coefficient KOBSV(k+1) of the cylinder which is fired next to the held cylinder deviates in the direction opposite to the correction coefficient KOBSV(k+2).

The second pattern is for determining that the response speed of the LAF sensor 17 has become lower. In this pattern, the correction coefficient KOBSV(k+3) of the cylinder which is fired three strokes later than the held cylinder is held at the limit value and at the same time the correction coefficient KOBSV(k+2) of the cylinder which is fired two strokes later than the held cylinder deviates in the direction opposite to the correction coefficient KOBSV(k+3), or in some cases, the correction coefficient KOBSV(k+2) of the cylinder which is fired two strokes later than the held cylinder is held at the limit value and at the same time the correction coefficient KOBSV(k+3) of the cylinder which is fired three strokes later than the held cylinder deviates in the direction opposite to the correction coefficient KOBSV(k+2).

Further, if the first determination flag FLAFFAST or the second determination flag FLAFLATE becomes equal to "1" through execution of the LAF sensor response speed-determining process, a caution lamp may be lighted to caution the driver of the fact that the LAF sensor is deteriorated (though it can still be used). Further, if the timing-selecting parameter CSEL after the correction thereof by the correction term CSELLAF is held at "0 (minimum value)" or "17 (maximum value)", i.e. if FLAFLATE=1 holds with the CSEL value being 0, or if FLAFFAST=1 holds with the CSEL value being 17, an alarm lamp may be lighted to warn the driver of the fact that the LAF sensor 17 is seriously deteriorated (it cannot be used anymore). These processes are not illustrated in the figures, which, however, are preferably executed by the ECU 5.

Although in the above described embodiment, the CSELLAF map is stored in the back-up RAM, and the set value of the CSELLAF map is updated according to the change of the LAF sensor responses speed, alternatively the set value of the CSEL map may be updated in the following manner: That is, the CSEL map is usually stored in the ROM, and when the CSEL map is actually used, it is once read out from the ROM and stored in the RAM at a calculation working area thereof. The set value of the CSEL map read out and stored in the RAM is updated in the same manner as the updating of the correction term CSELLAF as described above. The updated CSEL value is stored in the back-up RAM in a manner corresponding to the engine operating region in which the CSEL value is updated. Then, after turning-on of the ignition switch, when the CSEL map is read out from the ROM and stored in the RAM, the contents of the updated data stored in the back-up RAM are reflected upon the set value of the CSEL map so as to obtain an appropriate value of the timing-selecting parameter CSEL to the change of the response speed of the LAF sensor, similarly to the manner described in the above embodiment.

Next, description will be made of a third embodiment of the invention with reference to FIGS. 30 to 34.

In the second embodiment, the correction coefficient KOBSV#N of a particular one of the cylinders is held at 1.0 to thereby determine the change of the LAF sensor response speed. The third embodiment, however, employs a process for always sequentially changing the cylinder of which the correction coefficient KOBSV#N is held at 1.0, to determine the change of the response speed of the LAF sensor 17. This makes it possible to eliminate the process for determining the KOBSV#N held-to-limit state of FIGS. 19 and 25. Only those which are distinguished from the second embodiment will be described hereunder.

Figure 30:
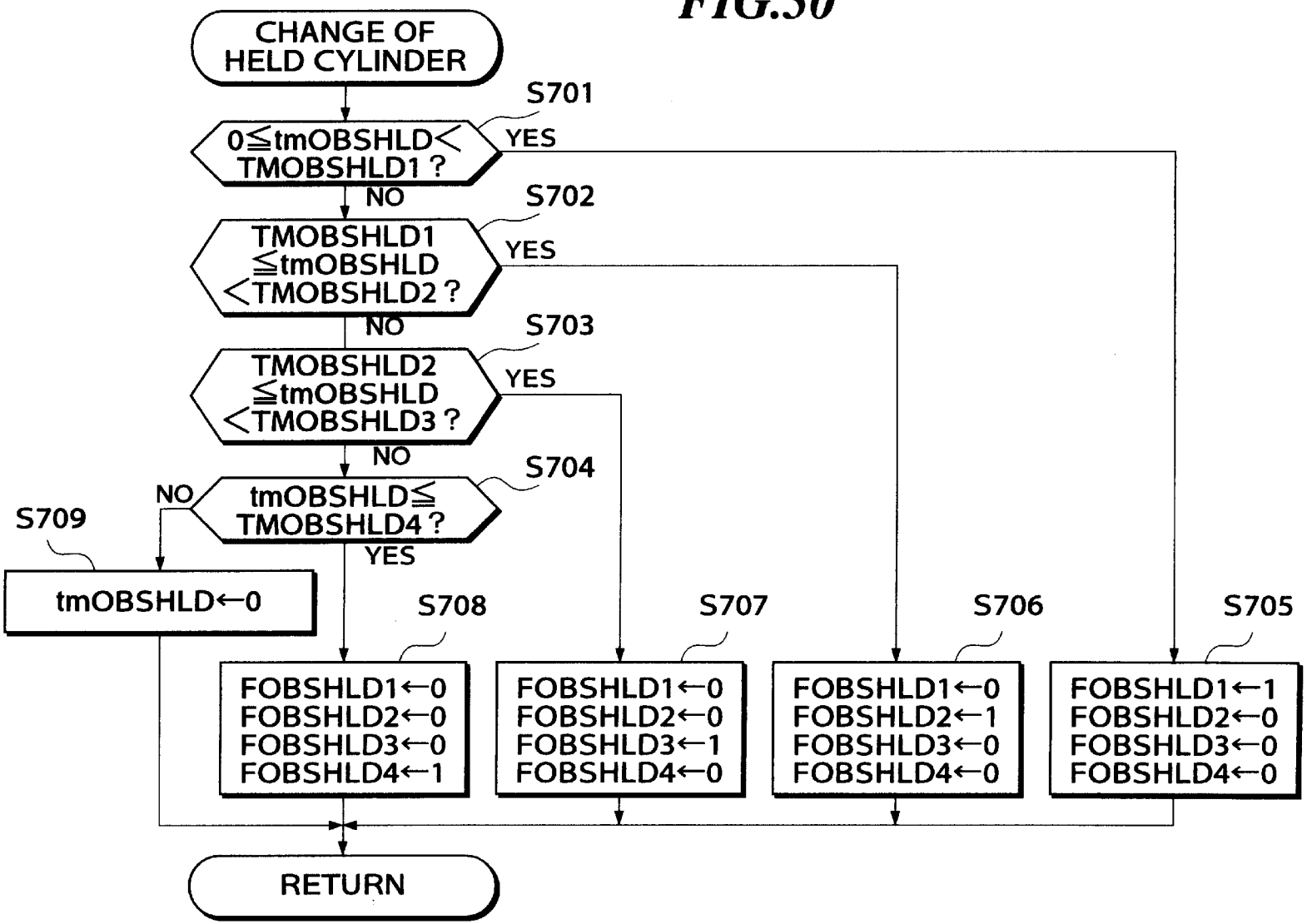
FIG. 30 is a flowchart showing a routine for changing a cylinder for which the cylinder-by-cylinder correction coefficient KOBSV#N is to be held, according to a third embodiment of the invention.

FIG. 30 shows a routine for carrying out a held cylinder-changing process, which is executed in synchronism with generation of TDC signal pulses, by the CPU of the ECU 5.

First, at a step S701, it is determined whether or not the count value of an up-counting timer tmOBSHLD is equal to or larger than 0 and at the same time smaller than a first predetermined time period TMOBSHLD1 (e.g. 1 min). If the answer is affirmative (YES), the program proceeds to a step S705, wherein a #1 cylinder-holding flag FOBSHLD1 which, when set to "1", indicates that the #1 cylinder is to be the held cylinder, is set to "1" and at the same time #2 to #4 cylinder-holding flags FOBSHLD2 to FOBSHLD4 are set to "0", followed by terminating the present routine.

If the answer to the question of the step S701 is negative (NO), it is determined at a step S702 whether or not the count value of the up-counting timer tmOBSHLD is equal to or larger than the first predetermined time period TMOBSHLD1 and at the same time smaller than a second predetermined time period TMOBSHLD2 (e.g. 2 min). If the answer is affirmative (YES), the program proceeds to a step S706, wherein the #2 cylinder-holding flag FOBSHLD2 which, when set to "1", indicates that the #2 cylinder is to be the held cylinder, is set to "1" and at the same time the #1, #3 and #4 cylinder-holding flags FOBSHLD1, FOBSHLD3, and FOBSHLD4 are set to "0", followed by terminating the present routine.

If the answer to the question of the step S702 is negative (NO), it is determined at a step S703 whether or not the count value of the up-counting timer tmOBSHLD is equal to or larger than the second predetermined time period TMOBSHLD2 and at the same time smaller than a third predetermined time period TMOBSHLD3 (e.g. 3 min). If the answer is affirmative (YES), the program proceeds to a step S707, wherein the #3 cylinder-holding flag FOBSHLD3 which, when set to "1", indicates that the #3 cylinder is to be the held cylinder, is set to "1" and at the same time the #1, #2 and #4 cylinder-holding flags FOBSHLD1, FOBSHLD2, and FOBSHLD4 are set to "0", followed by terminating the present routine.

If the answer to the question of the step S703 is negative (NO), it is determined at a step S704 whether or not the count value of the up-counting timer tmOBSHLD is equal to or smaller than a fourth predetermined time period TMOBSHLD4 (e.g. 4 min). If the answer is affirmative (YES), the program proceeds to a step S708, wherein the #4 cylinder-holding flag FOBSHLD4 which, when set to "1", indicates that the #4 cylinder is to be the held cylinder, is set to "1" and at the same time the #1, #2 and #3 cylinder-holding flags FOBSHLD1, FOBSHLD2, and FOBSHLD3 are set to "0", followed by terminating the present routine.

If the answer to the question at the step S704 is negative (NO), the count value of the timer tmOBSHLD is reset to "0" at a step S709, followed by terminating the present routine.

Figure 31:
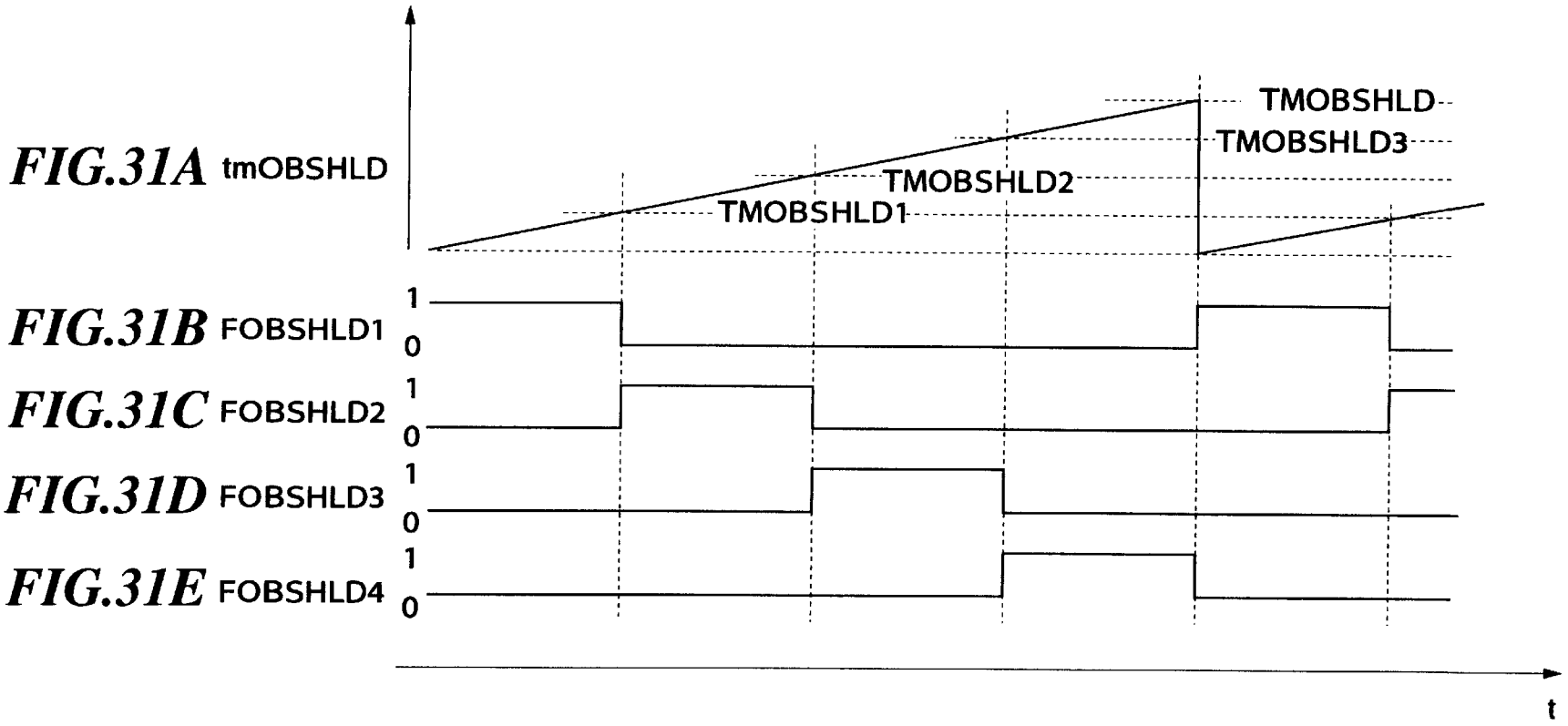

According to the above described held cylinder-changing process, the cylinder to be set as the held cylinder is sequentially changed from the #1 cylinder to the #4 cylinder, as shown in FIG. 31, and after the #4 cylinder is set as the held cylinder, the #1 cylinder is again set as the held cylinder, to thereby repeatedly execute the above process.

Figure 32:
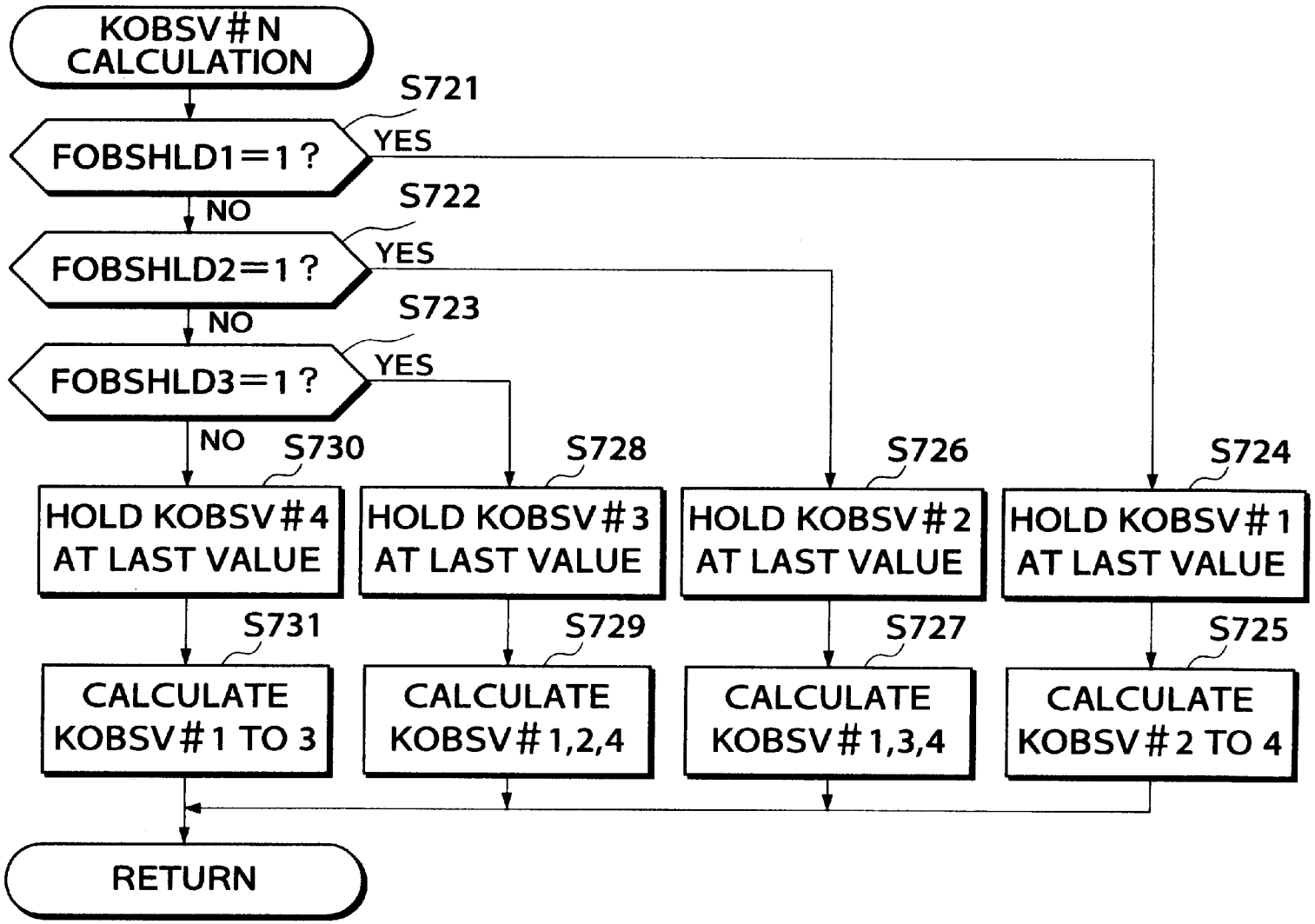
FIG. 32 is a flowchart showing a routine for calculating the cylinder-by-cylinder correction coefficient KOBSV#N according to the third embodiment, which corresponds to the FIG. 24 routine in the second embodiment.

FIG. 32 shows a routine for calculating the correction coefficient KOBSV#N according to the third embodiment, which is executed in place of the FIG. 24 routine in the second embodiment.

First, at a step S721, it is determined whether or not the #1 cylinder-holding flag FOBSHLD1 is equal to "1". If FOBSHLD1=1 holds, the correction coefficient KOBSV#1 is held at the last KOBSV#1 value at a step S724 and at the same time the other correction coefficients KOBSV#2 to KOBSV#4 are calculated through the ordinary feedback control by the use of the equations (13A) to (13C) and (14) at a step S725, followed by terminating the present routine.

If FOBSHLD1=0 holds at the step S721, it is determined at a step S722 whether or not the #2 cylinder-holding flag FOBSHLD2 is equal to "1". If FOBSHLD2=1 holds, the correction coefficient KOBSV#2 is held at the last KOBSV#2 value at a step S726, and the other correction coefficients KOBSV#1, KOBSV#3, and KOBSV#4 are calculated through the ordinary feedback control at a step S727, followed by terminating the present routine.

If FOBSHLD2=0 holds at the step S722, it is determined at a step S723 whether or not the #3 cylinder-holding flag FOBSHLD3 is equal to "1". If FOBSILD3=1 holds, the correction coefficient KOBSV#3 is held at the last KOBSV#3 value at a step S728, and the other correction coefficients KOBSV#1, KOBSV#2, and KOBSV#4 are calculated through the ordinary feedback control at a step S729, followed by terminating the present routine.

If FOBSHLD3=0 holds at the step S723, the correction coefficient KOBSV#4 is held at the last KOBSV#4 value at a step S730, and the other correction coefficients KOBSV#1, KOBSV#2, and KOBSV#3 are calculated through the ordinary feedback control at a step S731, followed by terminating the present routine.

Figure 33:
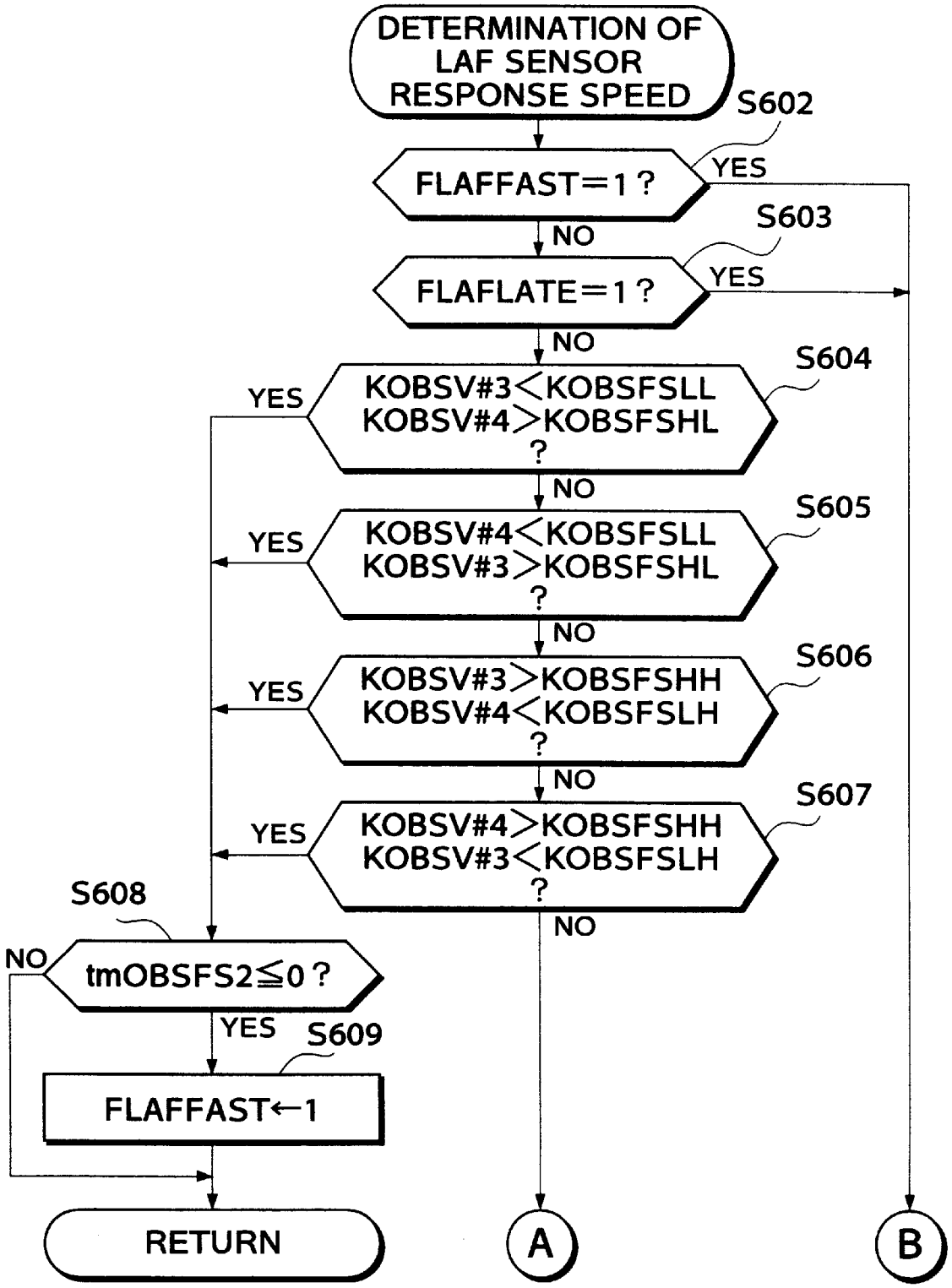
FIG. 33 is a flowchart showing a routine for determining the response speed of the LAF sensor, which corresponds to the FIG. 26 routine in the second embodiment.

By executing the FIG. 32 process, the cylinder-by-cylinder air-fuel ratio feedback control is carried out while the held cylinder is changed. If the #1 cylinder is set as the held cylinder, a LAF sensor response speed-determining process of FIG. 33 and FIG. 27 is carried out. FIG. 33 in the present embodiment corresponds to FIG. 26 in the second embodiment but is distinguished from the latter in that the step S601 in FIG. 26 is deleted. Therefore, the LAF sensor response speed-determining process in the present embodiment is carried out by the process of FIGS. 33 and 27. Further, if the #2 cylinder is set as the held cylinder, the parameters in the FIGS. 33 and 27 process are changed in the following manner, to thereby carry out the LAF sensor response speed-determining process: KOBSV#3 KOBSV#1, KOBSV#4→KOBSV#3, KOBSV#2→KOBSV#4. If the #3 cylinder is set as the held cylinder, the parameters in the FIGS. 33 and 27 process are changed in the following manner, to thereby carry out the LAF sensor response speed-determining process: KOBSV#3→KOBSV#4, KOBSV#4→KOBSV#2, KOBSV#2→KOBSV#1. If the #4 cylinder is set as the held cylinder, the parameters in the FIGS. 33 and 27 process are changed in the following manner, to thereby carry out the LAF sensor response speed-determining process: KOBSV#3→KOBSV#2, KOBSV#4→KOBSV#1, KOBSV#2→KOBSV#3. Thus, by carrying out the LAF sensor response speed-determining process in a manner corresponding to the held cylinder, the change of the LAF sensor response speed can be determined while the ordinary air-fuel ratio feedback control is executed.

Figure 34:
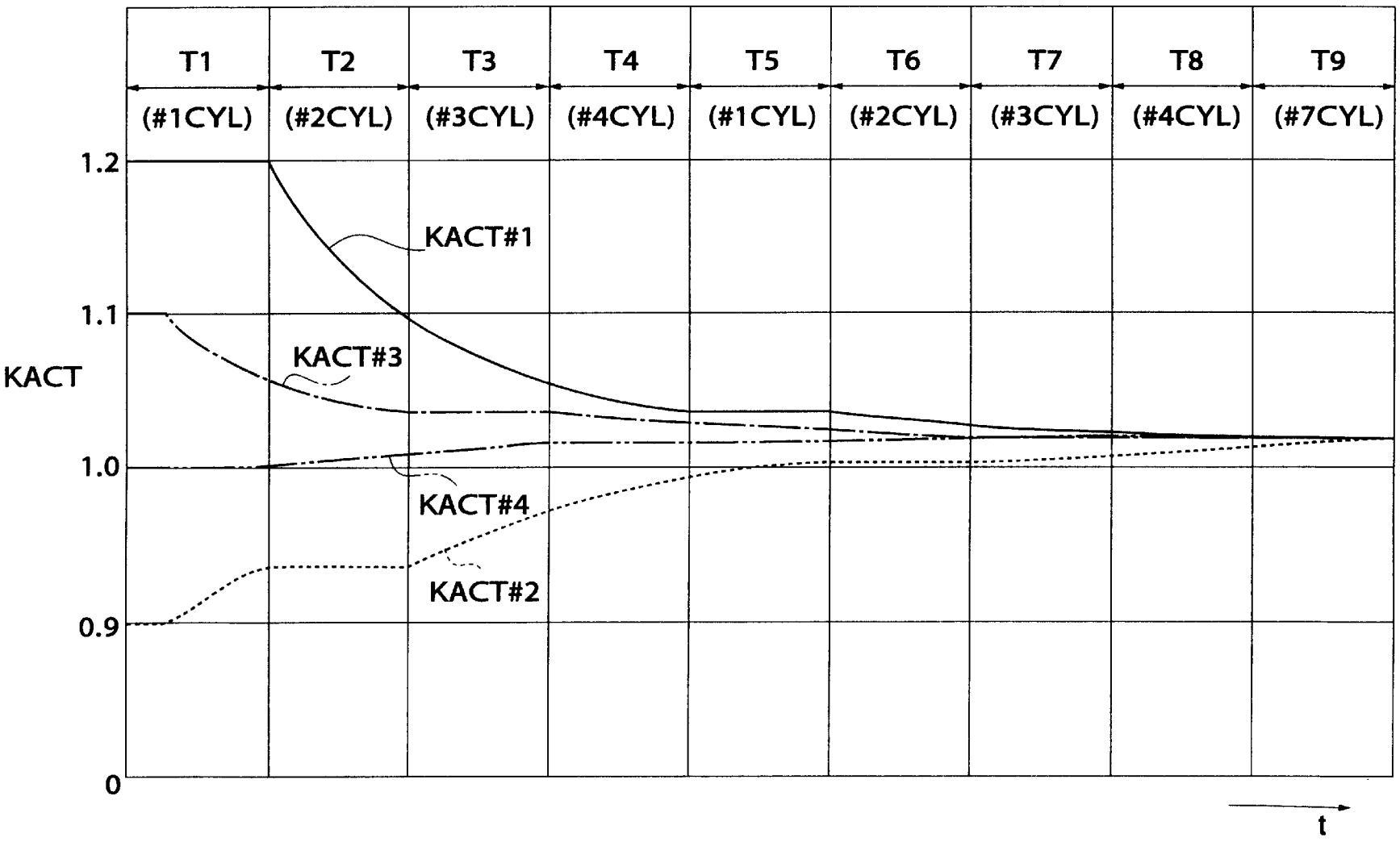
FIG. 34 is a timing chart showing the relationship between cylinder-by-cylinder actual equivalent ratio values KACT#1 to KACT#4 with the lapse of time.

FIG. 34 shows changes in the cylinder-by-cylinder actual equivalent ratios KACT#1 to #4 with the lapse of time obtained when the LAF sensor 17 is not deteriorated, by executing the cylinder-by-cylinder air-fuel ratio feedback control while the held cylinder is sequentially changed. In the figure, initial values of the KACT#1 to KACT#4 are respectively set to 1.2, 0.9, 1.1, and 1.0, and the #1 cylinder is set as the held cylinder over a time period T1, the #2 cylinder over a time period T2, the #3 cylinder over a time period T3, and the #4 cylinder over a time period T4, and the same process is repeatedly executed thereafter. As is apparent from the figure, even if one of the cylinders is set as the held cylinder, the held cylinder is sequentially changed, and therefore the air-fuel ratios of the cylinders can be converged to almost the same value. As a result, the control performance of the cylinder-by-cylinder air-fuel ratio feedback control is hardly degraded compared with the control performance of the same executed without providing the held cylinder.

Except for the above, the third embodiment is identical with the second embodiment, that is, the timing-selecting parameter CSEL is corrected according to the change of the LAF sensor response speed, to thereby always carry out the feedback control, based on the LAF sensor output which is obtained at the optimum timing.

As described hereinabove, according to the present embodiment, the cylinder-by-cylinder air-fuel ratio feedback control is executed with one of the cylinders set as the held cylinder, while the held cylinder is sequentially changed, to thereby carry out the LAF sensor response speed-determining process depending on the held cylinder. As a result, the change of the LAF sensor response speed can be quickly determined during execution of the ordinary feedback control. Further, since the timing-selecting parameter CSEL is corrected based on results of the determination of the sensor response speed, excellent control performance can be secured.

In the present embodiment, similarly to the second embodiment, if the first determination flag FLAFFAST or the second determination flag FLAFLATE is equal to "1" through execution of the LAF sensor response speed-determining process, a caution lamp may be lighted to caution the driver of the fact that the LAF sensor 17 is deteriorated (though it can still be used). Further, if the timing-selecting parameter CSEL after the correction by the correction term CSELLAF is held at "0 (minimum value)" or "17 (maximum value)", i.e. if FLAFLATE=1 holds with the CSEL value being 0, or if FLAFFAST=1 holds with the CSEL value being 17, an alarm lamp may be lighted to warn the driver of the fact that the LAF sensor 17 has been seriously deteriorated (it cannot be used anymore).

Next, description will be made of a fourth embodiment of the invention.

In the second embodiment described before, the first determination pattern is defined as the pattern for determining that the response speed of the LAF sensor 17 has become higher, i.e. the pattern that with the cylinder-by-cylinder correction coefficient KOBSV#1 of the #1 cylinder held at 1.0, the correction coefficient KOBSV#3 of the #3 cylinder (fired next to the #1 cylinder) is held at the limit value and at the same time the correction coefficient KOBSV#4 of the #4 cylinder (fired two strokes later than the #1 cylinder) deviates in a direction opposite to the correction coefficient KOBSV#3, or in some cases, the correction coefficient KOBSV#4 of the #4 cylinder is held at the limit value and at the same time the correction coefficient KOBSV#3 of the #3 cylinder deviates in a direction opposite to the correction coefficient KOBSV#4. The second determination pattern is defined as the pattern for determining that the response speed of the LAF sensor 17 has become lower, i.e. the pattern that with the cylinder-by-cylinder correction coefficient KOBSV#1 of the #1 cylinder held at 1.0, the correction coefficient KOBSV#2 of the #2 cylinder (fired three strokes later than the #1 cylinder) is held at the limit value and at the same time the correction coefficient KOBSV#4 of the #4 cylinder (fired two strokes later than the #1 cylinder) deviates in a direction opposite to the correction coefficient KOBSV#2, or in some cases, the correction coefficient KOBSV#4 of the #4 cylinder is held at the limit value and at the same time the correction coefficient KOBSV#2 of the #2 cylinder deviates in a direction opposite to the correction coefficient KOBSV#4.

According to the fourth embodiment, however, these two determination patterns may be defined in a different manner from the above manner:

For example, the first determination patterns is defined such that with the cylinder-by-cylinder correction coefficient KOBSV#1 of the #1 cylinder held at 1.0, the correction coefficient KOBSV#3 of the #3 cylinder (fired next to the #1 cylinder (one stroke later than the #1 cylinder)) or the correction coefficient KOBSV#4 of the #4 cylinder (fired two strokes later than the #1 cylinder) is held at the limit value and at the same time the correction coefficient KOBSV#2 of the #2 cylinder (fired three strokes later than the #1 cylinder) remains in a range between the first lower determination value KOBSFSLL and the first upper determination value KOBSFSHH over a predetermined time period TMOBSFS3 (e.g. 10 sec) or more. On the other hand, the second determination parameter is defined such that with the cylinder-by-cylinder correction coefficient KOBSV#1 of the #1 cylinder held at 1.0, the correction coefficient KOBSV#4 of the #4 cylinder (fired two strokes later than the #1 cylinder) or the correction coefficient KOBSV#2 of the #2 cylinder (fired three strokes later than the #1 cylinder) is held at the limit value and at the same time the correction coefficient KOBSV#3 of the #3 cylinder (fired one stroke later than the #1 cylinder) remains in the range between the first lower determination value KOBSFSLL and the first upper determination value KOBSFSHH over the predetermined time period TMOBSFS3 or more. The determining process using the above determination patterns is for determining whether or not the patterns shown in FIGS. 29A and 29B are detected, in a manner different from the manner of the process of FIGS. 26 and 27. Even based on the above patterns according to the present embodiment, the change of the response speed of the LAF sensor 17 can be determined, similarly to the process of FIGS. 26 and 27 in the second embodiment.

In other words, if the cylinder of which the correction coefficient KOBSV#N is held at 1.0 is set as the "held cylinder", the first and second determination patterns according to the present embodiment are defined as follows:

When the cylinder-by-cylinder correction coefficient KOBSV(k+1) of the cylinder to be fired next to the held cylinder (one stroke later than the held cylinder) or the correction coefficient KOBSV(k+2) of the cylinder to be fired two strokes later than the held cylinder is held at the limit value and at the same time the correction coefficient KOBSV(k+3) of the cylinder to be fired three strokes later than the held cylinder remains in the range between the first lower determination value KOBSFSLL and the first upper determination value KOBSFSHH over the predetermined time period TMOBSFS3 (e.g. 10 sec) or more, this pattern is defined as the first determination pattern. When the correction coefficient KOBSV(k+2) of the cylinder to be fired two strokes later than the held cylinder or the correction coefficient KOBSV(k+3) of the cylinder to be fired three strokes later than the held cylinder is held at the limit value and at the same time the correction coefficient KOBSV(k+1) of the cylinder to be fired next to the held cylinder remains in the range between the first lower determination value KOBSFSLL and the first upper determination value KOBSFSHH over the predetermined time period TMOBSFS3 (e.g. 10 sec) or more, this pattern is defined as the second determination pattern.

Except for the above, the fourth embodiment is identical with the second embodiment. According to the present embodiment, the ECU 5 executes a determination as to whether or not the relationship in value between the cylinder-by-cylinder correction coefficient KOBSV#N and the predetermined determination values KOBSFSLL and KOBSFSHH corresponds to the first determination pattern or the second determination pattern, to thereby judge the change of the response speed of the LAF sensor 17.

What is claimed is:

1. In an air-fuel ratio control system for an internal combustion engine having a plurality of cylinders, and an exhaust system, including air-fuel ratio-detecting means arranged in said exhaust system, for detecting an air-fuel ratio of exhaust gases from said engine, cylinder-by-cylinder air-fuel ratio-estimating means for estimating an air-fuel ratio of a mixture supplied to each of said cylinders cylinder by cylinder in response to an output from said air-fuel ratio-detecting means, by using an observer for observing an internal operative state of said exhaust system based on a model representative of a behavior of said exhaust system, and cylinder-by-cylinder air-fuel ratio control means for calculating cylinder-by-cylinder air-fuel ratio control amounts corresponding respectively to said cylinders for carrying out feedback control of said air-fuel ratio of said mixture supplied to said each of said cylinders such that said estimated air-fuel ratio of said mixture supplied to said each of said cylinders is converged to a desired value, the improvement comprising:

response speed-determining means for holding one of said cylinder-by-cylinder air-fuel ratio control amounts corresponding to one of said cylinders at a predetermined value, determining whether relationships in value between ones of said cylinder-by-cylinder air-fuel ratio control amounts corresponding respectively to cylinders other than said one cylinder and a plurality of predetermined determination values meet a predetermined determination pattern, and determining that said response speed of said air-fuel ratio-detecting means has changed when said relationships meet said predetermined determination pattern.

2. An air-fuel ratio control system as claimed in claim 1, wherein said plurality of said predetermined determination values comprise at least one predetermined determination value which is set between a central value of said cylinder-by-cylinder air-fuel ratio control amounts and an allowable upper limit value thereof, and at least one predetermined determination value which is set between said central value and an allowable lower limit value thereof.

3. An air-fuel ratio control system as claimed in claim 1, including air-fuel ratio detection timing-correcting means responsive to a determination by said response speed-determining means that said response speed of said air-fuel ratio-detecting means has changed, for correcting timing of detection of said air-fuel ratio of said exhaust gases by said air-fuel ratio-detecting means, based on results of the determination.

4. An air-fuel ratio control system as claimed in claim 1, including deterioration-determining means responsive to a determination by said response speed-determining means that said response speed of said air-fuel ratio-detecting means has changed, for determining that said air-fuel ratio-detecting means is deteriorated.

5. An air-fuel ratio control system as claimed in claim 3, wherein said predetermined determination pattern comprises a first determination pattern for determining that said response speed of said air-fuel ratio-detecting means has increased, and a second determination pattern for determining that said response speed of said air-fuel ratio-detecting means has decrased, said air-fuel ratio detection timing-correcting means correcting said timing of detection in a direction depending on whether said response speed-determining means has determined that said relationships meet said first determination pattern or said second determination pattern.

6. An air-fuel ratio control system as claimed in claim 1, wherein said response speed-determining means determines whether second relationships in value between said cylinder-by-cylinder air-fuel ratio control amounts corresponding respectively to all said cylinders and said plurality of predetermined determination values meet a predetermined held-to-limit pattern, and wherein when said second relationships meet said predetermined held-to-limit pattern, said response speed-determining means holds said one of said cylinder-by-cylinder air-fuel ratio control amounts corresponding to said one cylinder at said predetermined value and at the same time said cylinder-by-cylinder air-fuel ratio control means calculates said cylinder-by-cylinder air-fuel ratio control amounts corresponding respectively to said cylinders other than said one cylinder, said response speed-determining means determining whether said first-mentioned relationships in value between the calculated cylinder-by-cylinder air-fuel ratio control amounts and said plurality of said predetermined determination values meet said predetermined determination pattern, and determining that said response speed of said air-fuel ratio-detecting means has changed when said first-mentioned relationships meet said predetermined determination pattern.

7. An air-fuel ratio control system as claimed in any of claims 1 to 6, wherein said response speed-determining means sequentially changes said one cylinder of which said one of said cylinder-by-cylinder air-fuel ratio control amounts is held at said predetermined value, with a predetermined repetition period.

8. In an air-fuel ratio control system for an internal combustion engine having a plurality of cylinders, and an exhaust system, including air-fuel ratio-detecting means arranged in said exhaust system, for detecting an air-fuel ratio of exhaust gases from said engine, cylinder-by-cylinder air-fuel ratio-estimating means for estimating an air-fuel ratio of a mixture supplied to each of said cylinders cylinder by cylinder in response to an output from said air-fuel ratio-detecting means, by using an observer for observing an internal operative state of said exhaust system based on a model representative of a behavior of said exhaust system, and cylinder-by-cylinder air-fuel ratio control means for calculating cylinder-by-cylinder air-fuel ratio control amounts corresponding respectively to said cylinders for carrying out feedback control of said air-fuel ratio of said mixture supplied to said each of said cylinders such that said estimated air-fuel ratio of said mixture supplied to said each of said cylinders is converged to a desired value, the improvement comprising:

cylinder-by-cylinder control-interrupting means for determining whether relationships in value between said cylinder-by-cylinder air-fuel ratio control amounts corresponding respectively to said cylinders and a plurality of predetermined determination values meet a predetermined held-to-limit pattern, and interrupting said feedback control by said cylinder-by-cylinder air-fuel ratio control means when said relationships meet said predetermined held-to-limit pattern.

9. An air-fuel ratio control system as claimed in claim 8, wherein said cylinder-by-cylinder control-interrupting means interrupts said feedback control by said cylinder-by-cylinder air-fuel ratio control means when said relationships have continuously met said predetermined held-to-limit state over a predetermined time period.

10. An air-fuel ratio control system as claimed in claim 8 or 9, including learned value-calculating means for calculating learned values of said cylinder-by-cylinder air-fuel ratio control amounts, and wherein said cylinder-by-cylinder control-interrupting means interrupts calculation of said learned values by said learned value-calculating means and at the same time initializes said learned values to a predetermined value when said relationships meet said predetermined held-to-limit pattern.

11. An air-fuel ratio control system as claimed in claim 8, wherein said predetermined held-to-limit pattern is a pattern in which cylinder-by-cylinder air-fuel ratio control amounts corresponding to a cylinder group consisting of cylinders in which ignition takes place every other stroke deviate in the same direction and at the same time at least one of said cylinder-by-cylinder air-fuel ratio control amounts corresponding to at least one of said cylinders falls out of a range defined by said predetermined determination values.

12. An air-fuel ratio control system as claimed in claim 11, wherein said plurality of said predetermined determination values comprise at least one predetermined determination value which is set between a central value of said cylinder-by-cylinder air-fuel ratio control amounts and an allowable upper limit value thereof, and at least one predetermined determination value which is set between said central value and an allowable lower limit value thereof.

* * * * *